US012575688B2

(12) United States Patent
Thorne

(10) Patent No.: US 12,575,688 B2
(45) Date of Patent: Mar. 17, 2026

(54) PLAY YARD

(71) Applicant: Henry F. Thorne, Sewickley, PA (US)

(72) Inventor: Henry F. Thorne, Sewickley, PA (US)

( * ) Notice: Subject to any disclaimer, the term of this patent is extended or adjusted under 35 U.S.C. 154(b) by 170 days.

(21) Appl. No.: 18/599,887

(22) Filed: Mar. 8, 2024

(65) Prior Publication Data

US 2024/0206646 A1 Jun. 27, 2024

Related U.S. Application Data

(60) Continuation-in-part of application No. 18/135,267, filed on Apr. 17, 2023, now Pat. No. 12,458,154, and a continuation-in-part of application No. 18/107,645, filed on Feb. 9, 2023, now Pat. No. 12,035,817, said application No. 18/135,267 is a continuation-in-part of application No. PCT/US2021/055353, filed on Oct. 18, 2021, said application No. 18/107,645 is a division of application No. 16/904,061, filed on Jun. 17, 2020, now Pat. No. 11,589,686.

(60) Provisional application No. 63/092,548, filed on Oct. 16, 2020, provisional application No. 62/862,195, filed on Jun. 17, 2019.

(51) Int. Cl.
*A47D 13/06* (2006.01)

(52) U.S. Cl.
CPC ..... *A47D 13/063* (2013.01)

(58) Field of Classification Search
None
See application file for complete search history.

(56) References Cited

U.S. PATENT DOCUMENTS

| | | | |
|---|---|---|---|
| 3,040,341 | A | 6/1962 | Hesketh et al. |
| 2006/0021137 | A1 | 2/2006 | Waldman et al. |
| 2006/0037137 | A1 | 2/2006 | Song |
| 2017/0280892 | A1 | 10/2017 | Zhang et al. |
| 2017/0312644 | A1 | 11/2017 | Meir |
| 2019/0098992 | A1 | 4/2019 | Scott et al. |
| 2020/0390250 | A1 | 12/2020 | Thorne |

OTHER PUBLICATIONS

International Search Report and Written Opinion of the International Searching Authority for PCT Application PCT/US2024/019106 dated Aug. 15, 2024.

*Primary Examiner* — Adam C Ortiz
(74) *Attorney, Agent, or Firm* — Blynn L. Shideler; Krisanne Shideler; BLK Law Group

(57) ABSTRACT

The present invention includes a mechanical control assembly and system for use with a child's folding play yard. Some embodiments of the present invention encompass a novel foot for a child's play yard. Additionally, embodiments of the present invention encompass sheet metal components for use in a child's play yard.

19 Claims, 73 Drawing Sheets

PLAY YARD

CROSS-REFERENCE TO RELATED APPLICATION

This application is a Continuation-in-Part application claiming priority to U.S. Divisional application Ser. No. 18/107,645 filed on Feb. 9, 2023, which claims priority to Nonprovisional application Ser. No. 16/904,061, filed Jun. 17, 2020 and issued as U.S. Pat. No. 11,589,686 B2 on Feb. 28, 2023, which claims the benefit under 35 U.S.C. § 119 of U.S. Provisional Application Ser. No. 62/862,195, filed Jun. 17, 2019, each of which is incorporated by reference herein in its entirety.

Second, this application is a Continuation-in-Part patent application claiming priority to U.S. application Ser. No. 18/135,267, filed on Apr. 17, 2023, which claims priority to PCT Patent Application Serial No. PCT/US2021/055353, filed on Oct. 18, 2021, which claims priority to U.S. Provisional Application Ser. No. 63/092,548, filed on Oct. 16, 2020, which are incorporated by reference herein in their entirety.

BACKGROUND OF THE INVENTION

Field of the Invention

The present invention is directed to a child's play yard and, more particularly, a child's play yard that is easy to open and easy to close into a compact arrangement when not in use.

Description of Related Art

Foldable play yards, playyards, playpens, portable cribs, and crib devices (herein collectively referred to as "play yard(s)") are well known, as exemplified by U.S. Pat. No. 4,811,437 for a "Foldable Playyard" to Dillner et al. The foldable device disclosed therein is light enough to be carried and, when collapsed, is a fairly convenient compact package. One major problem with such devices, though, is that they are difficult to handle because they are cumbersome to open and unwieldy to fold with clumsy operating mechanisms. Usually there is a need to pull up on a central lower mechanism and a need to unlatch upper rails when closing existing play yards. Additionally, many play yards currently and historically on the market suffered from severe racking during opening. To open most play yards, the user unpackaged the play yard and stood it upright on the four corner posts. The user then had to push down on a central hub to force the play yard into the open position. However, until the play yard was fully opened and secured, the entire structure would wobble or sway severely or rack side-to-side, making it difficult to control, manage and open traditional play yard structures.

Additionally, many known play yard designs require complex interconnections of linkages, cables and/or gear assemblies to obtain the desired qualities of easy operation and compact folding. However, such designs are often expensive to manufacture and require significant calibration during assembly to ensure that the play yards fold correctly. Additionally, the large number of pieces contributes to a heavier play yard that cannot be opened and closed or carried easily. Many play yards that are currently on the market employ a series of steps that the user must go through to open or close the play yard and, frequently, at least one of those steps is not intuitive. This suggests a market need for a lightweight, intuitive, easy to open and easy to close play yard.

U.S. Pat. Nos. 8,756,727 and 8,458,829 for a "Foldable Child Enclosure" to Thorne et al. are examples of play yards that can be more expensive to manufacture, require significantly more calibration during manufacture and assembly to ensure that the play yards open and close correctly, and require a larger number of pieces, which contributes to their being heavier play yards. The designs of the '727 and '829 inventions require that the posts remain almost rigid and substantially parallel to a vertical axis to create a tension within the structure that is necessary to open the play yard and to maintain the stability of the play yard both when it is opening and when it is fully open. The structure of those play yards requires a larger number of parts to achieve that stability and tension. In particular, the '727 and '829 inventions (and related inventions) utilize upper and lower leg assemblies that attach between corner posts and a central hub and form a parallelogram that acts to hold the corner posts in substantially vertical position—that is, where the deviation from vertical is no more than five-degrees (5°).

In contrast, the present invention utilizes a novel cam actuator assembly and mechanical control assembly in place of the upper and lower assemblies of the prior art. The cam actuator assembly operates to prevent the corner posts from collapsing during the opening and closing of the play yard and allows the corner posts to tilt or flex inward and/or outward during opening and closing. The cam actuator assembly interacts with a central hub and, with respect to each corner post, includes: (i) a base strut (or lower arm) that pivotably attaches at the outer end of the strut to a corresponding corner post and that also pivotably attaches at the inner end of the strut to a central hub, (ii) a strut cam rod (or push rod) associated with and oriented along the side of the base strut, with the inner end of each strut cam rod slidably mounted within a straight cam slot in the inner end of the base strut and a corresponding arc-shaped cam slot in the central hub, and the outer end of the strut cam rod slidably mounted within an arc-shaped cam slot in the outer end of the base strut and a corresponding arc-shaped cam slot in the lower end of the corresponding corner post; and (iii) an actuator rod (or pull rod) oriented along the same corner post. The actuator rod has a lower end that is slidably mounted within the cam slot in the outer end of the associated base strut and the corresponding cam slot in the lower end of the associated corner post and the upper end of the actuator rod is pivotably attached to a transfer link that is pivotably attached to an upper rail assembly. The present invention also includes a number of novel cam paths and specified angles and connections that, together, enable a simpler, lighter, and/or less expensive to manufacture play yard. The structure and mechanisms used to achieve this operation and motion in the present invention require significantly fewer parts than the prior art structures. The play yard structures in the '727 and '829 patents use almost three times as many parts than the current invention, which again results in structures that are more costly to manufacture and weigh more than the current invention.

Another drawback of many play yards that are currently on the market is that the top, bottom, and side rails are made of metal tubes (usually welded steel or extruded aluminum), which are heavier and more expensive to manufacture than the corner posts and lower arms of the current invention. The top play yards on the market today range in weight from 18.1 lbs. to 35 lbs., with an average weight of 25 lbs. These various drawbacks to the play yards that are currently on the market create a need for a play yard that is simple and intuitive to open and close and is lightweight and robust while also being easy to operate and efficient to manufacture. The play yard and structures described in this application can be manufactured to be roughly four to six pounds lighter than play yards that are currently on the market and are simpler and more intuitive to operate.

However, inventing a lighter play yard is no simple feat because the various components still need to satisfy the regulatory requirements for play yards. For example, a current United States regulation describes the static load requirement for the floor of a play yard as follows: "Place the [6"×6" ] wood blocks 6+/−½" apart. Place a 50-lb weight on one wood block and a 301*b* weight on the other wood block. Maintain for 60 seconds. Perform the test in those locations deemed to be the weakest or the most likely to fail." See ASTM Standards Section 8.12.2.1.

The blocks are placed on the mattress of the play yard and the mattress is supported by the lower arms. The two weights can be placed in such a manner that the full load of the combined weights rests on the center of the lower arm. The lower arm is supported by the hub at one end and the corner post at the other. This creates a [the following] beam loading situation, which engineers call a "Simply Loaded Beam."

In the case of a play yard with a lower arm that is approximately 24-inches, the load required by the compliance specification, W, is 80 lbs. Given that the load is in the middle of the lower arm (the worst location for it), the reaction force at A and B are both 40 lbs. The applied bending moment at the cross section at W is 40 ft lbs. To determine the stress on a beam, one must also know the beam's area moment of inertia, I. The typical rectangular beam formula for I is: I=(b×d^3)/12 where b is the beam width and d is the beam height.

The maximum stress for a rectangular beam is given by:

$$\sigma = M \times c/I = M \times c/((b \times d^{\wedge}3)/12)$$

The maximum stress is reduced by increasing the height of the beam to the cubed power whereas increasing the width only reduces the stress proportionally. Therefore, if one was to cut the width in half but double the height, the total amount of material stays the same but your stress is reduced by a factor of 4. The present invention (as described more fully herein) is configured to capitalize to utilize these laws through a novel structural design that enables the use of sheet metal for various play yard components while satisfying the current regulations on play yards. All existing play yards meet these regulations by using welded steel or extruded aluminum tube-like structures, which meet the strength requirements but are significantly heavier and more limiting in the design of play yards.

In sum, the present invention overcomes the deficiencies of existing play yards by providing a play yard that (i) is lightweight, (ii) is easy to open, (iii) does not have side walls and corner posts that collapse during the opening and closing of the play yard, and (iv) is less expensive to manufacture when compared to similar products currently on the market. The present invention overcomes these deficiencies through the use of novel cam actuator assemblies and/or novel mechanical control assemblies.

BRIEF SUMMARY OF THE INVENTION

One embodiment of the present invention is a mechanical control assembly for use with an opening and closing foldable structure having open and closed positions and comprising a frame having a plurality of corner posts, each corner post having a top and a bottom, and a plurality of upper arms which arms connect the tops of adjacent corner posts. The mechanical control assembly comprises: (1) a hub centrally located near a bottom of the foldable structure in an open position and near a top of the foldable structure in a closed position, the hub having a plurality of hub slots; (2) a plurality of lower arms each lower arm having a hub end with a lower arm hub slot and a post end with a lower arm post slot, with each lower arm connected at the lower arm post end to the bottom of one of the corner posts and at the lower arm hub end to the hub; (3) a plurality of push rods, each push rod having a push rod corner end and a push rod hub end, wherein each push rod is adjacent to a corresponding lower arm and is slidably connected at the push rod hub end to the lower arm hub slot in the corresponding lower arm hub end, with the lower arm hub slot as illustrated in FIG. 52A, and wherein the push rod corner end is slidably connected to the lower arm post slot in the corresponding lower arm post end, with the lower arm post slot as illustrated in FIG. 56; and (4) a plurality of pull rods, each pull rod having an upper end and a lower end, wherein each pull rod lower end is slidably connected to the lower arm post slot and each pull rod upper end is pivotably attached to either at least one corresponding upper arm or at least one corresponding transfer link, each transfer link having a transfer link upper end and a transfer link lower end, wherein each transfer link lower end is pivotably attached to the upper end of a corresponding pull rod and each transfer link upper end is pivotably attached to at least one corresponding upper arm. For this embodiment, each lower arm hub end and the corresponding push rod hub end also are slidably connected to one of the corresponding hub slots, with the hub slot as illustrated in FIG. 52B, and wherein each lower arm post end and the corresponding pull rod lower end and push rod corner end are slidably mounted to a first corner post mount slot in the corresponding corner post bottom, with the corner post mount slot as illustrated in FIG. 53B. Additionally, the foldable structure is enabled from a closed to an open position by exerting a downward push force on the hub, which downward push force pushes each lower arm and corresponding push rod outward against each corresponding corner post until each lower arm and corresponding push rod pull each pull rod downward until the upper arms each have a substantially horizontal position.

Another embodiment of the present invention comprises a mechanical control assembly for use with an opening and closing foldable structure having open and closed positions and comprising a frame having a plurality of corner posts, each corner post having a top and a bottom, and a plurality of upper arms which arms connect the tops of adjacent corner posts. This mechanical control assembly comprises: (1) a hub centrally located near a bottom of the foldable structure in an open position and near a top of the foldable structure in a closed position, the hub having a plurality of hub slots; (2) a plurality of lower arms each lower arm having a hub end with a lower arm hub slot and a post end with a lower arm post slot, with each lower arm connected at the lower arm post end to the bottom of one of the corner posts and at the lower arm hub end to the hub; (3) a plurality of push rods, each push rod having a push rod corner end and a push rod hub end, wherein each push rod is adjacent to a corresponding lower arm and is slidably connected at the push rod hub end to the lower arm hub slot in the corresponding lower arm hub end, wherein the push rod corner end is slidably connected to the lower arm post slot in the corresponding lower arm post end; and (4) a plurality of pull rods, each pull rod having an upper end and a lower end, wherein each pull rod lower end is slidably connected to the lower arm post slot and each pull rod upper end is pivotably attached to either at least one corresponding upper arm or at least one corresponding transfer link, each transfer link having a transfer link upper end and a transfer link lower end, wherein each transfer link lower end is pivotably attached to the upper end of a corresponding pull rod and each transfer link upper end is pivotably attached to at least one corresponding upper arm. For this embodiment, each lower arm hub end and the corresponding push rod hub end also are slidably connected to one of the corresponding hub slots, and wherein each lower arm post end and the corresponding pull rod lower end are slidably mounted to a corner post mount slot in the corresponding corner post bottom. Additionally, the foldable structure is enabled from a closed to an open position by exerting a downward push force on the hub, which downward push force pushes each lower arm and corresponding push rod outward against each corresponding corner post forcing the corner posts to an orientation that is beyond substantially parallel to vertical until each lower arm and corresponding push rod pull each pull rod downward until the upper arms each have a substantially horizontal position.

Another embodiment of the present invention is a foot for a play yard having a plurality of corner posts, with each corner post having a top and a bottom, and the foot connects to or near the bottom of a corner post and is operable to rest on a floor surface. This foot comprises: a bottom surface of the foot that faces the floor surface; a wheel that engages only during the opening and closing of the foldable structure, which wheel protrudes through the bottom surface; and a non-slip rest located on the bottom surface. Another embodiment of the present invention is a lower arm for a foldable structure comprising at least one piece of sheet metal bent to form a beam structure, wherein the beam is configured to have a height, a width, and a sheet metal thickness sufficient to satisfy any force requirements that are applicable to the foldable structure.

Another embodiment of the present invention is a corner post for a folder structure comprising at least one piece of sheet metal bent to form a hollow tube having a tube width and a sheet metal thickness sufficient to satisfy any force requirements that are applicable to the foldable structure.

BRIEF DESCRIPTION OF THE SEVERAL VIEWS OF THE DRAWINGS

For the purpose of facilitating understanding of the invention, the accompanying drawings and descriptions illustrate preferred embodiments thereof, from which the invention, various embodiments of its structures, construction and method of operation and many advantages may be understood and appreciated. The accompanying drawings are hereby incorporated by reference.

DETAILED DESCRIPTION OF THE INVENTION

Figure 1:
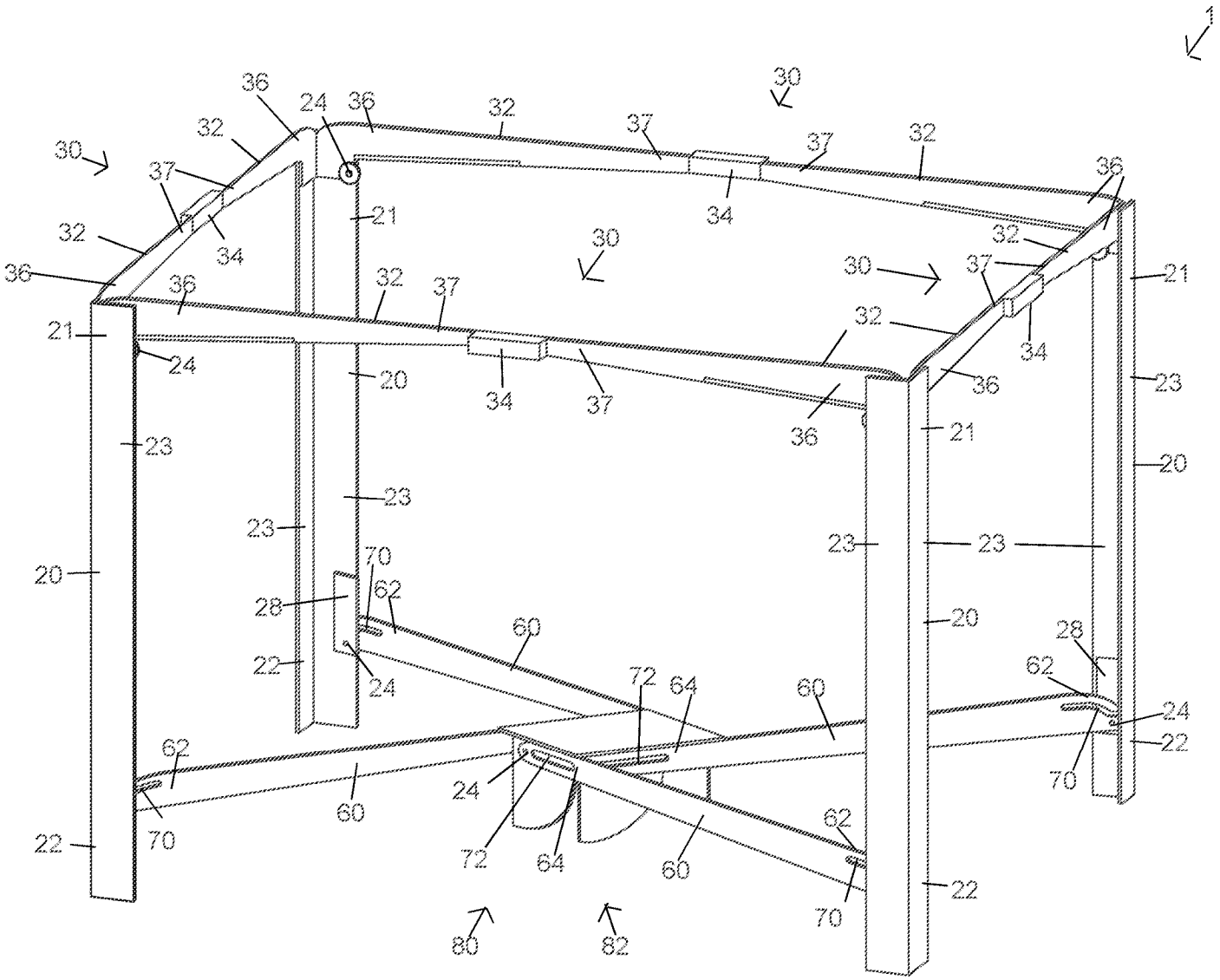
FIG. 1 is a play yard according to one embodiment of the present invention in the fully open position.

The following describes example embodiments in which the present invention may be practiced. This invention, however, may be embodied in many different ways and the description provided herein should not be construed as limiting in any way. Among other things, the following invention may be embodied as systems, methods or devices. The following detailed descriptions should not be taken in a limiting sense. The accompanying drawings are hereby incorporated by reference.

In this document, the terms "a" or "an" are used, as is common in patent documents, to include one or more than one. In this document, the term "or" is used to refer to a nonexclusive "or" such that "A or B" includes "A but not B," "B but not A," and "A and B," unless otherwise indicated. Furthermore, all publications, patents, and patent documents referred to in this document are incorporated by reference herein in their entirety, as though individually incorporated by reference. In the event of inconsistent usages between this document and those documents so incorporated by reference, the usage in the incorporated reference(s) should be considered supplementary to that of this document; for irreconcilable inconsistencies, the usage in this document controls.

In the following description, numerous specific details are set forth. However, it is to be understood that embodiments of the disclosed technology may be practiced without these specific details. In other instances, well-known methods, structures, and techniques have not been shown in detail in order not to obscure an understanding of this description. References to "one embodiment," "an embodiment," "example embodiment," "some embodiments," "certain embodiments," "various embodiments," etc., indicate that the embodiment(s) of the disclosed technology so described may include a particular feature, structure, or characteristic, but not every embodiment necessarily includes the particular feature, structure, or characteristic. Further, repeated use of the phrase "in one embodiment" does not necessarily refer to the same embodiment, although it may.

For purposes of the description hereinafter, the terms "upper", "lower", "right", "left", "vertical", "horizontal", "top", "bottom", "lateral", "longitudinal", and derivatives thereof shall relate to the invention as it is oriented in the figures. However, it is to be understood that the invention may assume alternative variations and step sequences, except where expressly specified to the contrary. It also is to be understood that the specific devices, methods, and processes illustrated in the attached drawings and described in this specification are simply exemplary embodiments of the invention. Hence, specific dimensions and other physical characteristics related to the embodiments disclosed herein are not to be considered as limiting.

As used herein, the terms "pivot" and "pivot point", when used as nouns (and "pivotably" when used as an adjective) mean a structural and functional connection between at least two components which allows at least partial rotation of the at least two components relative to one another. For example, a pivot between a rod and a strut means a physical connection between the rod and the strut that permits at least partial rotation of the rod relative to the strut, and vice versa. The pivot may include a hole in one or both of the rod and the strut, and an axial member extending through the hole(s) to constrain the rod and the strut to each other about a rotational axis. The axial member may include a pin, bolt, screw, bearing, bushing, wheel, or combination thereof to facilitate rotation of the first and second links relative to each other. It will be obvious to one skilled in the art that there are numerous structures and mechanisms that can be used to create pivot points between two or more elements to achieve the structural goals of the present invention and all such structures and mechanism as included within the scope of this application.

The terms "cam slot" and "cam path" are used interchangeably herein to mean the path that a cam roller follows within a cam slot as a play yard opens and closes. A cam slot is designed and configured to allow for the movement of a cam roller within the slot (or the movement of the slot around the roller) such that the cam roller is following a cam path created by the design and configuration of a cam slot.

The materials described hereinafter as making up the various elements of the embodiments of the present disclosure are intended to be illustrative and not restrictive. Many suitable materials that would perform the same or a similar function as the materials described herein are intended to be embraced within the scope of the example embodiments. Such other materials not described herein can include, but are not limited to, materials that are developed after the time of the development of the invention, for example.

While the disclosure has been described in detail and with reference to specific embodiments thereof, it will be apparent to one skilled in the art that various changes and modifications can be made thereto without departing from the spirit and scope of the embodiments. Thus, it is intended that this application covers modifications and variations of this disclosure provided they come within the scope of the appended claims and their equivalents.

Figure 2:
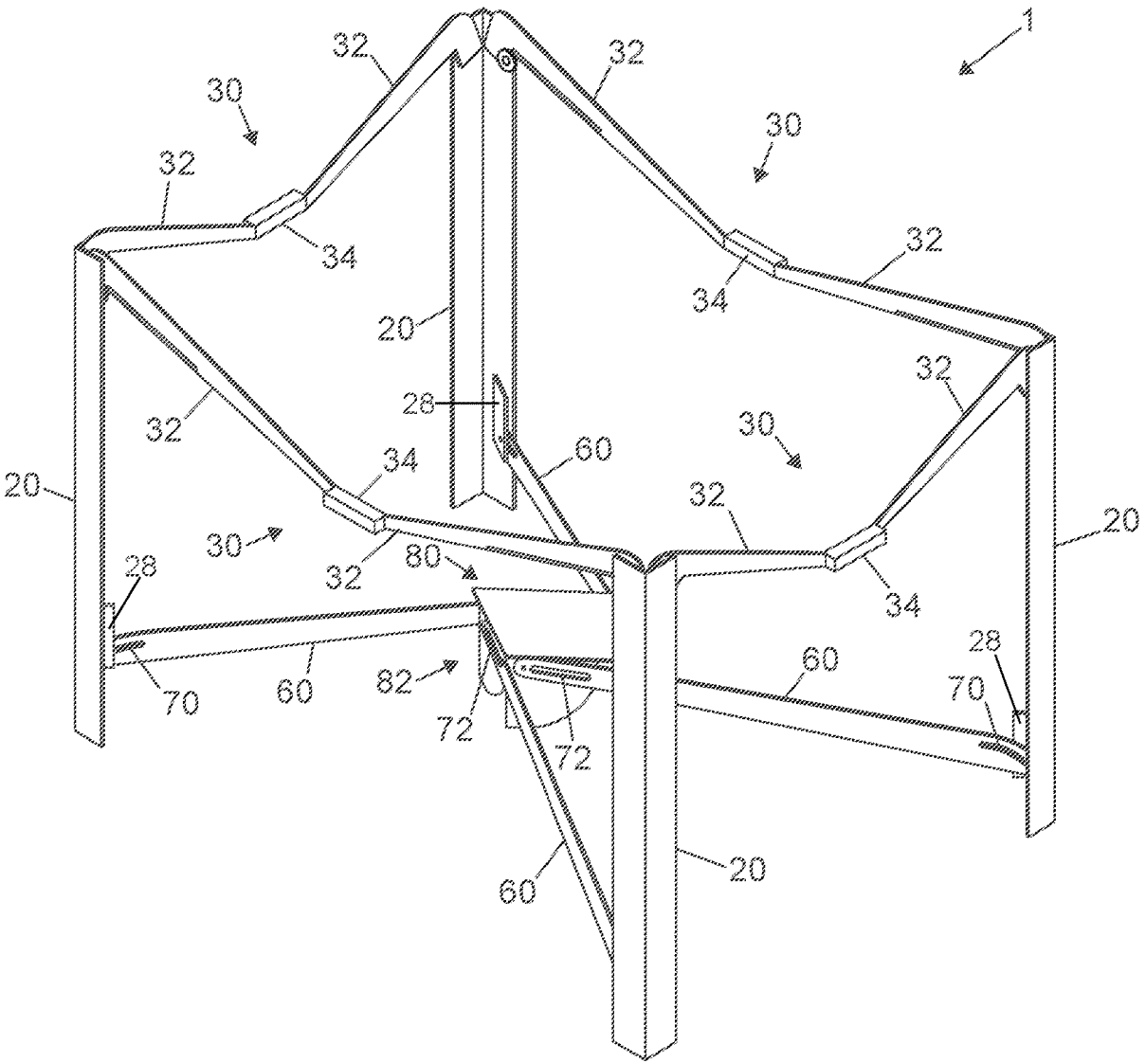
FIG. 2 is a play yard according to one embodiment of the present invention in an intermediate position.
Figure 48:
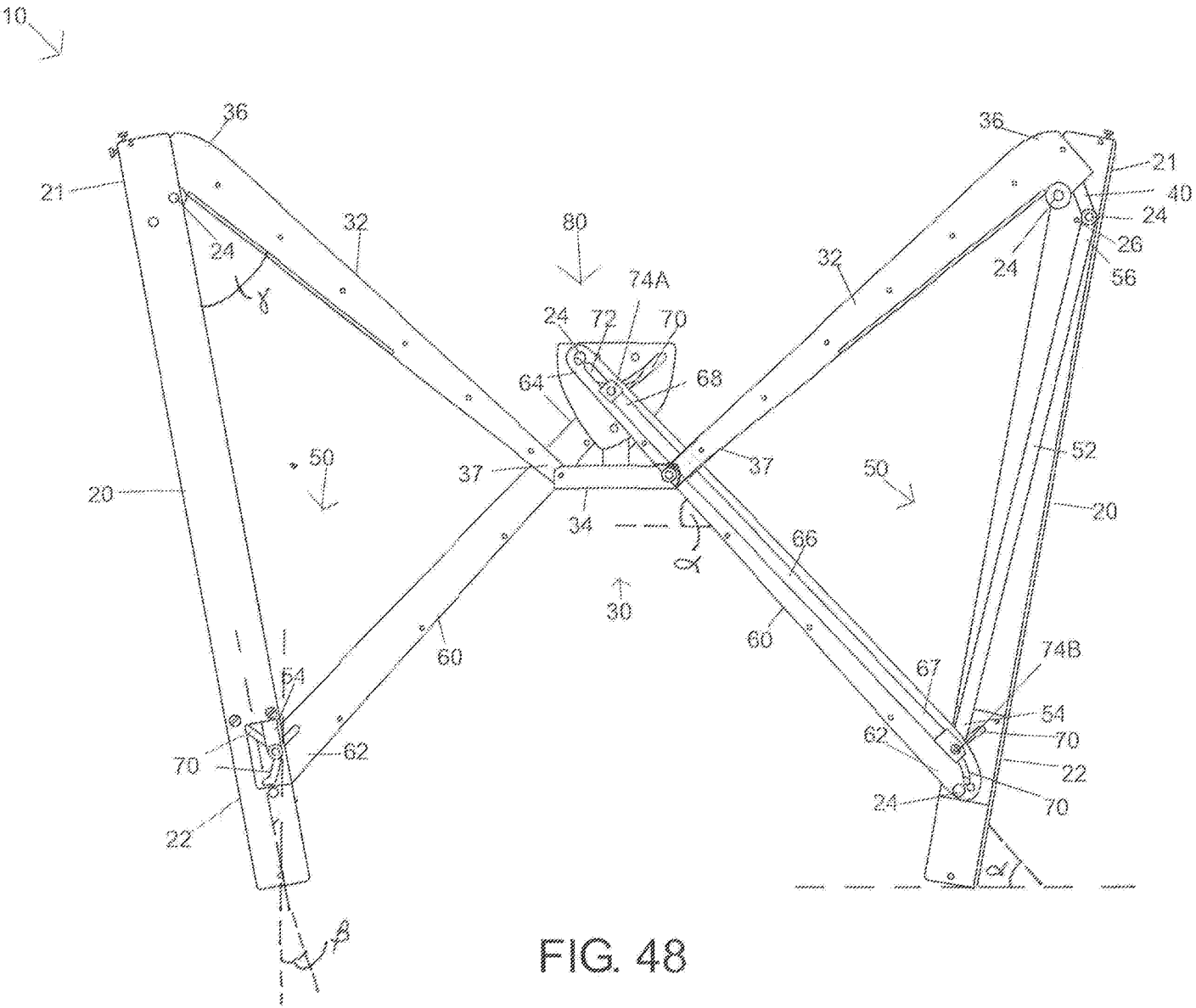
FIG. 48 is an illustrative frame assembly according to one embodiment of the present invention in an intermediate position.

The present invention is directed to a child's play yard 1, as shown in FIGS. 1 and 2 that is relatively easy to open and to close and, in some embodiments, will stay closed without a separate locking feature while other embodiments of the present invention may incorporate the use of a corner post locking mechanism to keep the play yard 1 in the closed position and, further, other embodiments will not incorporate the locking mechanism. As is explained in more detail below, in the present invention, the associated movements of the central hub 80 and each cam actuator assembly 50 determine a joint angle at the central hub 80 and formed by the intersection of the longitudinal orientation of each base strut 60 and the floor plane (angle $\alpha$ as shown in FIG. 48). In turn, these joint angles, through interaction with the interconnected parts of the cam actuator assembly 50, control an angle measured at the lower end 22 of the corner posts 20 between vertical and the actual orientation of the corner post 20 (angle R as shown in FIG. 48) and also an angle measured at the upper end 21 of corner post 20 and formed by the respective orientations of the corner post 20 and the pivotably connected rail 32 of upper rail assembly 30 (angle 7 as shown in FIG. 48). This control of the angles at the upper end 21 and lower end 22 of each corner post 20 enables the up and down motion of the central hub 80 to control the motion of the corner posts 20 and upper rail assemblies 30 so that the play yard 1 can move from an open to a closed state and vice versa primarily through the motion of the hub 80. Additionally, this structure controls for and/or prevents significant racking, which is the tendency for sides of a play yard 1 and corner posts 20 to sway in response to movement of the central hub 80. Traditionally, racking is the term used for when a structure tilts as its components are forced out of plumb or alignment. For traditional play yards, racking results in the corner posts swaying, almost uncontrollably, in a variety of directions while the play yard is being opened. This movement makes opening traditional play yards unwieldy. The present invention is also directed to a play yard 1 that is relatively lightweight, easy to transport, and is not prone to the significant racking of traditional play yards.

FIGS. 1 and 2 illustrate a play yard 1 having four base struts 60 (more fully described herein) that attach to four flanges or tabs 28, which tabs 28 are oriented inward toward the central hub 80 (more clearly illustrated in FIG. 2). These tabs 28 connect to the four corner posts 20 (as shown in FIGS. 1, 2, 6 and 8). For all embodiments of the present invention, it should be understood that the base struts 60 (and associated strut cam rods 66 and actuator rods 52) may connect directly to the corner posts 20 or each may connect to a flange or tab 28, which then connects to the corner posts 20. All discussion herein of the base struts 60, strut cam rods 66 and actuator rods 52 connecting to the corner posts should be understood to include the options of a direct connection to the corner posts 20 and/or a connection to a flange or tab 28, which then connects to the corner post 20. The tabs 28 may be oriented at any angle coming off from the corner post 20 towards the central hub 80 and they may be of a variety of lengths, widths, and heights. Additionally, the play yard 1 as shown in FIGS. 1 and 2 is a simplified illustration (lacking some of the details of the cam actuator assemblies 50) to illustrate the relative positioning of the corner posts 20, base struts 60, rail assemblies 30 and central joint member 82 when one embodiment of the present invention play yard 1 is in the fully open (FIG. 1) and an intermediate positions (FIG. 2).

Figure 3:
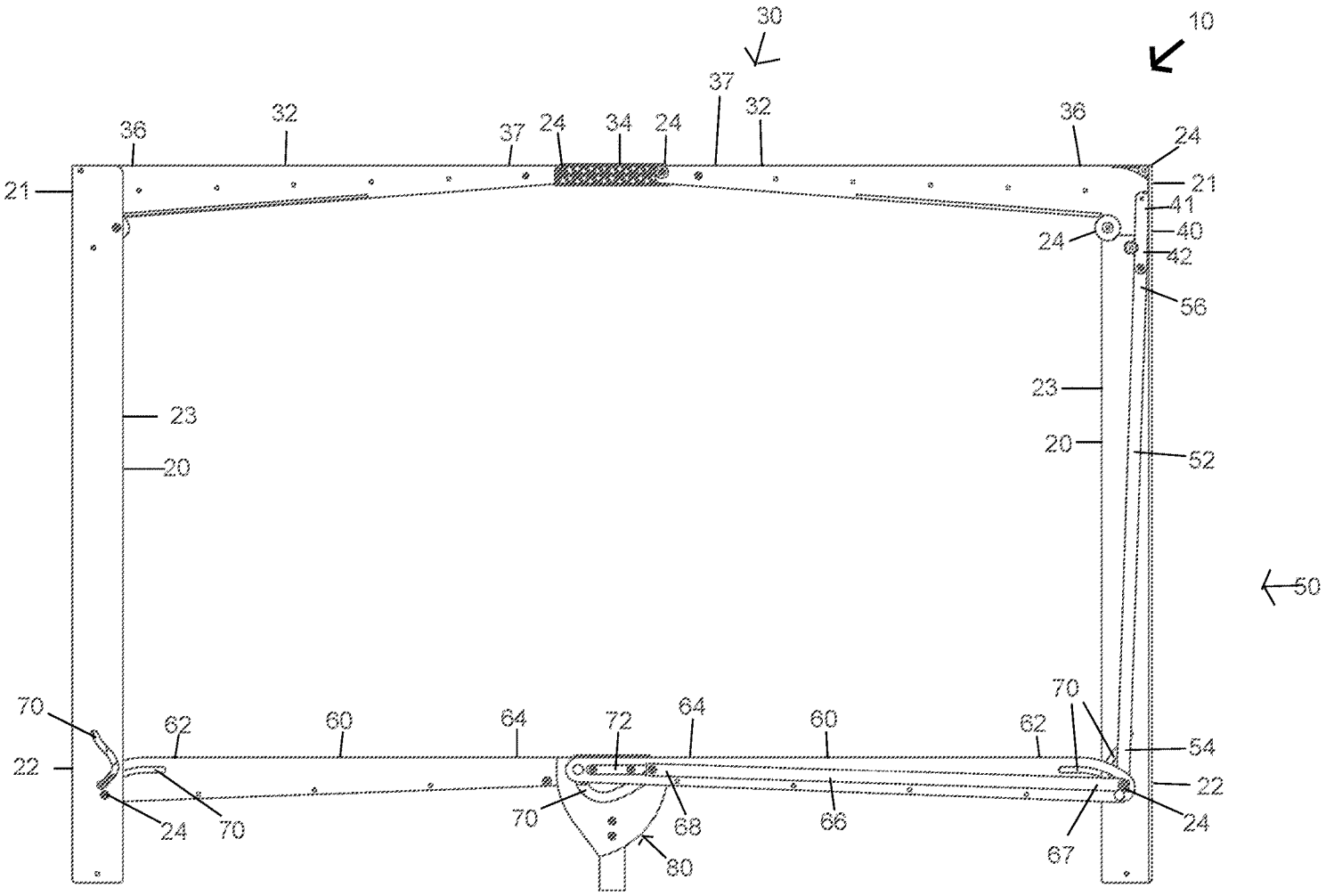
FIG. 3 is an illustrative frame assembly according to one embodiment of the present invention in the open position.
Figure 4:
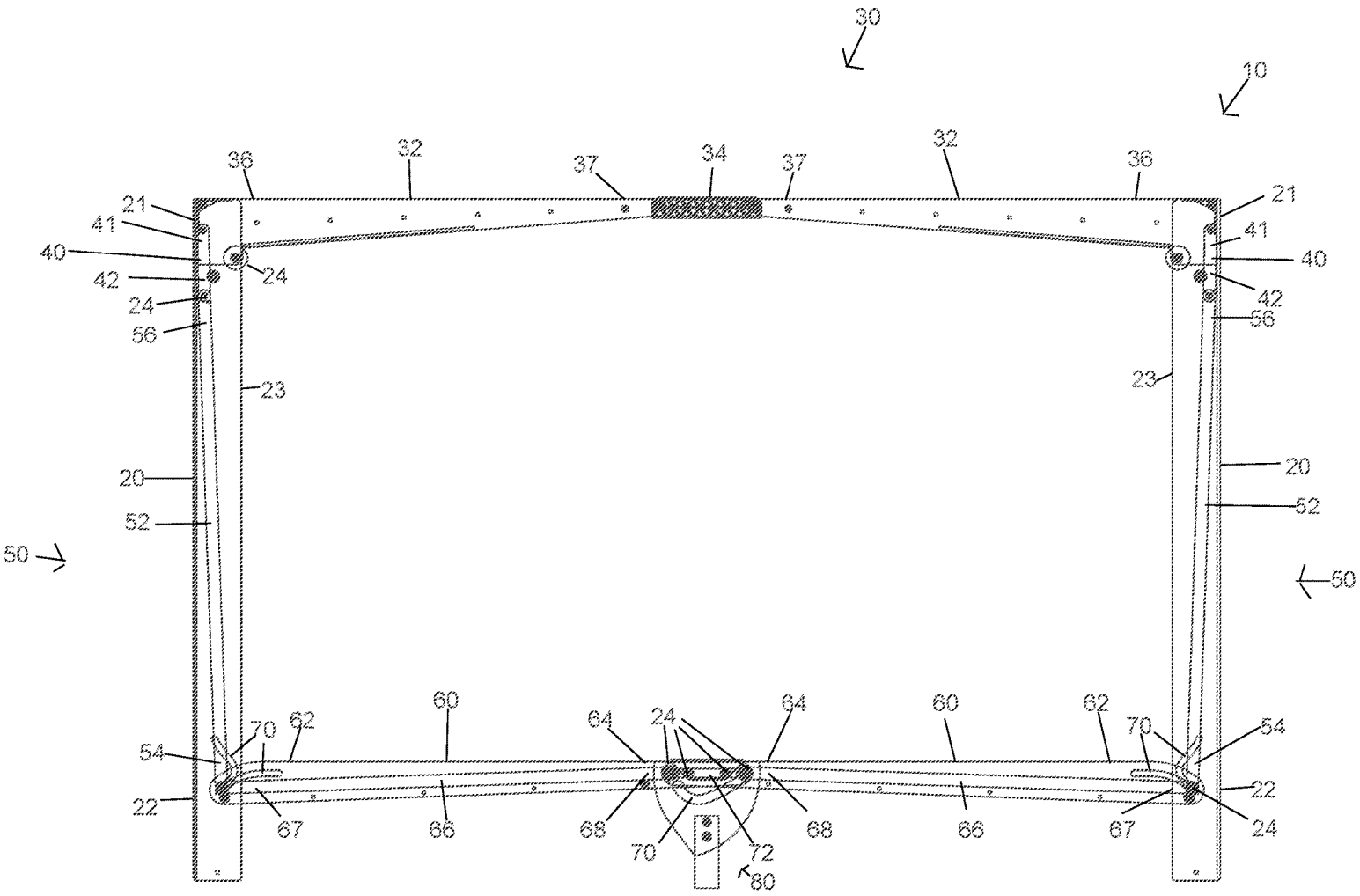
FIG. 4 is an alternative view of the frame assembly of FIG. 3 showing hidden parts.
Figure 5:
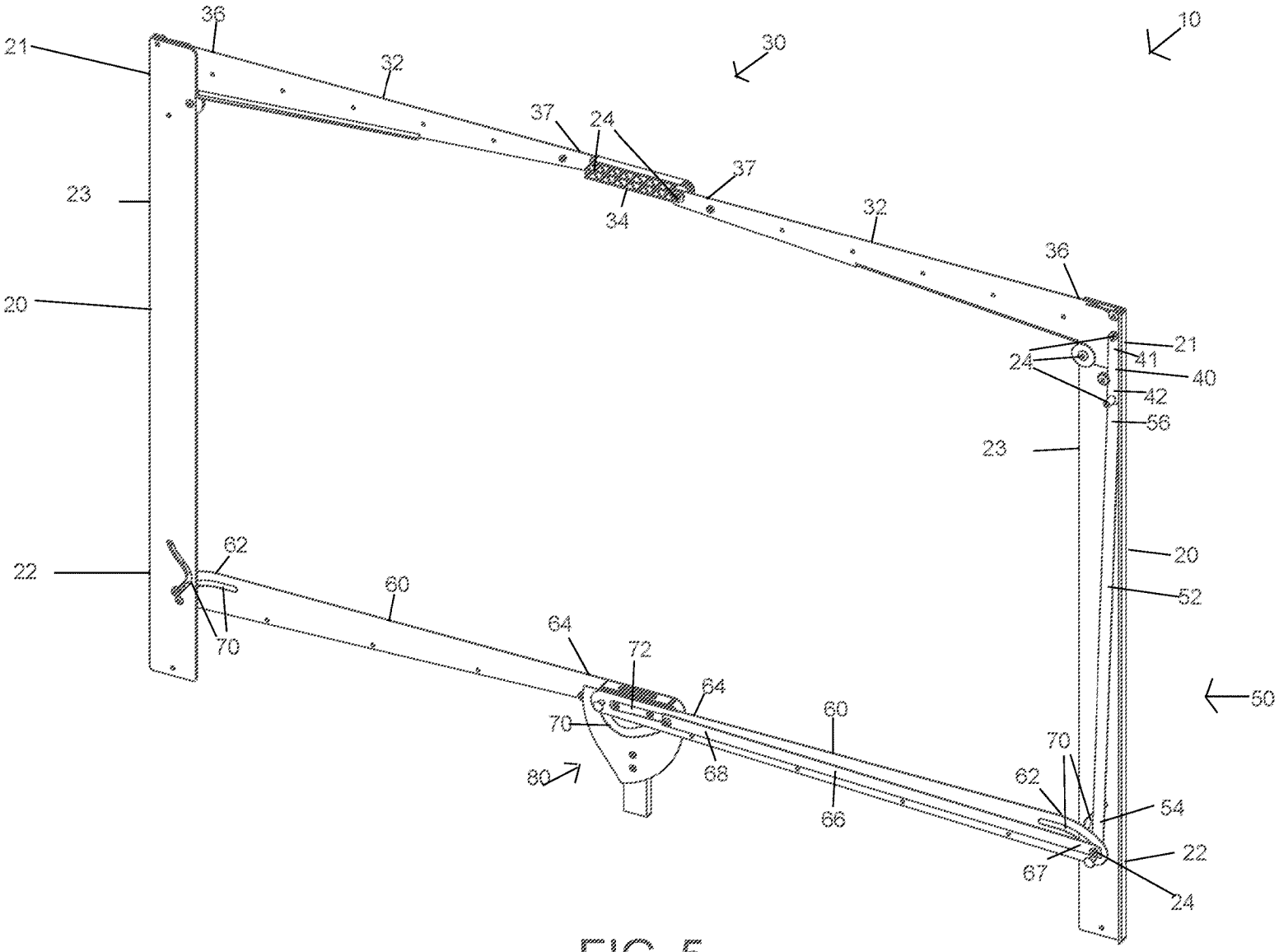
FIG. 5 is a perspective view of the illustrative frame assembly of FIG. 3.
Figure 6B:
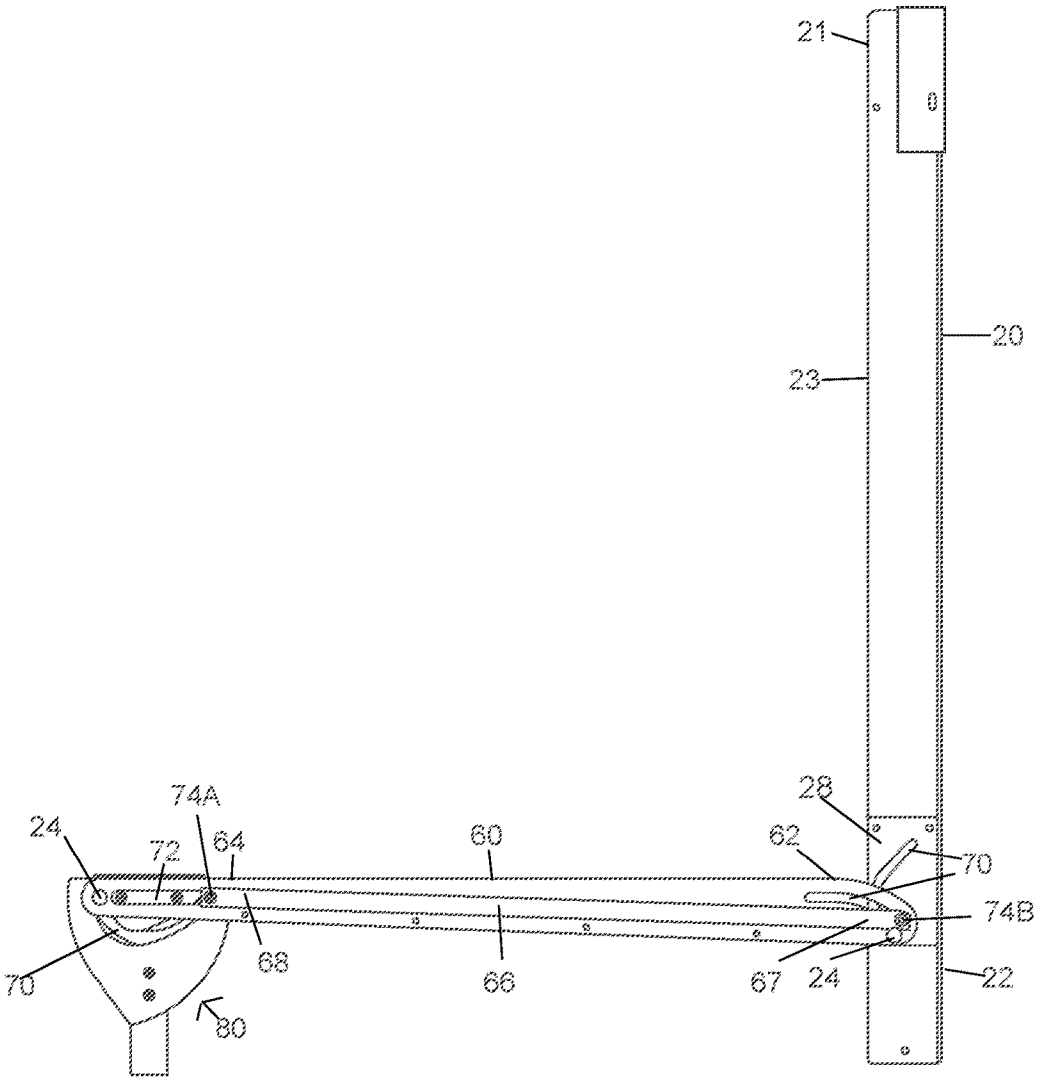
FIGS. 6A and 6B illustrate the movement of parts of a cam actuator assembly from a closed position to an open position.
Figure 6A:
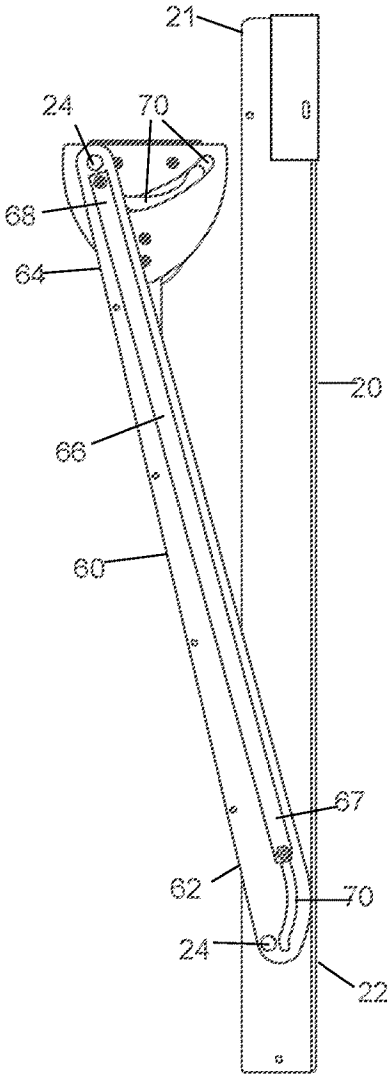
Figure 7A:
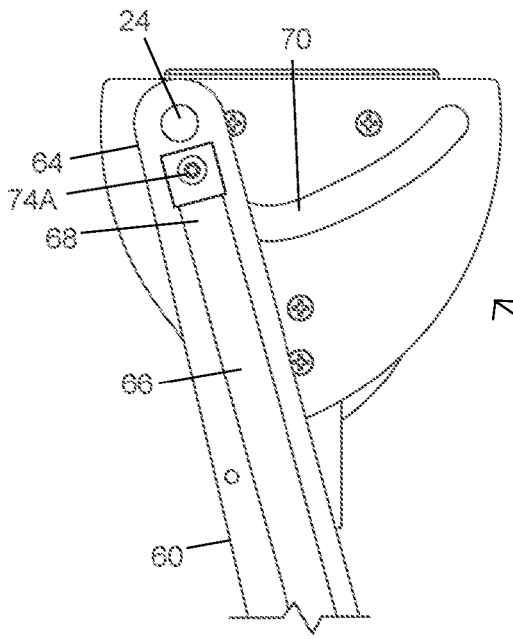
FIGS. 7A and 7B illustrate the movement of a base strut in an arc-shaped cam slot from a closed position to an open position.
Figure 7B:
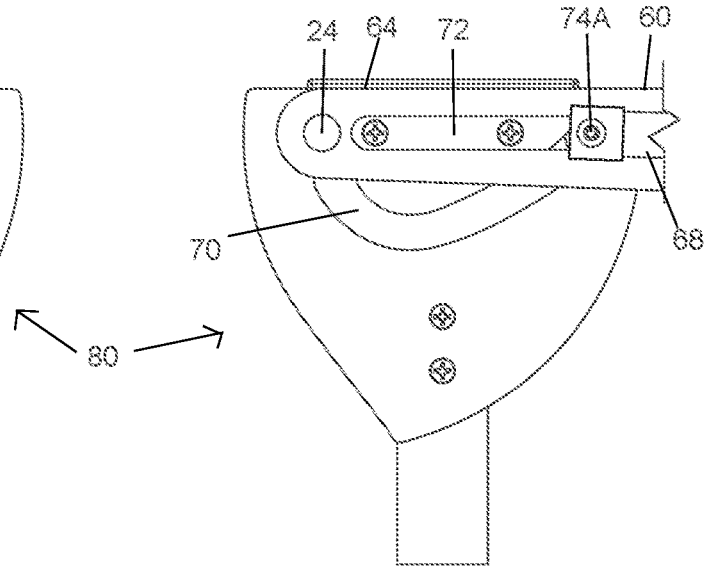
Figure 8C:
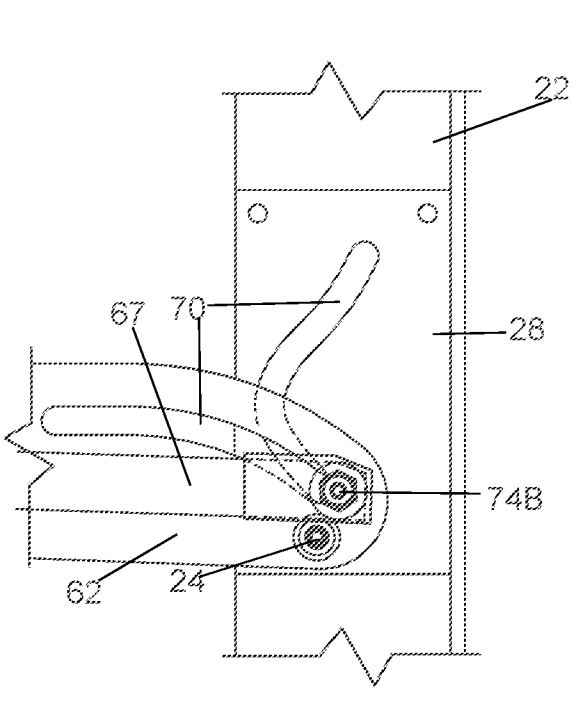
FIGS. 8A, 8B, and 8C illustrate the movement of a base strut outer end and a strut rod outer end in two arc-shaped cam slots at a corner post lower end.
Figure 8B:
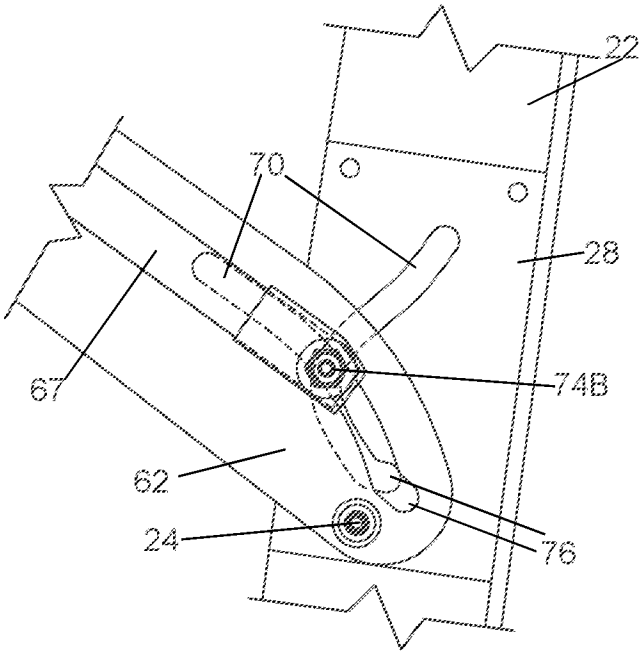
Figure 8A:
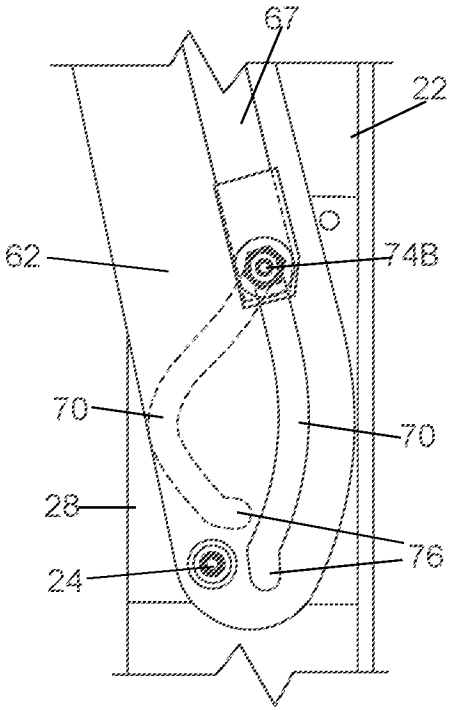
Figure 9C:
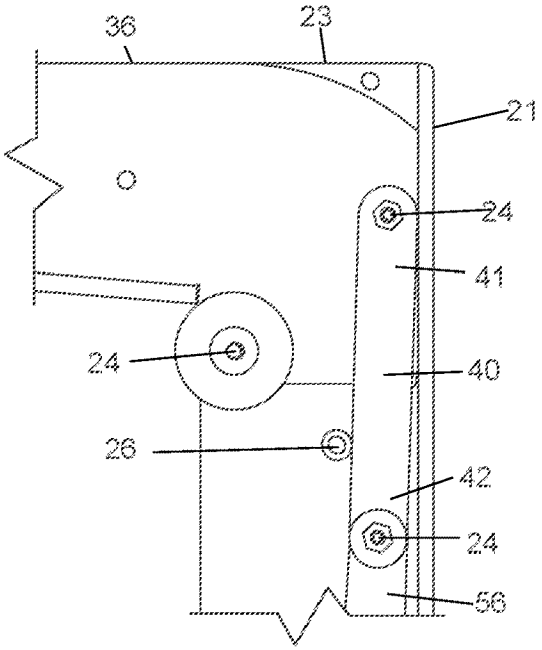
FIGS. 9A, 9B, and 9C illustrate the movement of a rail and a transfer link at a corner post upper end from a closed position to an open position.
Figure 9B:
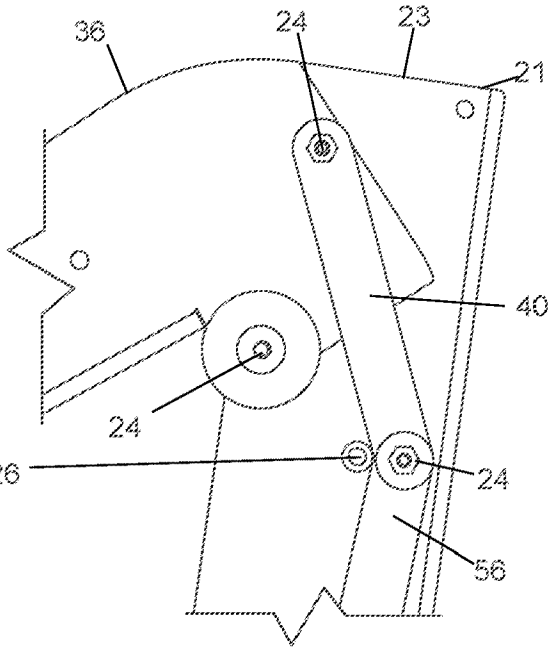
Figure 9A:
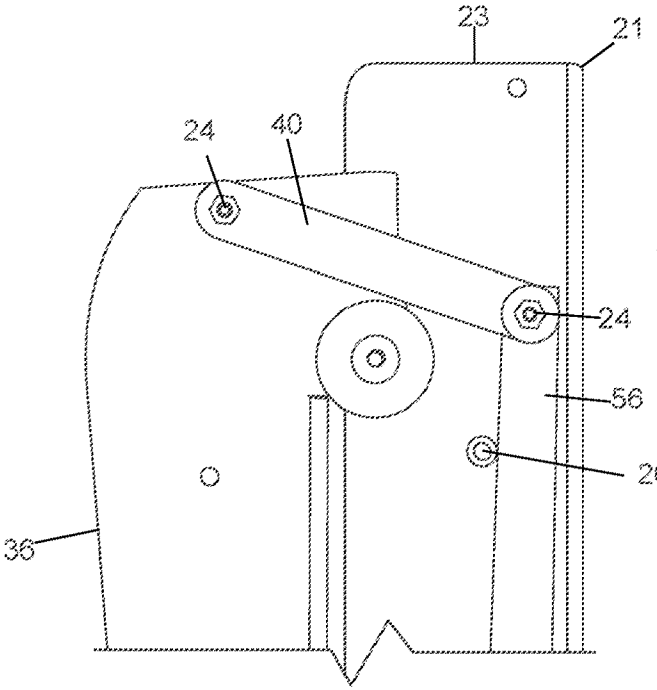
Figure 10C:
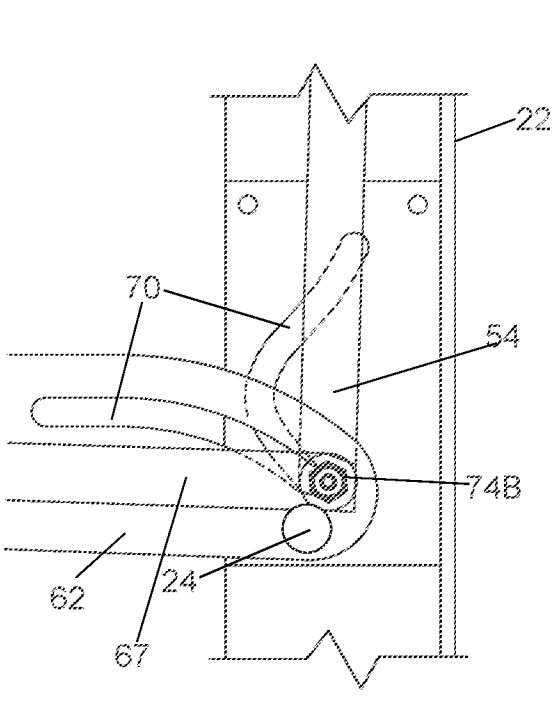
FIGS. 10A, 10B, and 10C illustrate the movement of a base strut and a strut cam rod in two arc-shaped cam slots at the corner post lower end from a closed position to an open position.
Figure 10B:
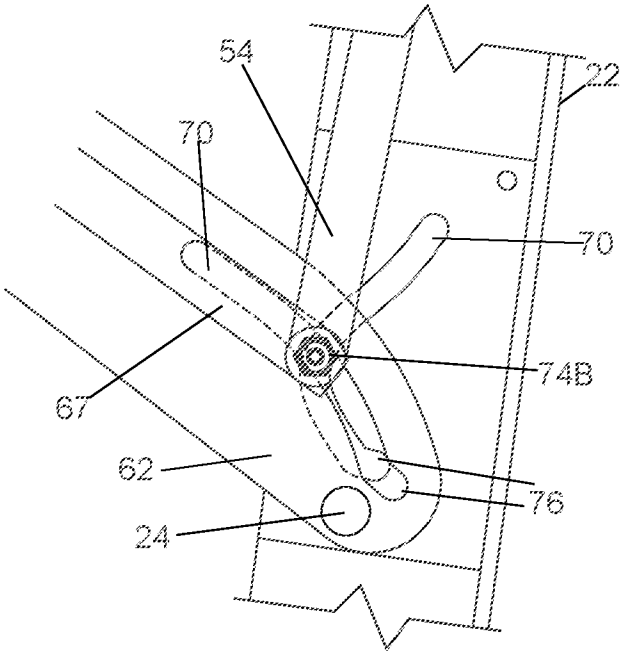
Figure 10A:
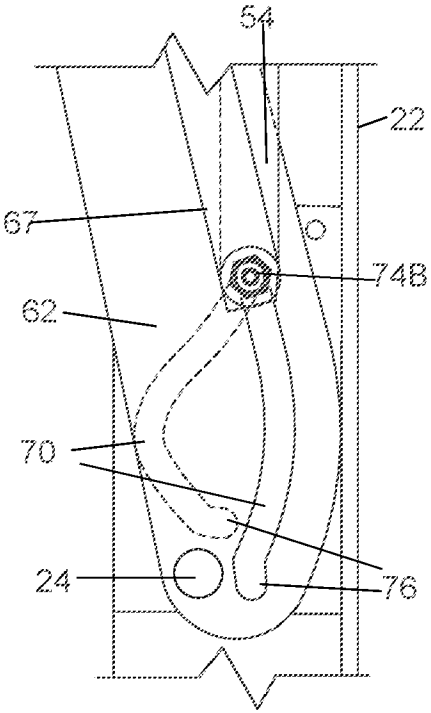
Figure 11A:
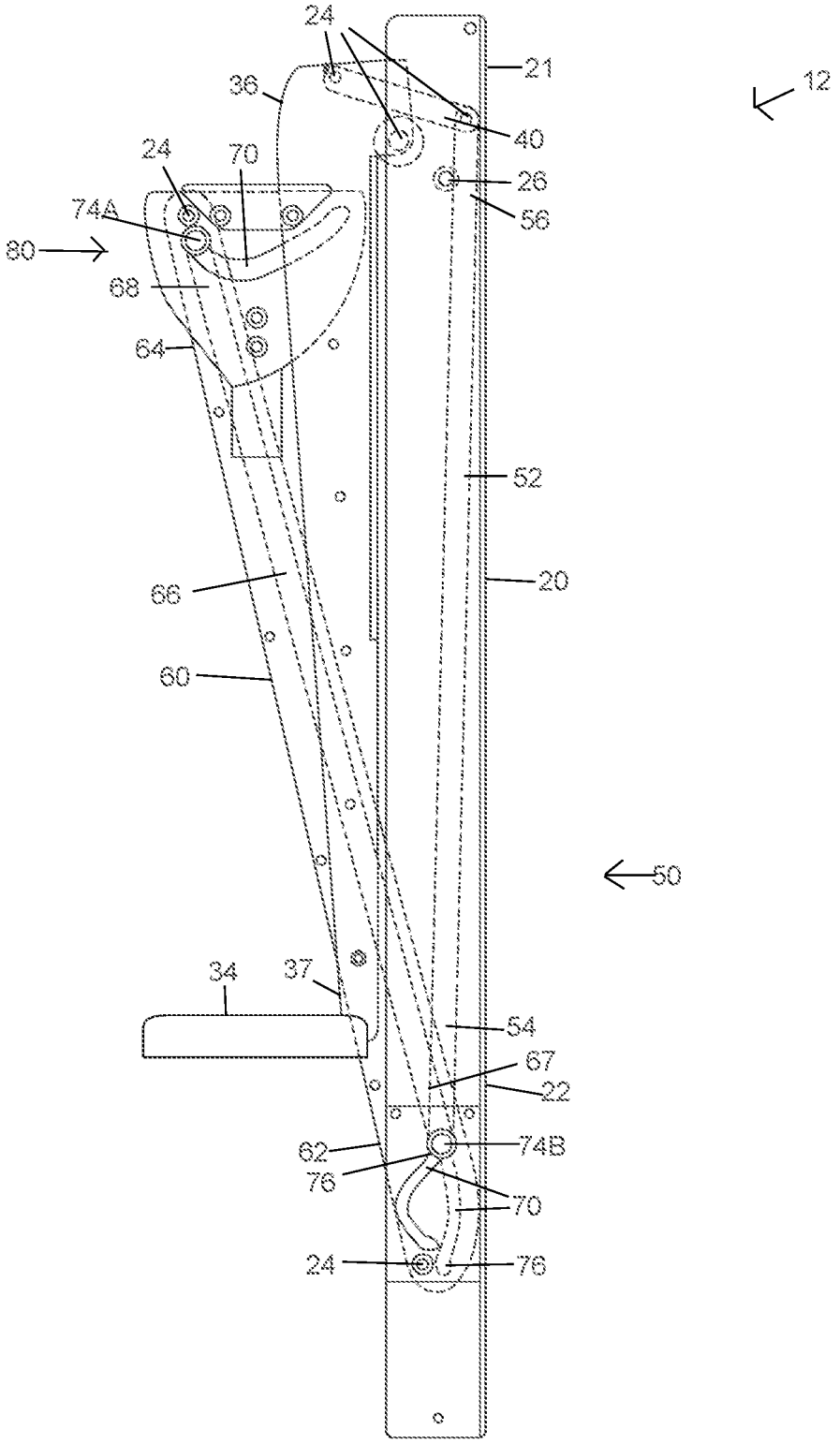
FIGS. 11A, 11B, and 11C illustrate a half frame assembly moving from a closed position to an open position.
Figure 11B:
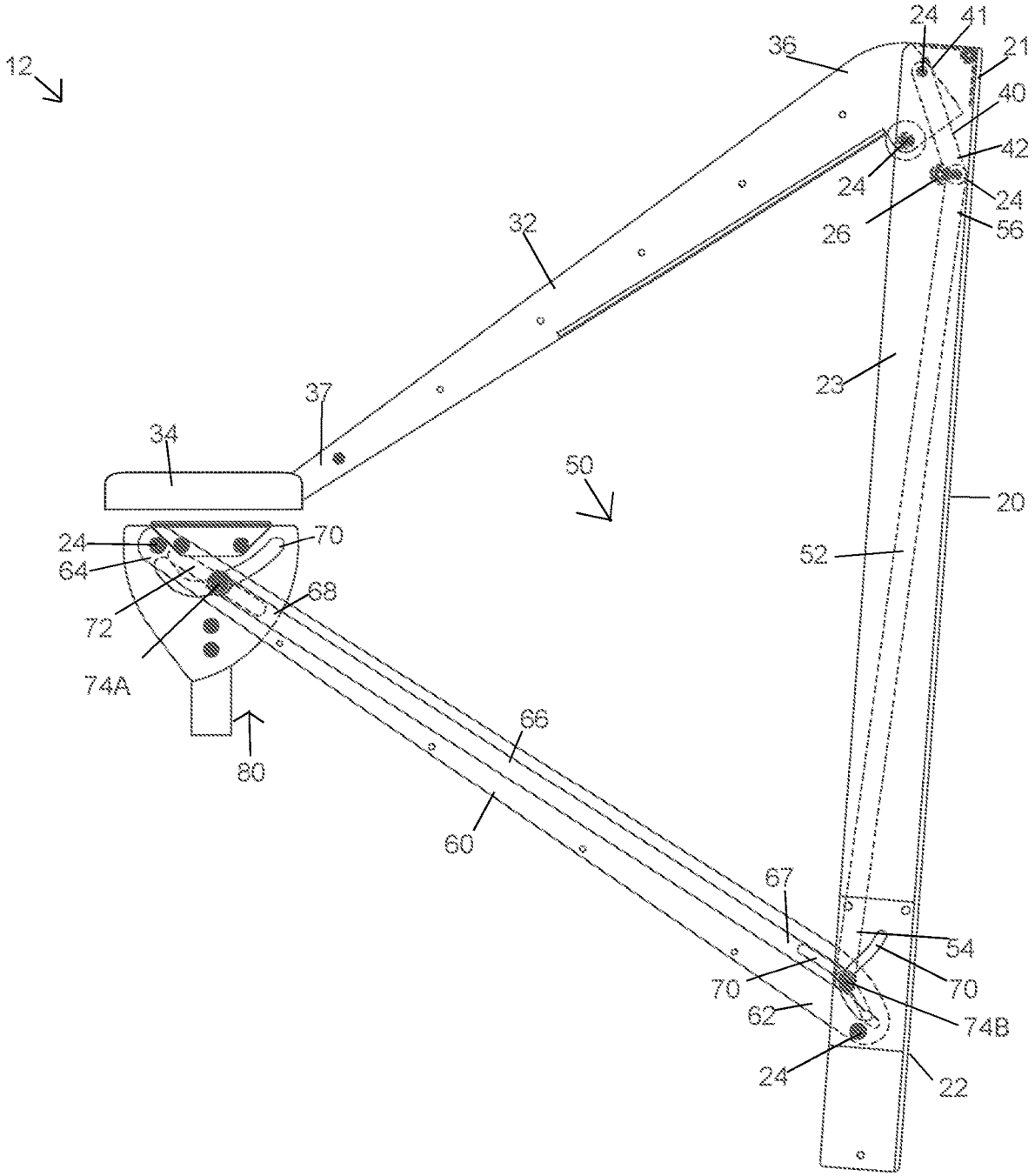
Figure 11C:
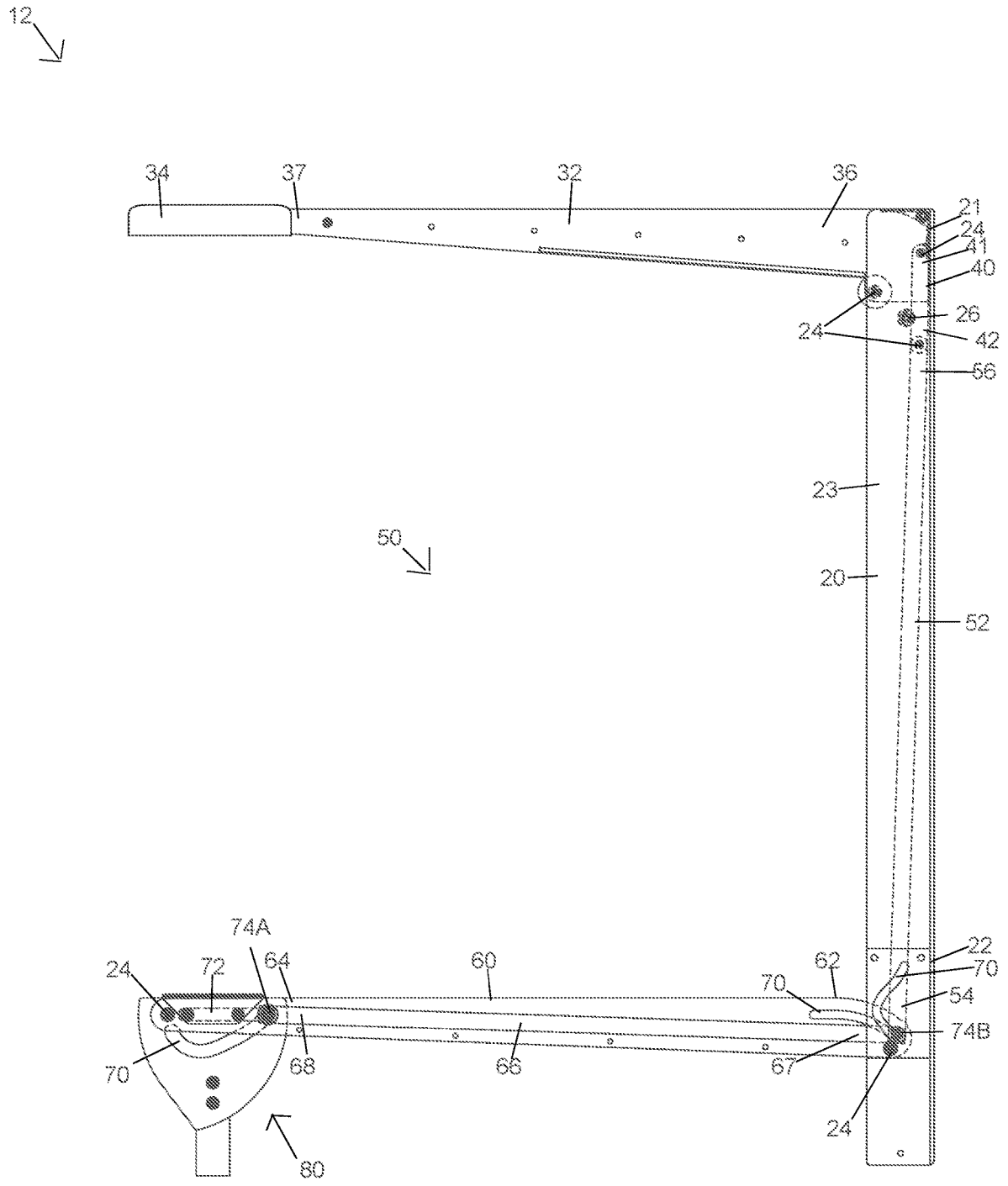

FIGS. 3, 4 and 5 show an illustrative frame assembly 10 in an open position depicting components for use in one embodiment of the present invention. In contrast to FIGS. 1 and 2, this illustrative frame assembly 10 is fully situated in a vertical plane and is pivotally connected to two adjacent corner posts 20 of a folding structure, with each corner post 20 having an upper end 21 and a lower end 22. This frame assembly 10 includes (i) an upper rail assembly 30 pivotably connected at each end 36 to the upper ends 21 of the corner posts 20, which folds downward when the play yard 1 (or other folding structure) is closed and remains in a horizontal position when the play yard 1 is opened, and (ii) two cam actuator assemblies 50, each cam actuator assembly 50 connected to an upper end 21 of a corner post 20, to the lower end 22 of the corner post 20 and to the hub 80 and each cam actuator assembly 50 folding upward when the play yard 1 is closed, and locking with each cam actuator assembly's base strut 60 in an approximately horizontal position when the play yard 1 is opened (as shown in detail in FIGS. 3 through 6). As shown in FIGS. 4 and 5, the upper rail assembly 30 is comprised of first and second rails 32 that are connected by an upper joint member 34 in the middle of the upper rail assembly 30. As shown in FIGS. 11A through 11C and 19 through 30, each cam actuator assembly 50 has a base strut 60 that pivotably attaches to a central joint member 82, and each base strut 60 also pivotably attaches to a corresponding corner post's 20 lower end 22. As described more fully below, the central joint member 82 in an operating play yard 1 can be a central hub 80. The cam actuator assembly 50 also includes a strut cam rod 66 and actuator rod 52 associated with each of the base struts 60 (as shown in FIGS. 3, 4 and 19 through 30), with each strut cam rod 66 slidably connected or mounted (i) at an inner end 68, to a corresponding straight cam slot 72 in the inner end 64 of the associated base strut 60 and an arc-shaped cam slot 70 in the central hub 80 (as shown in FIGS. 31 through 33 and 40 through 42) and (ii) at an outer end 67 to corresponding arc-shaped cam slots 70 in the outer end 62 of the associated based strut and the lower end 22 of the associated corner post 20 (as shown in FIGS. 34 through 36, 43 and 44). Each actuator rod 52 has (i) a lower end 54 that is slidably mounted within the arc-shaped cam slot 70 in the outer end 62 of the associated base strut 60 and the corresponding arc-shaped cam slot 70 in the lower end 22 of the associated corner post 20 (also shown in FIGS. 34 through 36 and 44) and (ii) an upper end 56 that is pivotably attached to an transfer link 40 that also is pivotably attached to an upper rail assembly 30 (as shown in FIGS. 37 through 39, 45 and 46). The opening and closing of the play yard 1 (or folding structure) comprised of these frame assemblies 10 is controlled and driven by the central hub 80 (or, more broadly, the central joint member 82) that is connected to at least three cam actuator assemblies 50, all of which are structured to control the joint angles between the central hub 80 and the corner posts 20 and between the corner posts 20 and the upper rails 32.

By comparison, and as discussed below, the embodiment shown in FIGS. 1 and 2 has a single central hub 80 to which all cam actuator assemblies 50 connect and whereby the cam actuator assemblies 50 are not located in the same vertical plane as the upper rail assemblies 30. This same distinction between embodiments exists for the half frame assembles 12 (shown in FIGS. 11A through 14, 19 through 30) that comprise frame assembly 10. For ease of understanding the various parts and connections of the embodiments of the present invention, FIGS. 3 through 48 illustrate the various assemblies as being situated in a vertical plane. It should be understood that, depending upon the ultimate structure of the play yard 1 or the desired folding structure, these various assemblies may be assembled in a vertical plane or they may be assembled at the various angles described in connection with FIGS. 1 and 2.

The play yard 1 of the various embodiments of the present invention can be comprised of three or more sides, as shown in FIGS. 1 and 2. The illustrative frame assembly 10 shown in FIGS. 3 through 5 and 48 is adapted for use with a play yard 1 in a manner whereby two adjacent corner posts 20 and the upper rail assembly 30 define a single side of the play yard 1 (also illustrated in FIGS. 1 and 2). As shown in FIGS. 1, 2 and 48, the cam actuator assemblies 50, in actual assembly and operation, connect between corner posts 20 and a central hub 80 in the middle of the play yard 1. The central hub 80 is configured to allow for corresponding interaction with the base struts 60. In the four-sided play yard 1, the cam actuator assemblies 50 form a cross or "X" at the bottom of the play yard 1 when fully opened (as shown in FIGS. 1 and 2). This direct connection of the base strut 60 to the corner post 20 eliminates several parts and some complication in design over prior art play yards in this field. As depicted in FIGS. 3 through 5, the illustrative frame assembly 10 has two halves or half frame assemblies 12 (shown in FIGS. 11A through 14, 19 through 30). The individual half frame assemblies 12 are shown in various perspectives and in various positions in FIGS. 6A through 14 and FIGS. 19 through 30. For the various embodiments of the present invention, the frame assembly 10 is operable to interact with additional frame assemblies 10 associated with all corner posts 20 of a folding structure or play yard 1 to control the opening and closing of the folding structure or play yard 1. Similarly, the half frame assembly 12 of the various embodiments of the present invention is operable to interact with additional half frame assemblies 12 associated with all corner posts 20 of a folding structure or play yard 1 to control the opening and closing of the folding structure or play yard 1.

FIGS. 2 and 48 show one embodiment of a play yard and an illustrative frame assembly 10 in an intermediate position, between fully open and fully closed. As more clearly shown in FIG. 48, the corner posts 20 of one embodiment of the present invention flex or tilt outward at the upper corners, away from being parallel to a central vertical axis when the play yard 1 is in the intermediate positions between fully opened and fully closed. During opening and closing, the corner posts 20 will tilt outward at least as far as 15° from vertical and inward at least as much as 5° from vertical, with a full range of motion of at least 20°. In one embodiment of the present invention, the corner posts 20 will tilt out to a maximum of 12° from vertical during the opening of the play yard 1 and tilt inward during closing of the play yard 1. In other embodiments, the corner posts 20 can tilt out more than 15°. Unlike prior art play yards, the play yard 1 of the current invention does not require the creation of a rigid parallelogram with substantially vertical corner posts 20 and formed by upper and lower leg assemblies to create tension on the sides and corners of the play yard to maintain its shape and structure. Instead, as described more fully herein, the shape, structure and tension is created and maintained via the upper rails 32, the cam actuator assemblies 50, the various corners, and the central hub 80 of the present invention.

FIGS. 3 through 5 show one embodiment of an illustrative frame assembly 10 in the fully open position. A play yard 1, according to the present invention, will consist of at least three sides wherein a plurality of upper rails 32 are connected to each other by a plurality of upper joint members 34 and to the upper corners 21 of a plurality of corner posts 20 (as shown in FIGS. 1 and 2). As described above, each corner post 20 also connects to one end of the cam actuator assembly 50, and the central hub 80 is at the middle of all cam actuator assemblies 50 that join the central hub 80 at the center of the play yard 1. The upper rails 32 and corner posts 20 as viewed from the top down define a polygonal shape, such as a square or rectangle, but other polygonal shapes can be created using different numbers of corner posts 20, upper rails 32, and cam actuator assemblies 50, etc.

As shown in FIGS. 11A through 14 and FIGS. 19 through 30, each half frame assembly 12 is designed to be pivotally connected to a corner post 20 of a folding structure or play yard 1. Each half frame assembly 12 has the following: (i) one rail 32 having a rail outer end 36 pivotably connected to the corner post upper end 21 and having a rail inner end 37; and (ii) one cam actuator assembly 50. FIGS. 19 through 30 also show the upper joint member 34 connected to the one rail 32. This joint member 34 allows the first and second rails 32 of the upper rail assembly 30 to fold down during closing (shown in FIGS. 2 and 48). FIGS. 19 through 30 also show one cam actuator assembly 50 and the central joint member 82 interposed at the inner end of the cam actuator assembly 50. Therefore, a four-sided play yard 1 will have four corner posts 20, four upper rail assemblies 30, at least four cam actuator assemblies 50 and one central hub 80 or one central joint member 82 (as shown in FIGS. 1 and 2).

The corner posts 20 of one embodiment of the present invention may be comprised of a rigid material, such as metal, which is formed to present flat projecting edges 23 at various angles depending upon the shape of the play yard 1, including at a substantially 90-degree angle at the upper end 21 of each corner post 20. Each flat projecting edge 23 at the upper end 21 of each corner post 20 provides a pivotable point of connection for the upper rail assemblies 30. The following is a description of the connection of one upper rail 32 to one side of one corner post 20 at the upper end 21 of the corner post 20. It will be obvious to one skilled in the art that this connection may be duplicated on the other flat projecting edges 23 of the corner post 20 at the upper corner 21 and then on both flat projecting edges 23 of all corner posts 20.

Figure 37:
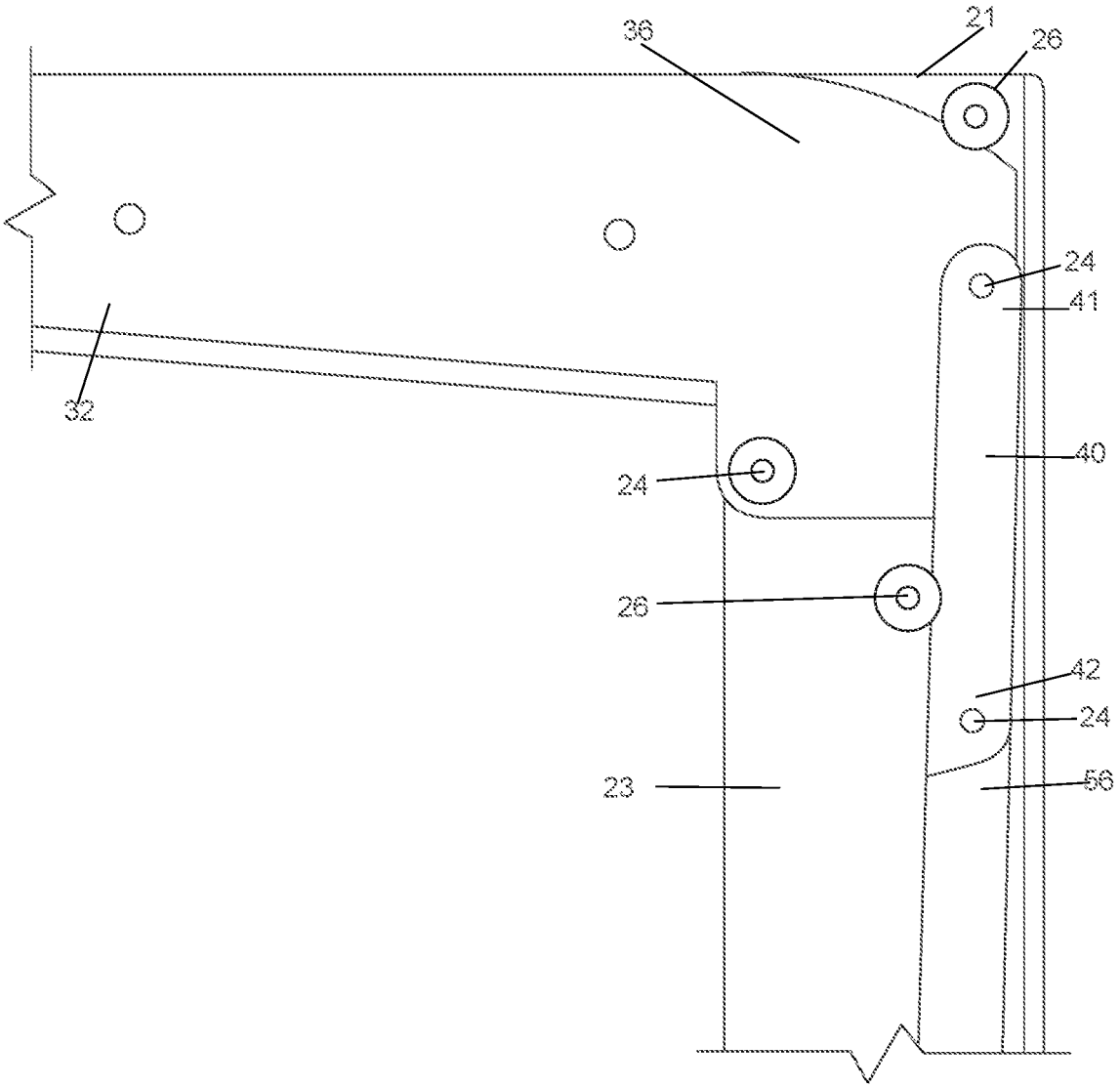
FIG. 37 illustrates the interconnections of a rail, a corner post upper end, a transfer link, and an actuator rod upper end according to one embodiment of the present invention in the open position.
Figure 38:
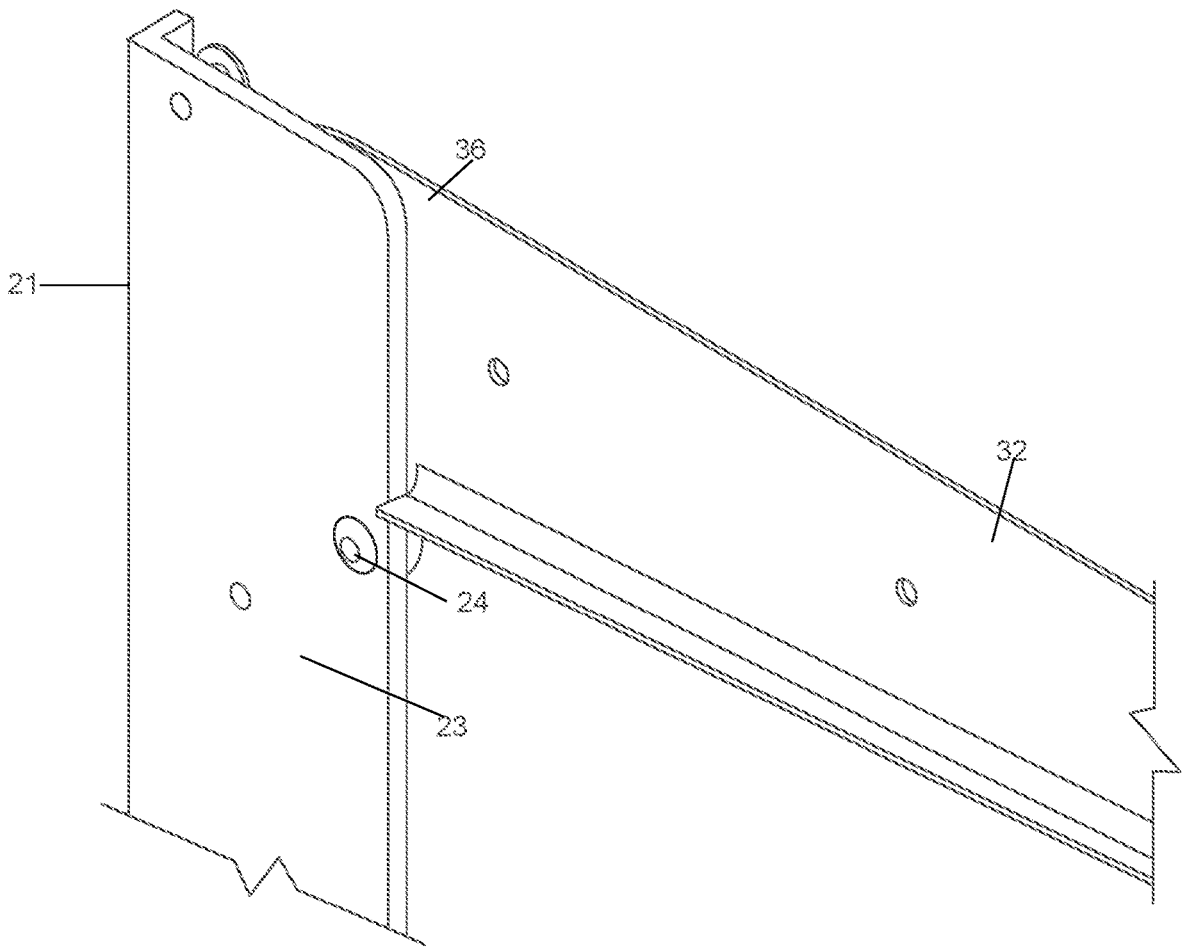
FIG. 38 is a front view of an upper corner of FIG. 37.
Figure 39:
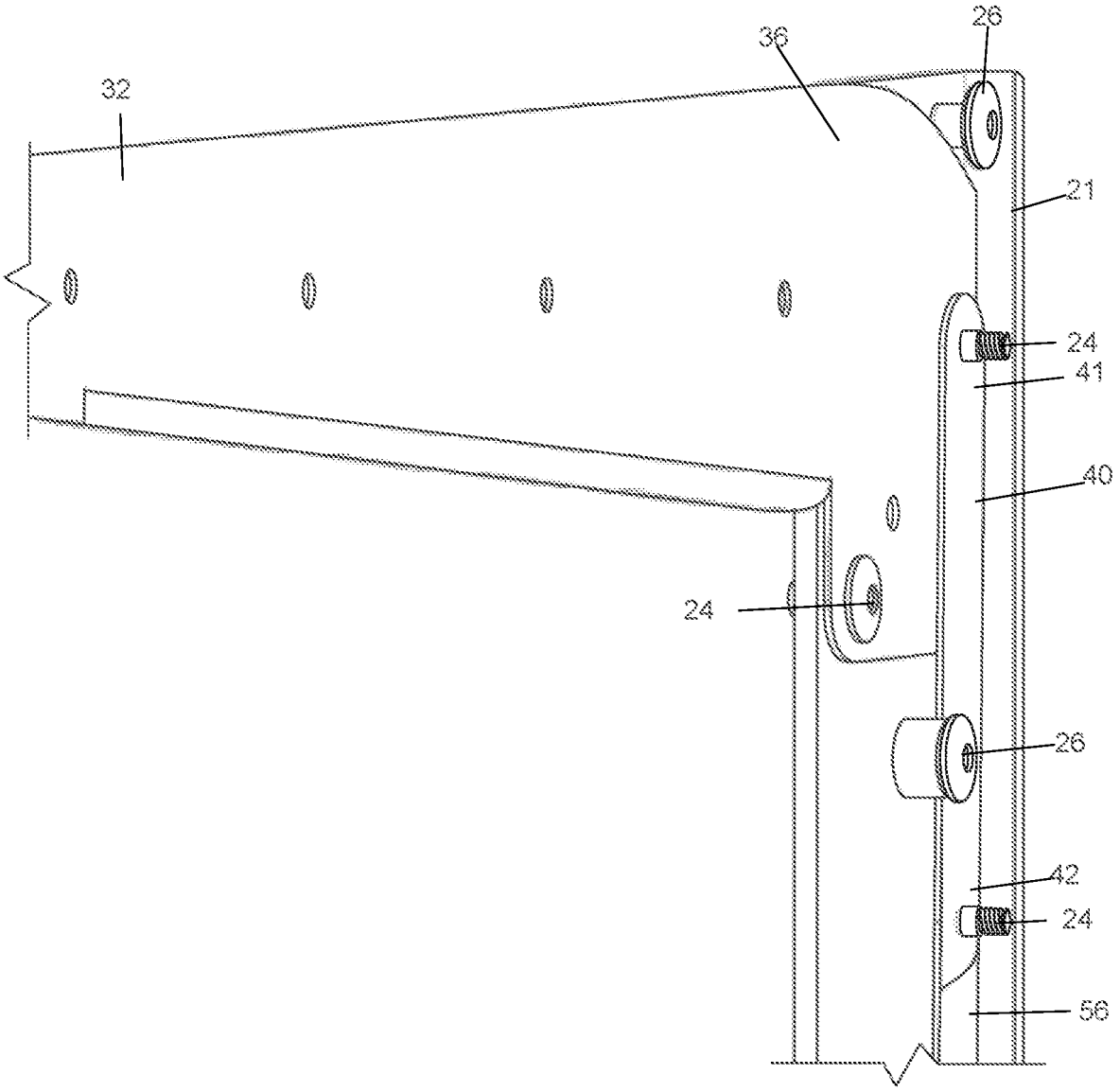
FIG. 39 is a perspective view of FIG. 37.
Figure 40:
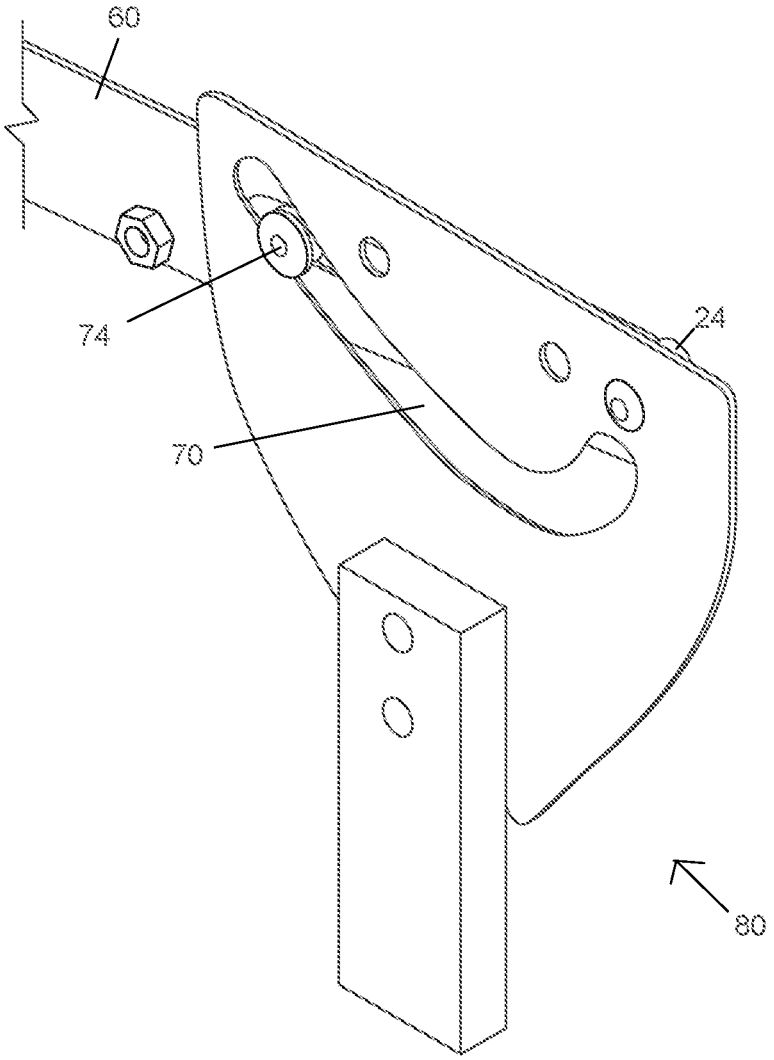
FIG. 40 is a perspective view of a hub according to one embodiment of the present invention in an almost open, but not locked, position.
Figure 41:
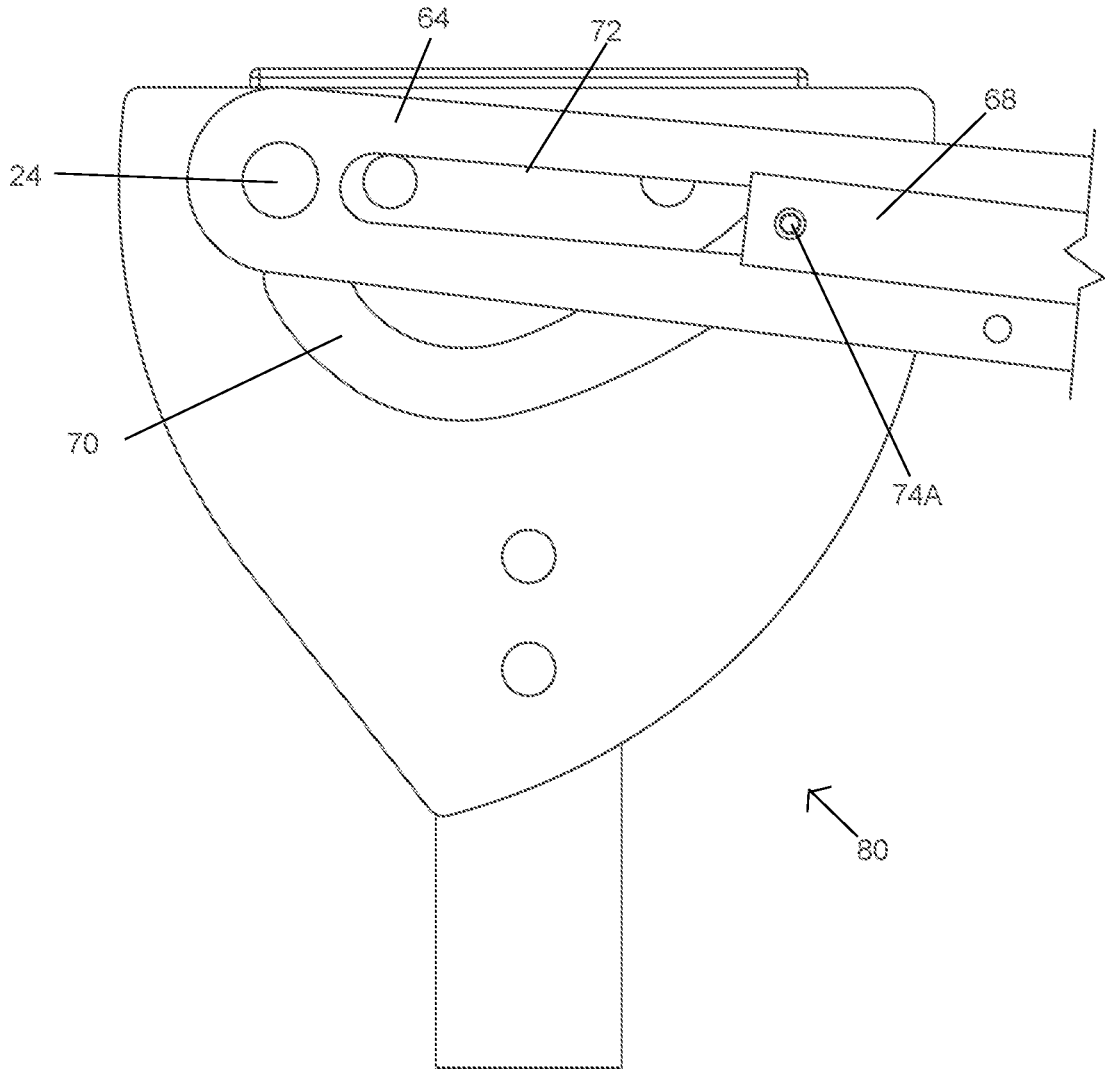
FIG. 41 is an alternative view of hub of FIG. 40.
Figure 42:
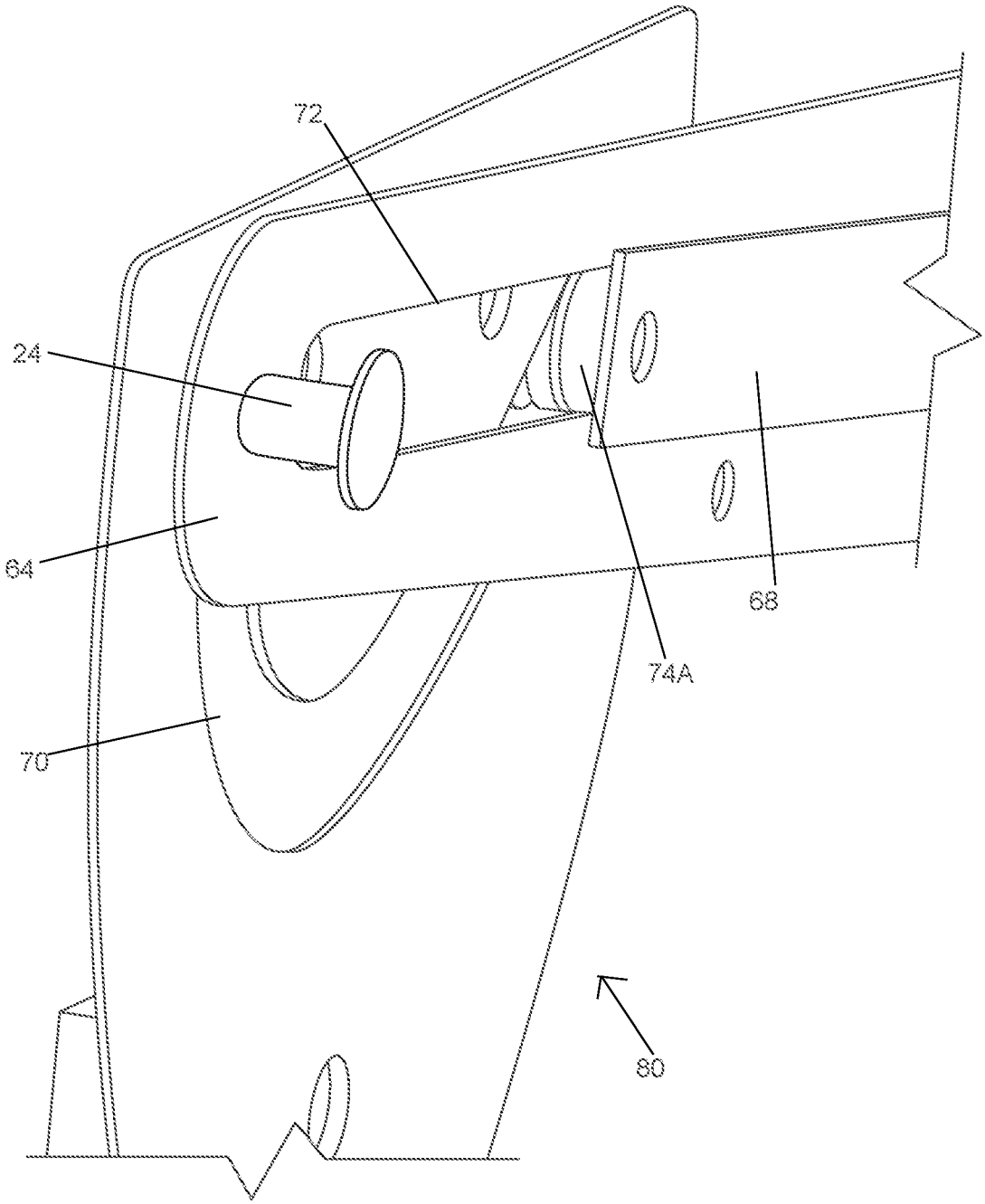
FIG. 42 is another perspective view of the hub according to FIGS. 40 and 41.
Figure 43:
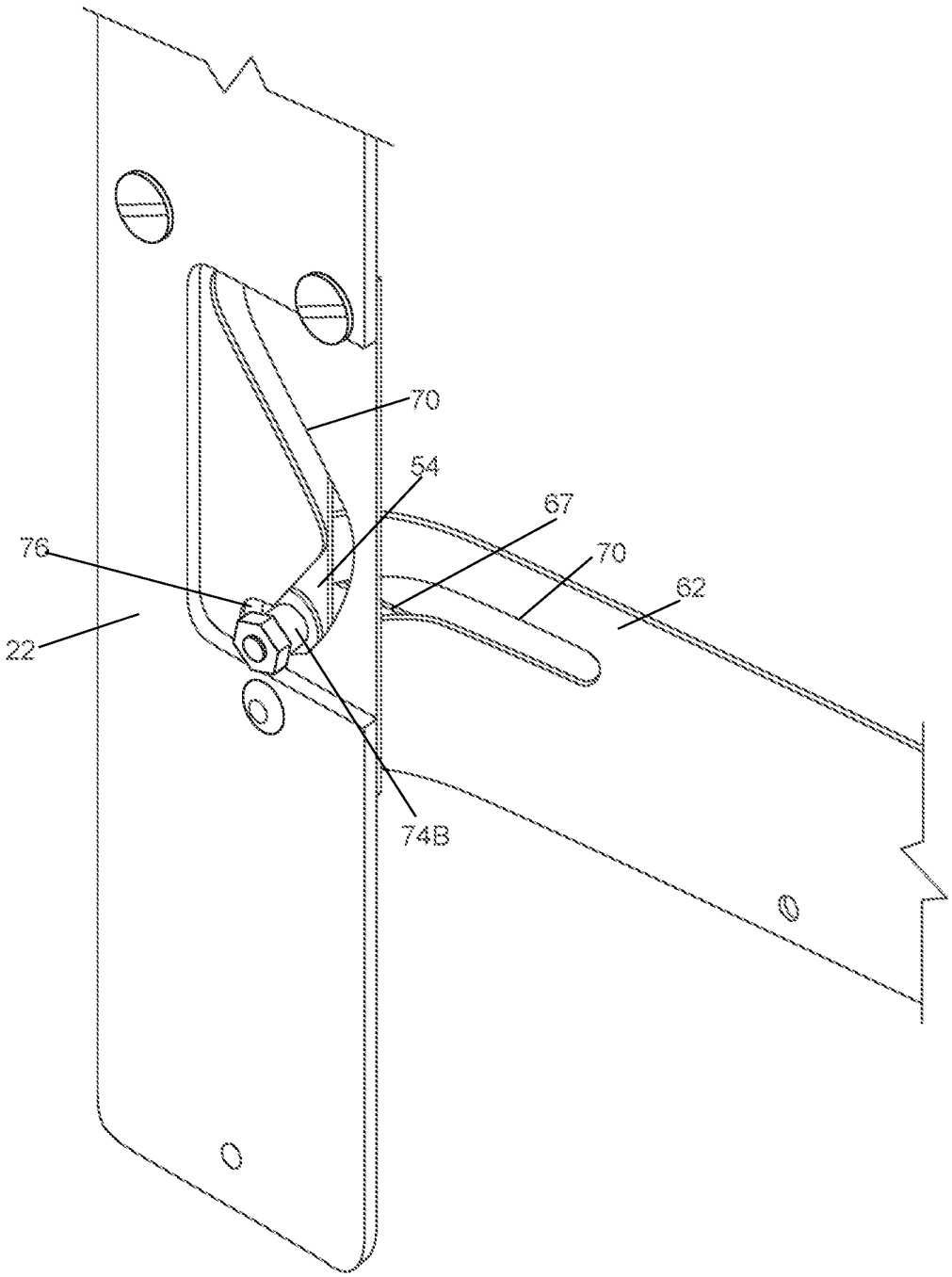
FIG. 43 illustrate a corner post lower end according to one embodiment of the present invention in an almost open, but not locked, position.
Figure 44:
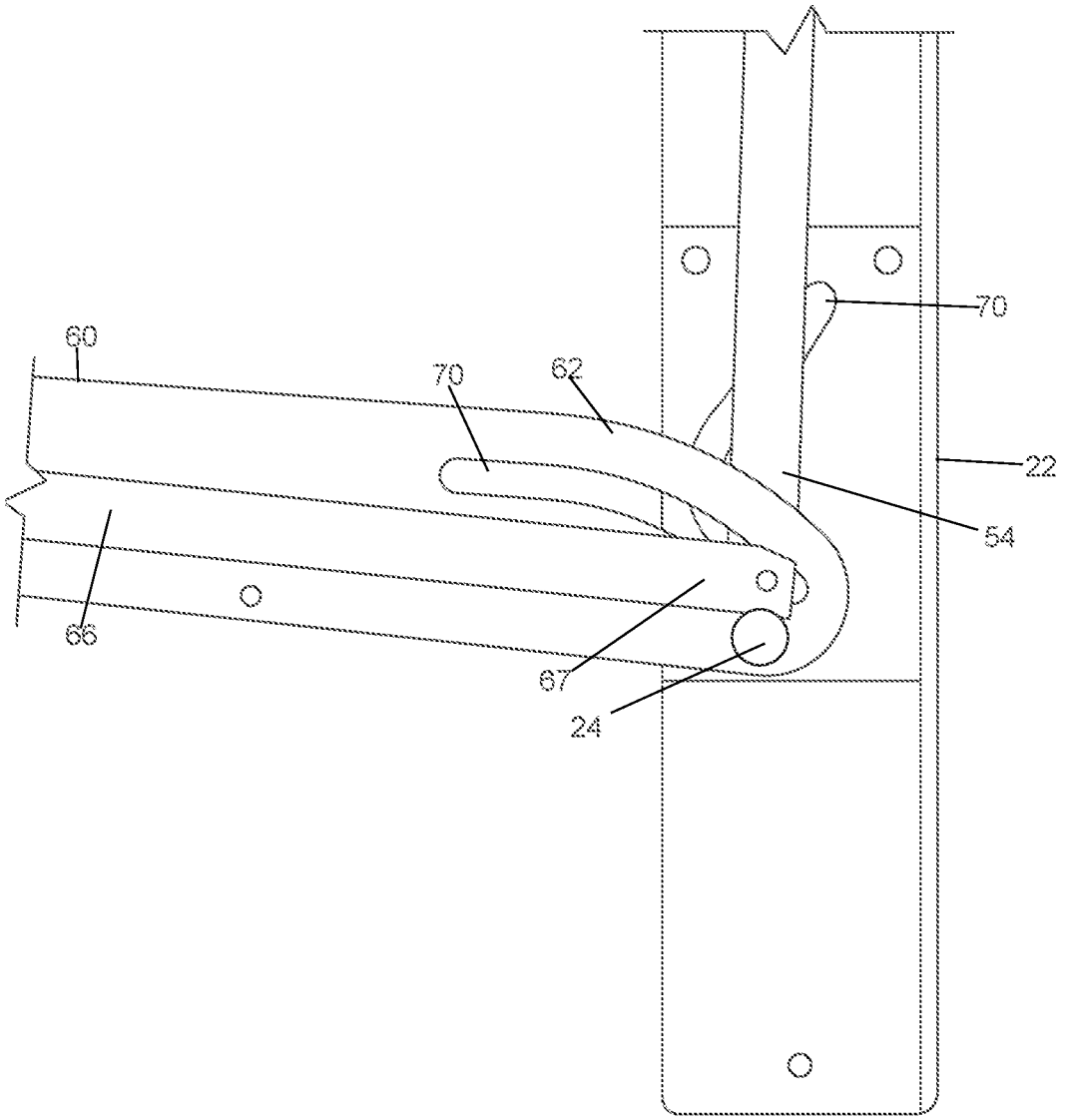
FIG. 44 is an alternative view of the lower corner of FIG. 43.
Figure 45:
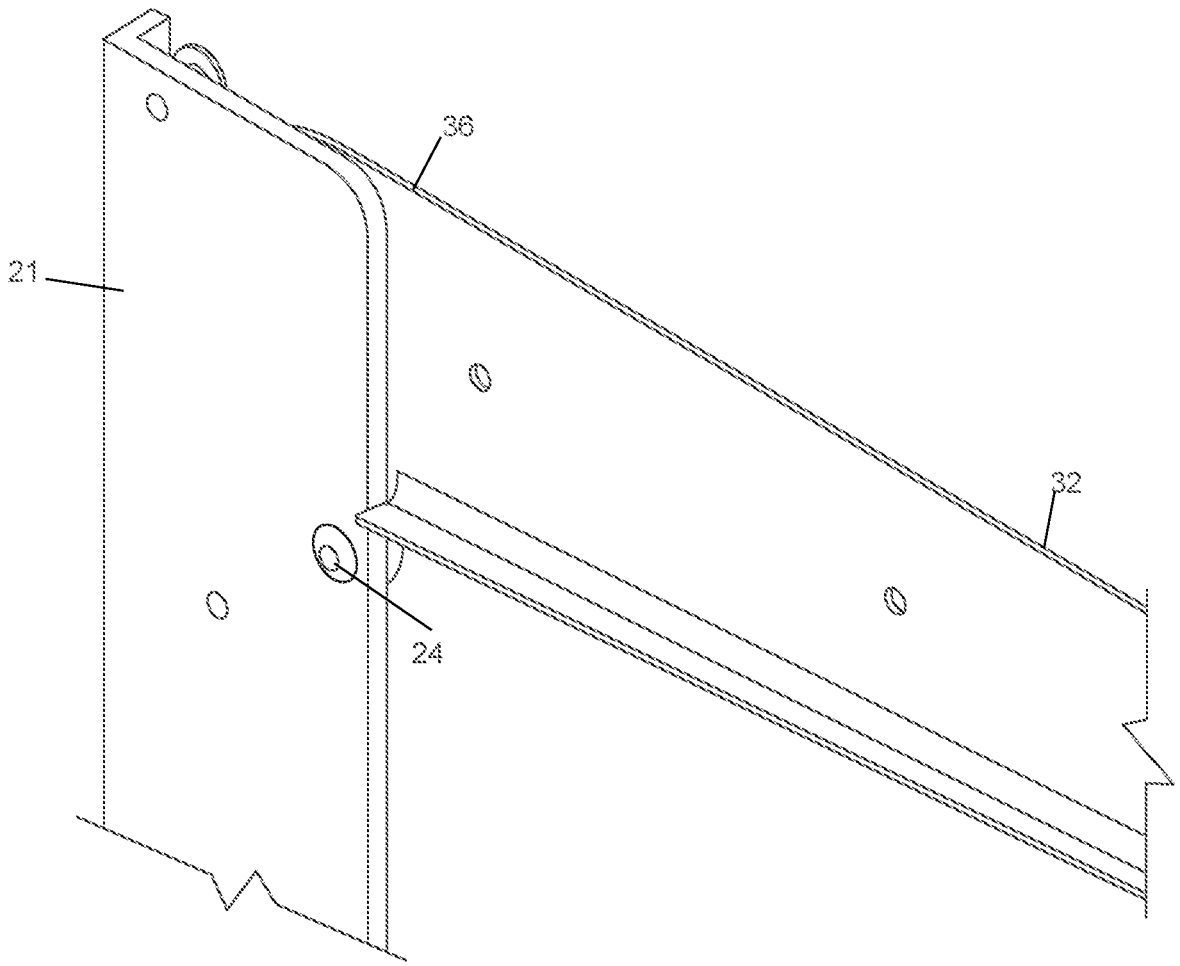
FIG. 45 is a front view of an upper corner according to one embodiment of the present invention.
Figure 46:
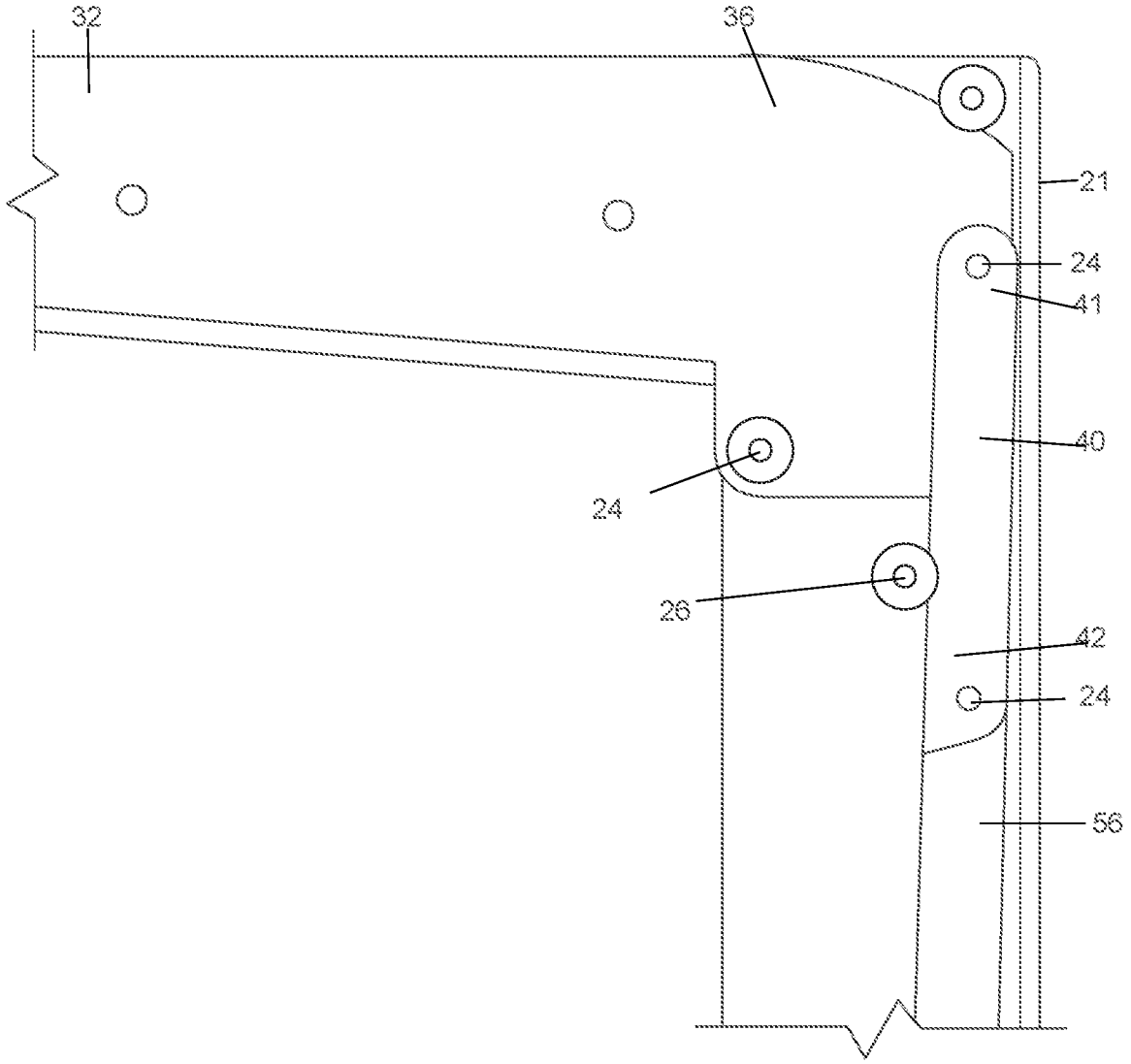
FIG. 46 is a rear view of the upper corner of FIG. 45.

FIGS. 11A through 16, 19 through 30 and 37 through 39 show the upper end 21 of one side of the corner post 20 where one rail 32 of the upper rail assembly 30 connects to one flat projecting edge 23 of the corner post 20. As can be seen in FIGS. 37 through 39, the outer end 36 of one rail 32 of the upper rail assembly 30 is pivotably connected at a pivot point 24 to the corner post 20, and the outer end 36 of the one rail 32 also pivotably connects to an upper end 41 of a corresponding transfer link 40 that, in turn, is pivotably connected, at the lower end 42 of the transfer link 40, to the upper end 56 of a corresponding actuator rod 52. The actuator rod 52 is part of the cam actuator assembly 50, as discussed above and more fully below, and is oriented along and moveably attached in an arc-shaped cam slot 70 located in the lower end 22 of the corner post 20. The transfer link 40 rests against and is movably secured in part by a guidepost 26 attached at the upper end 21 of the corner post 20 (as shown in FIGS. 37 through 39). In operation, and as shown generally in FIGS. 9A through 9C, 11A through 11C, 12 through 14, and 19 through 30, when the play yard 1 is opened—by pushing the central hub 80 downward—each cam actuator assembly 50 functions to pull its actuator rod 52 downward and also to maintain an upright orientation of the corner posts 20. This downward movement of the actuator rod 52, in turn, pulls the attached transfer link 40 downward against the guidepost 26 when the play yard 1 is nearly open. The downward movement of the transfer link 40 acts to pull the attached upper rail assembly 30 into an approximately horizontal position.

The present invention utilizes a central hub 80 to drive the opening of the play yard 1, and portions of the central hub 80 are shown in detail in FIGS. 7A, 7B, 31, 32, 33, 40, 41 and 42. FIGS. 6A, 6B, 8A through 8C, 10A through 10C, 17, 18, and 34 through 36 show the lower ends 22 of the corner posts 20 and specifically the attachments to the base struts 60. In operation, a user pushes down on the central hub 80, which, in turn, pushes all four base struts 60 and associated strut cam rods 66 away from the central hub 80 and toward the lower corners of the play yard 1 structure (illustrated in FIGS. 6A and 6B, 7A and 7B, 8A through 8C, 9A through 9C, 10A through 10C and 11A through 11C). If a locking mechanism is used in the upper corners of play yard 1 to keep the invention in the closed position, the locking mechanisms are released before the central hub 80 can be pushed down. The downward movement of the central hub 80 causes cam wheel 74A associated with strut cam rod 66 of the cam actuator assembly 50 to move in an arc within the cam slot 70 of the central hub 80 and to push outward in the corresponding cam slot 72 in the inner end 64 of the base strut 60 as is shown in detail in FIGS. 7A and 7B. This movement transfers to the outer end 67 of the strut cam rod 66, whereby cam wheel 74B moves outward in an arc within the cam slot 70 at the outer end 62 of the base strut 60 and the cam slot 70 in the lower end 22 of the corner post 20 as is shown in detail in FIGS. 8A through 8C and 10A through 10C. The outer end 67 of the strut cam rod 66 is pivotably attached to the lower end 54 of the actuator rod 52 so that the lower end 54 of the actuator rod 52 similarly moves in an arc within the cam slot at the outer end 62 of the base strut 60 and the cam slot 70 in the lower end 22 of the corner post 20, also shown in FIGS. 8A through 8C and 10A through 10C. The transfer of movement to the actuator rod 52 acts to keep the corner posts 20 in an upright orientation without collapse, and, as described above, also acts to pull the upper rail assemblies 30 upward into a substantially horizontal position (shown in FIGS. 9A through 9C). It also results in the corner post 20 angle being locked in by the height of the central hub 80. There is a wide range of motion for the cam actuator assemblies 50 as the central hub 80 moves up and down and when the play yard 1 is transitioning from fully open to fully closed and vice versa. In particular, with respect to the angle formed at the central hub 80 by the intersection of the vector of longitudinal orientation of base strut 60 and a horizontal line perpendicular to the vector of vertical movement of central hub 80, the movement of the central hub 80 moves each cam actuator assemble 50 anywhere from 110-degrees from horizontal when the central hub 80 and play yard 1 are in the fully closed position to 15-degrees below the horizontal when the central hub 80 and play yard 1 are in the fully open position. In one embodiment of the present invention, the cam actuator assemblies 50 are at 70-degrees from the horizontal in the closed position and at 0-degrees from horizontal in the open position. It will be obvious to one skilled in the art that there are a variety of ways to connect the various parts of the invention to the arc-shaped cam slots 70 and to the straight cam slots 72. One embodiment of the present invention uses cam wheels 74 to make these various connections, for example, using a cam wheel 74A to connect each strut cam rod 66 to an arc-shaped cam slot 70 in the central hub 80 at its inner end 68 and a cam wheel 74B to connect the outer end 67 of each strut cam rod 66 to an arc-shaped cam slot 70 in the lower corner 22 of the corner post 20.

In one embodiment of the present invention, and unlike other play yards that maintain a rigid and substantially vertical orientation of the corner posts, the upper ends 21 of the corner posts 20 can tilt or flex inwards and outwards during the opening and closing of the play yard 1 (as shown in FIG. 48), but the actuator rod 52 operates to prevent any inward or outward collapse of the corner posts 20. This design prevents the racking of the play yard that is experienced with other models currently and historically on the market.

When the play yard 1 is fully opened, the position of each actuator rod 52 and each cam actuator assembly 50 is locked by resting cam wheels 74B in corresponding extensions 76 in the cam slot 70 located at the lower end 22 of each corner post 20. Cam slot extensions 76 are shown in FIGS. 17 through 19, 21 through 27, 35, and 43.

Figure 12:
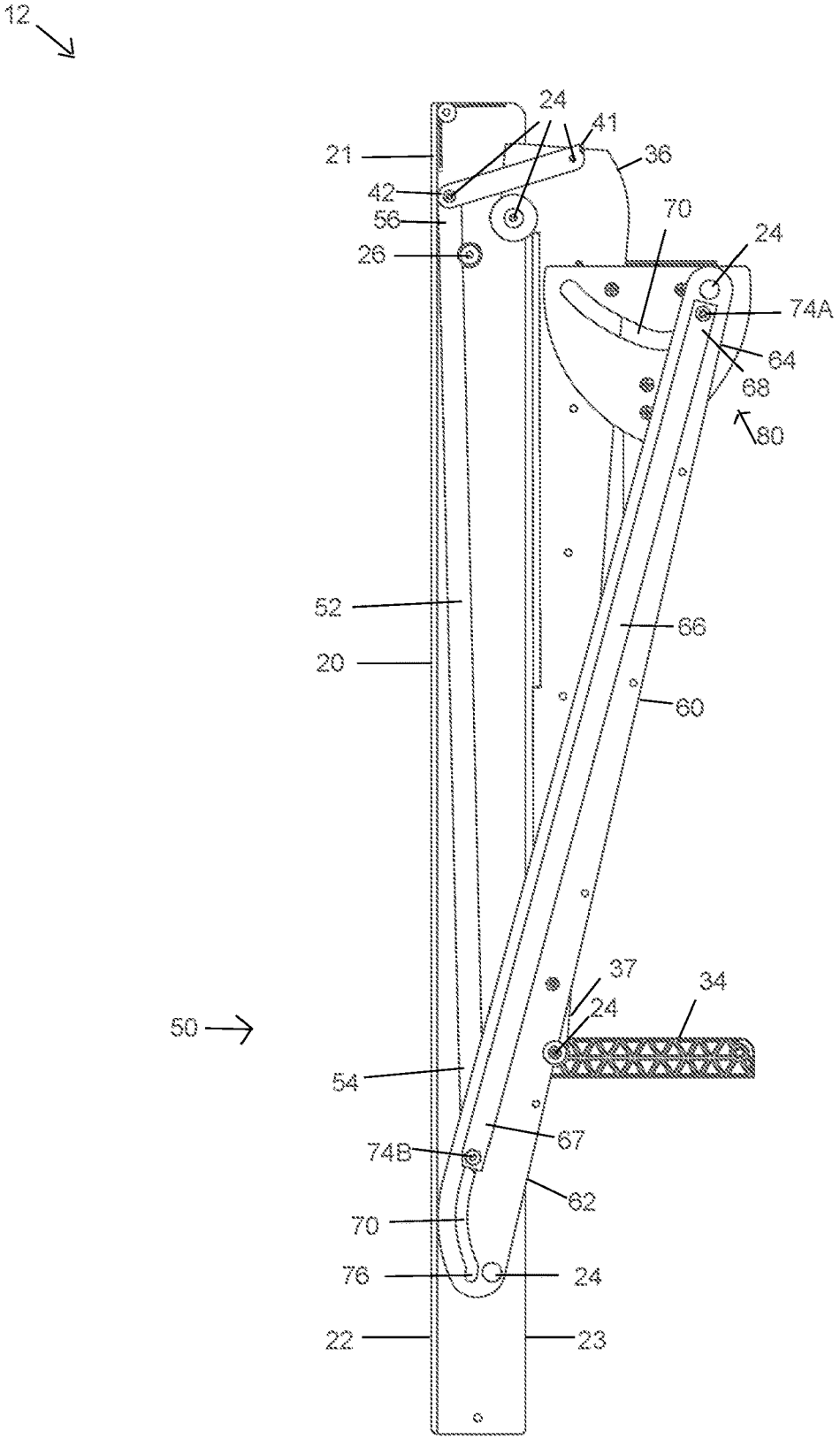
FIG. 12 shows a half frame assembly according one embodiment of the present invention in a closed position.
Figure 13:
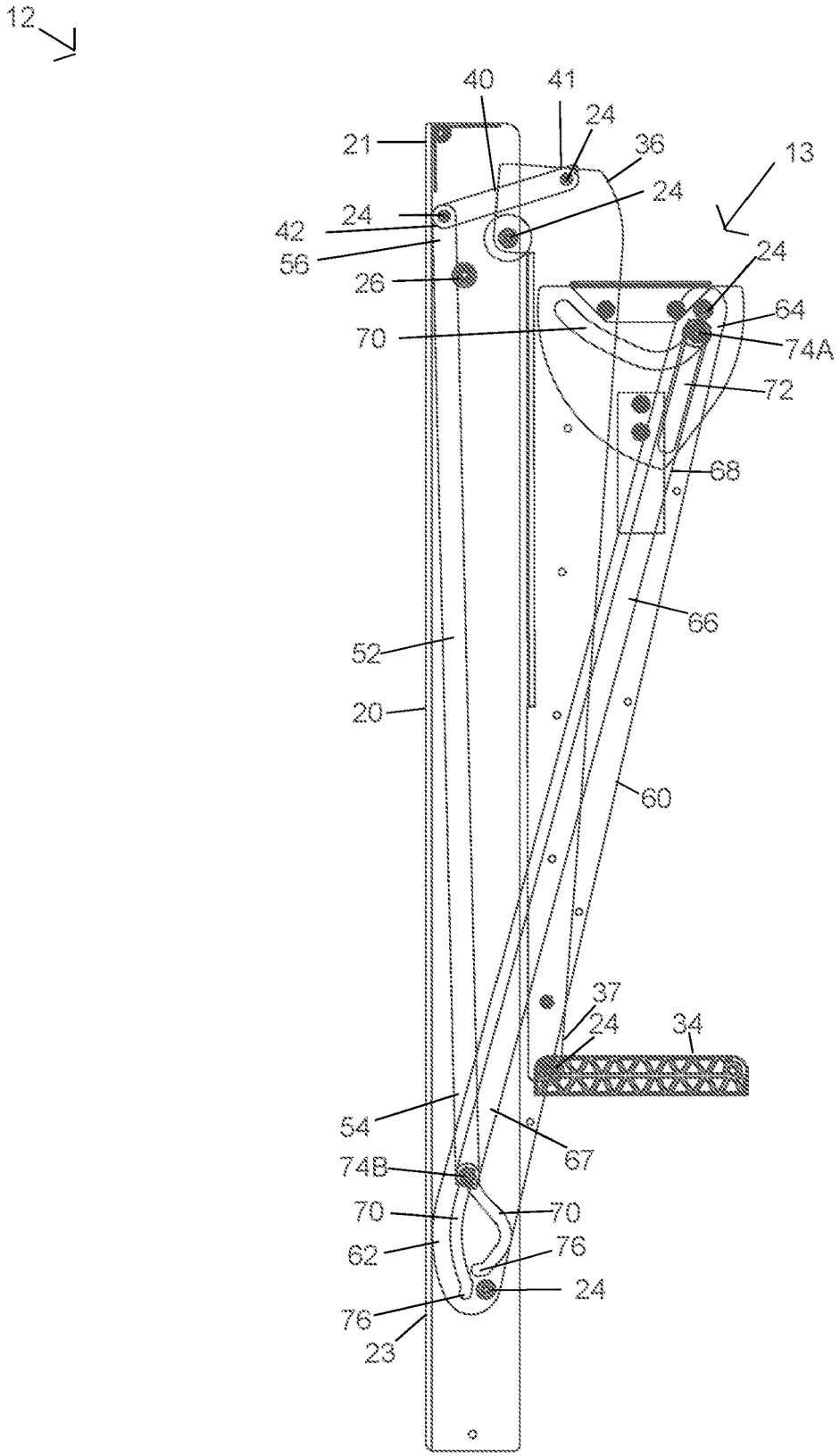
FIG. 13 shows the half frame assembly of FIG. 12 with all hidden lines and parts visible.
Figure 14:
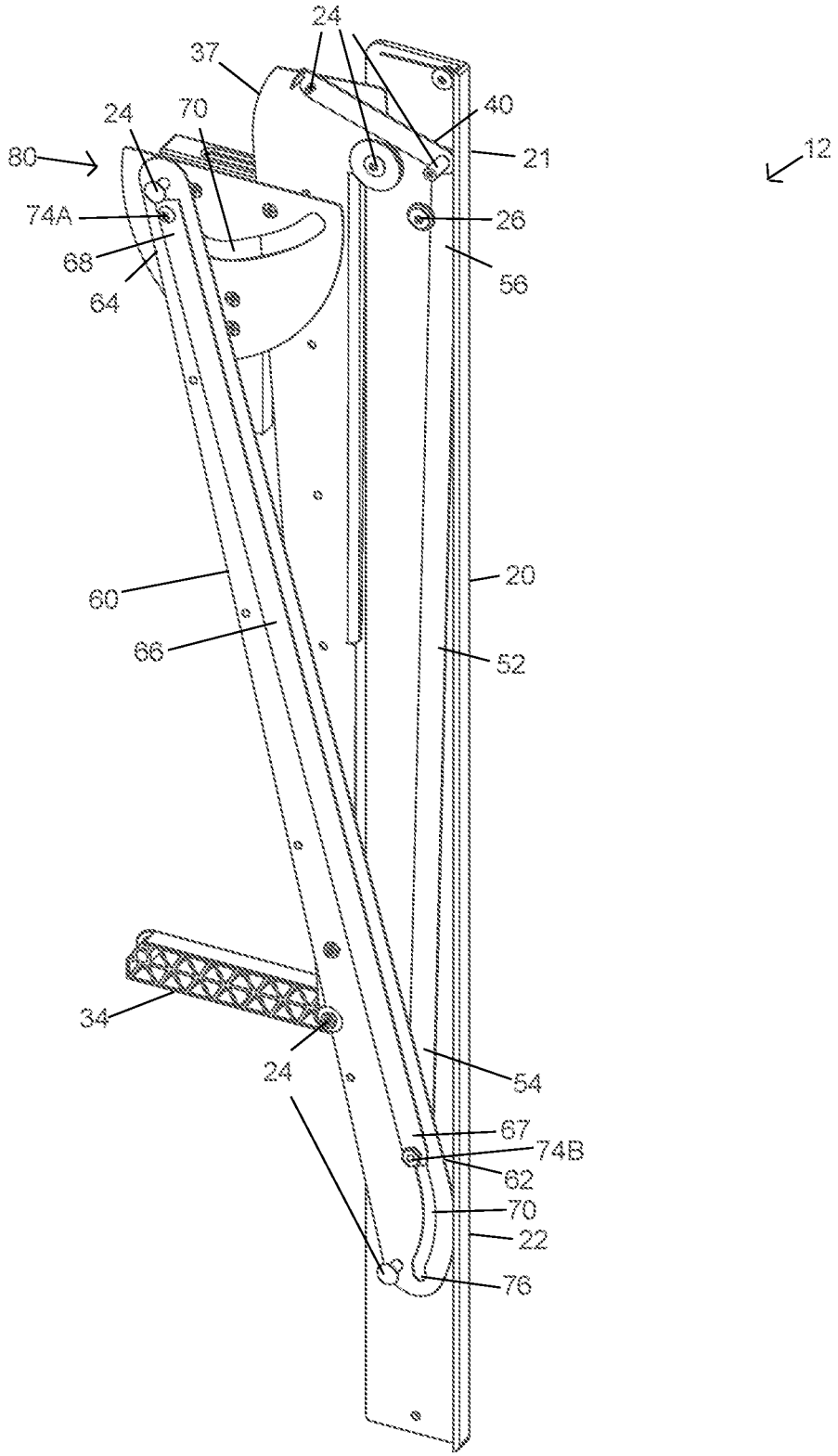
FIG. 14 is a perspective view of the half frame assembly from FIG. 12.
Figure 15:
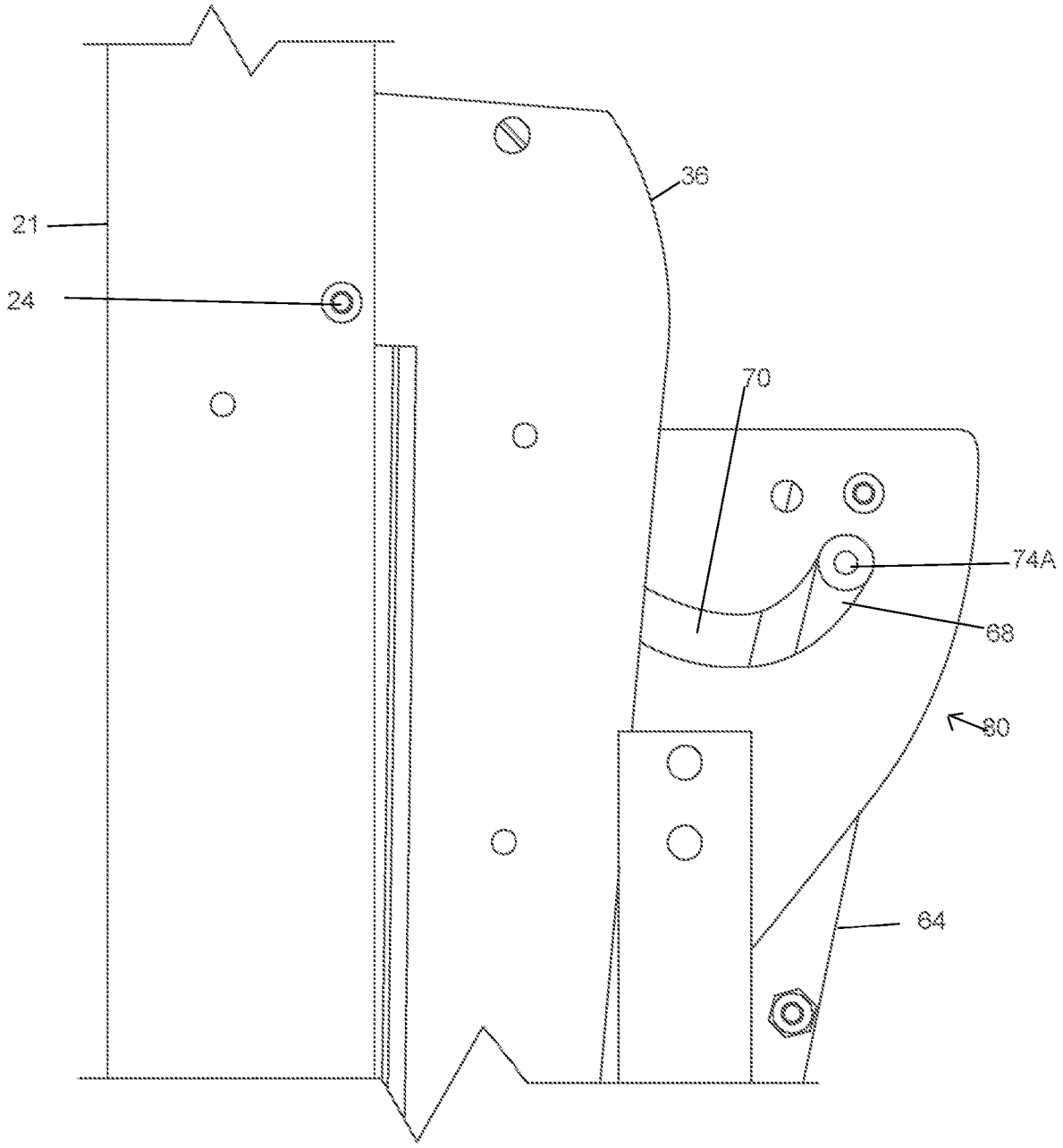
FIG. 15 is a front view of an upper corner and a hub according to one embodiment of the present invention in a closed position.
Figure 16:
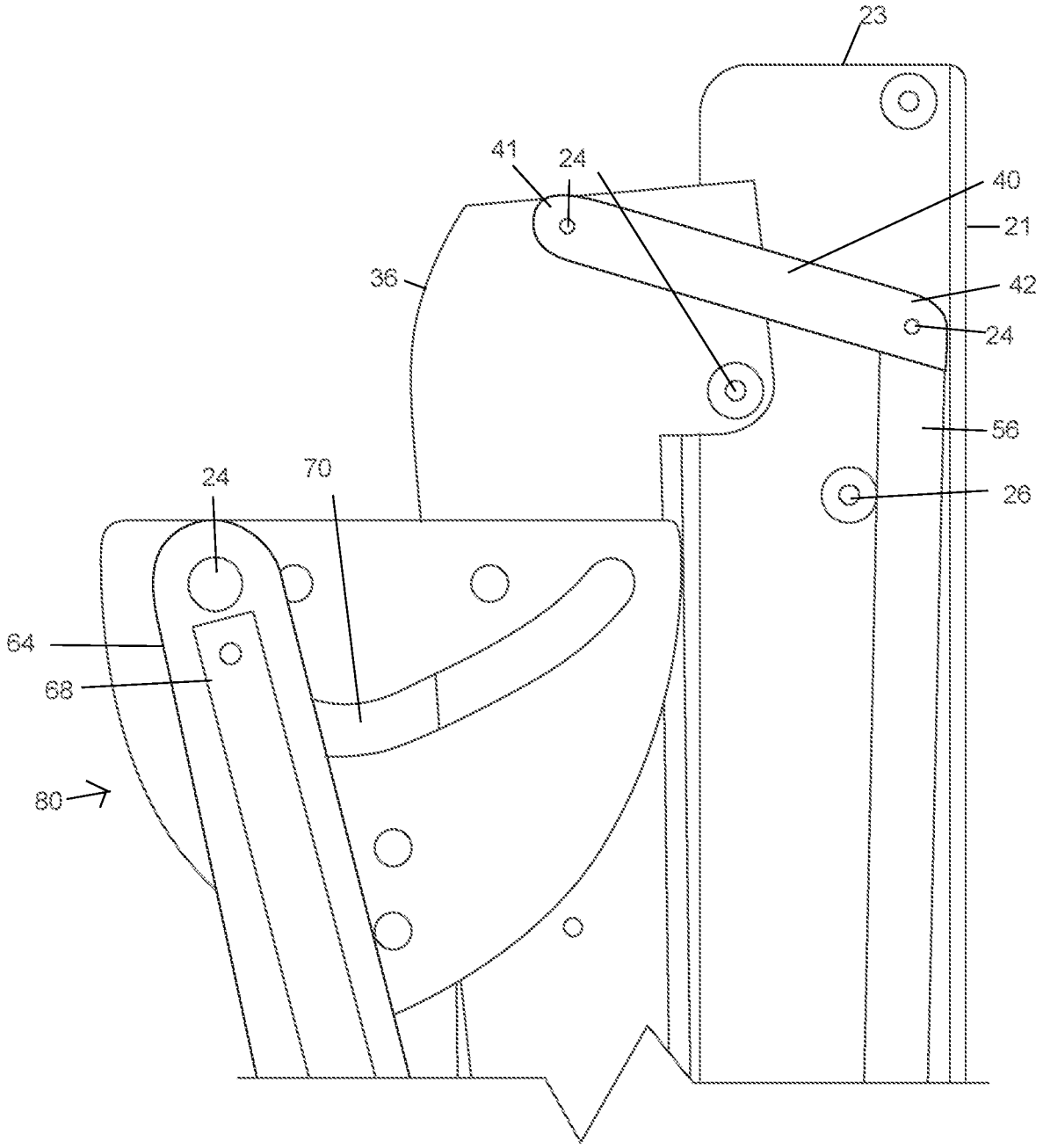
FIG. 16 is a rear view of an upper corner and a hub according to one embodiment of the present invention in a closed position.
Figure 17:
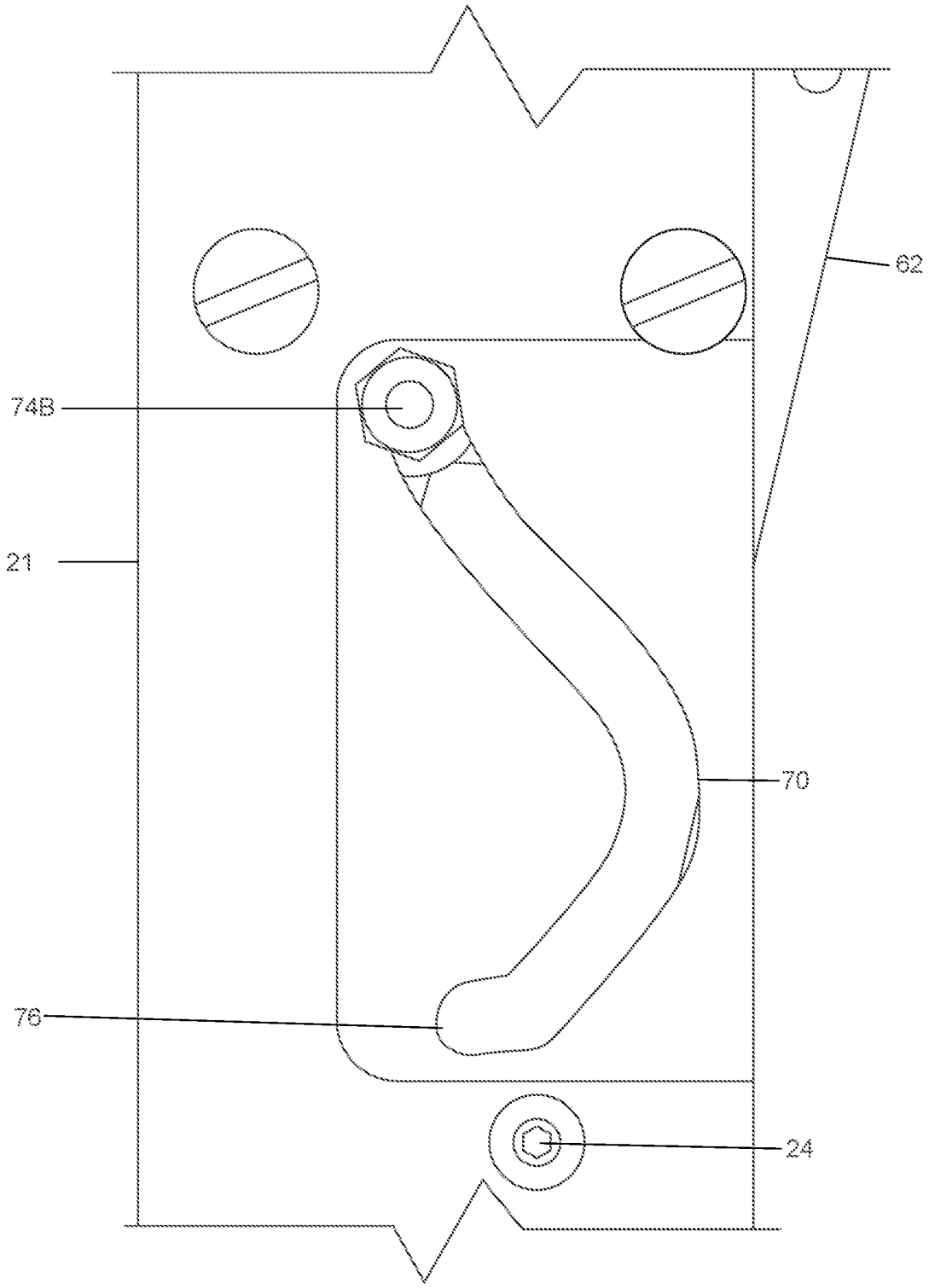
FIG. 17 is a front view of a lower corner according to one embodiment of the present invention in a closed position.
Figure 18:
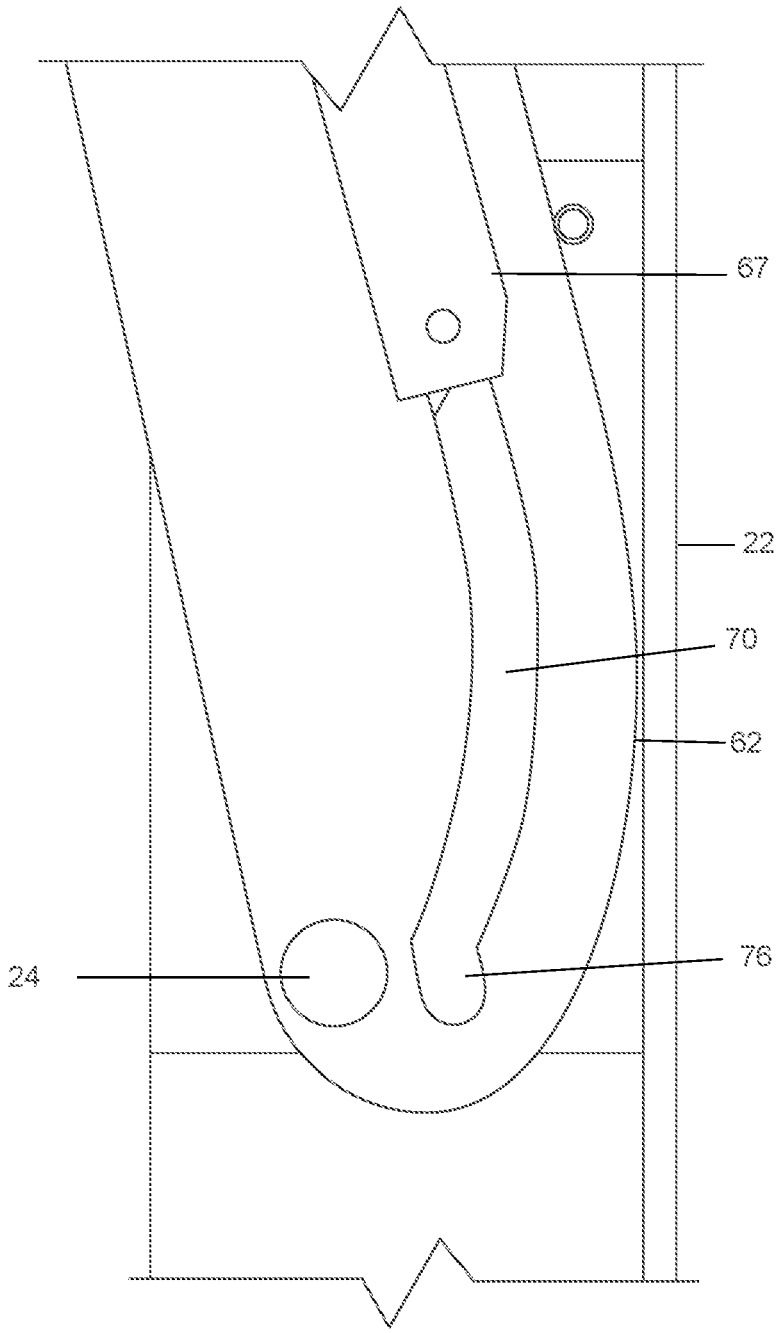
FIG. 18 is a rear view of a lower corner according to one embodiment of the present invention in a closed position.
Figure 19:
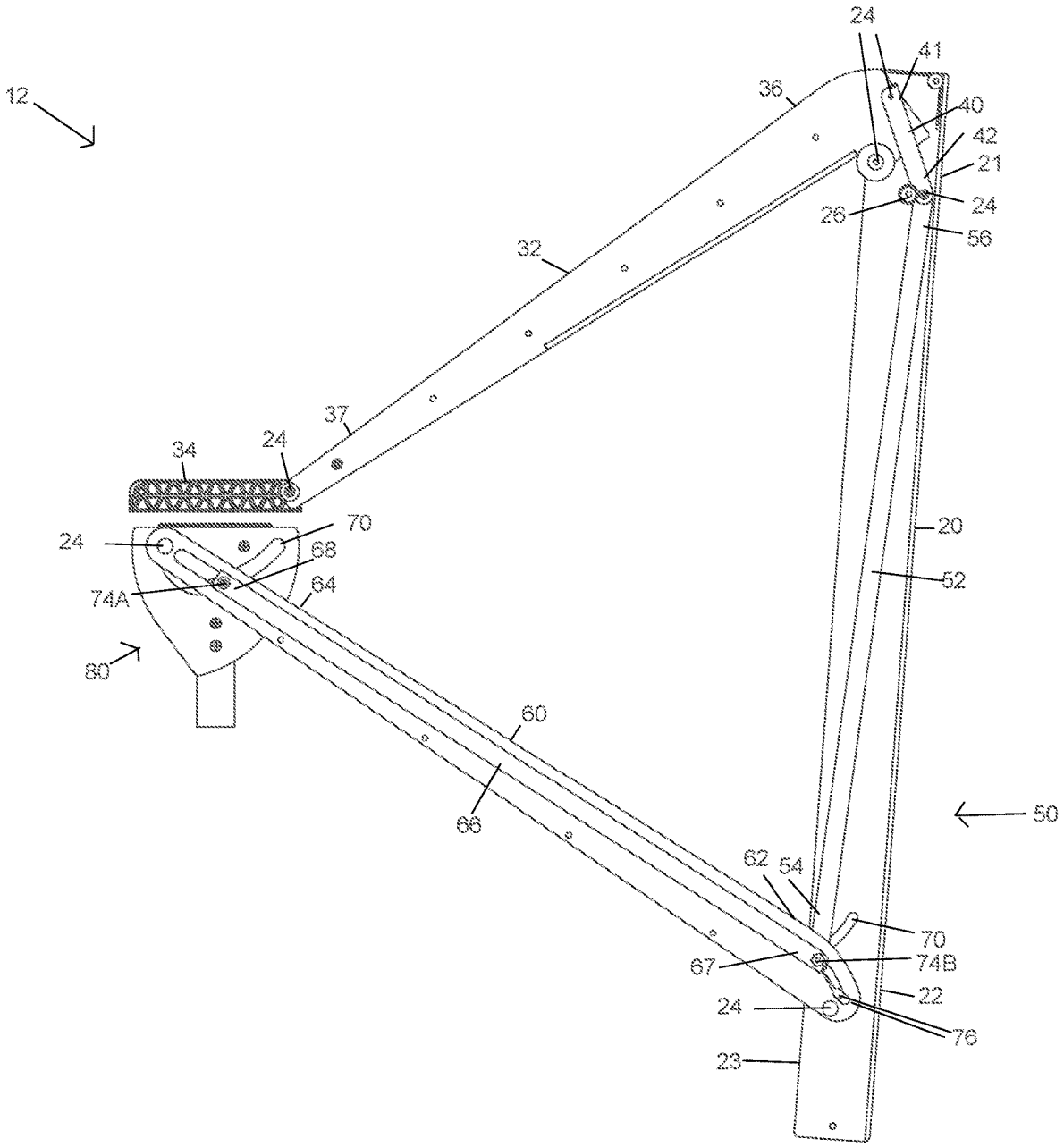
FIG. 19 is a half frame assembly of one embodiment of the present invention in the half open position.
Figure 20:
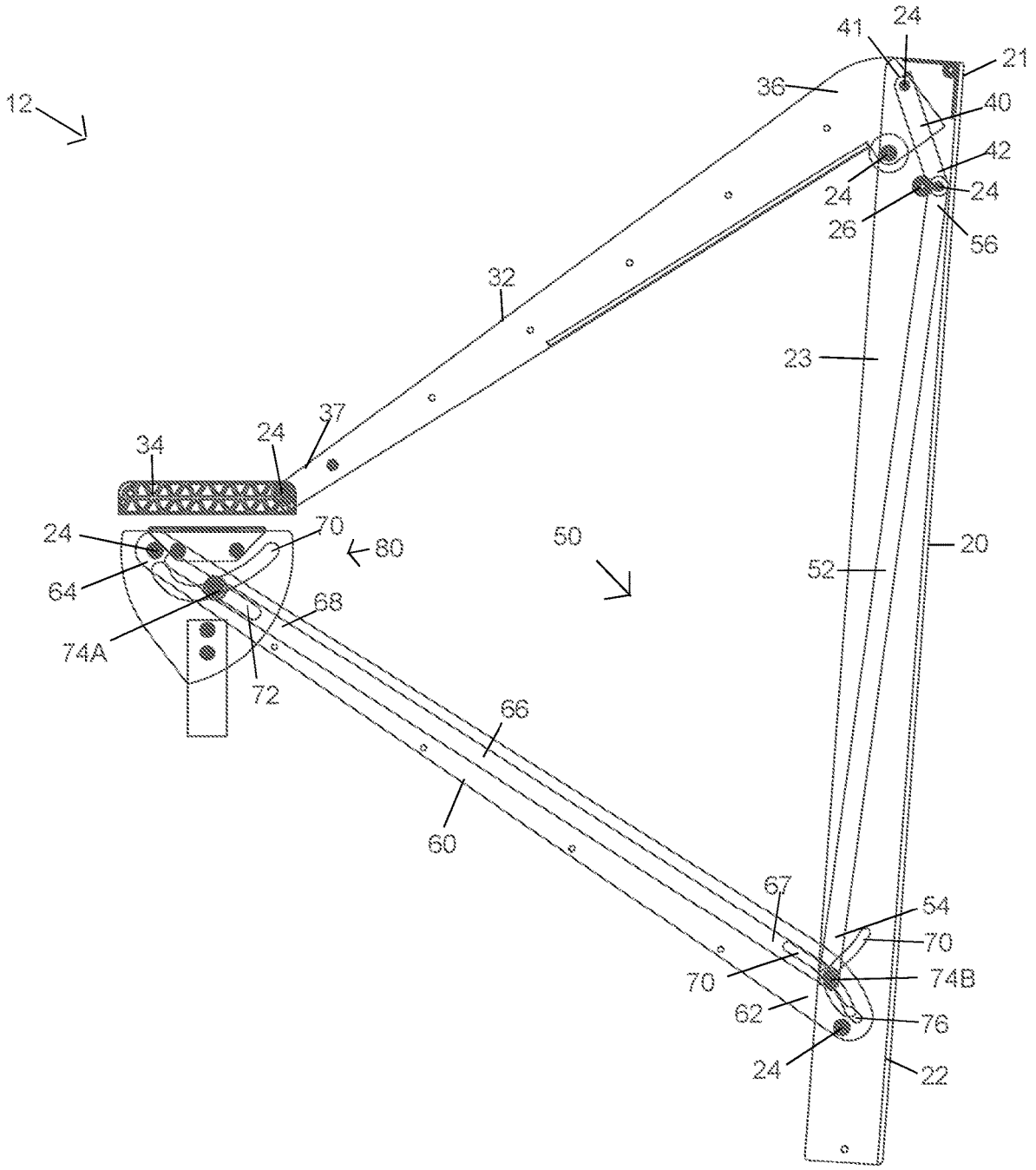
FIG. 20 shows the half frame assembly of FIG. 19 with hidden lines and parts visible.
Figure 21:
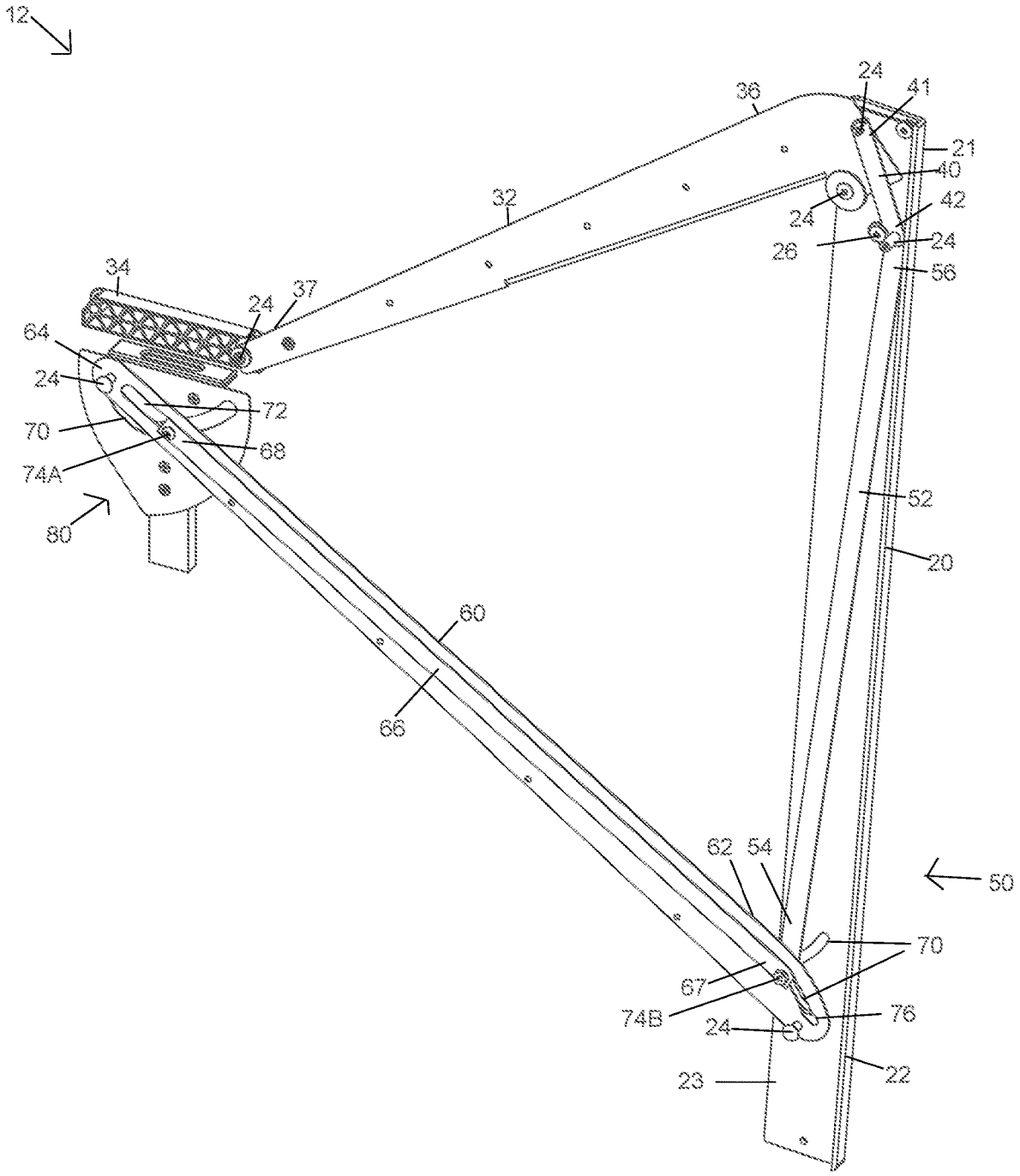
FIG. 21 is a perspective view of the half frame assembly of FIG. 19.
Figure 22:
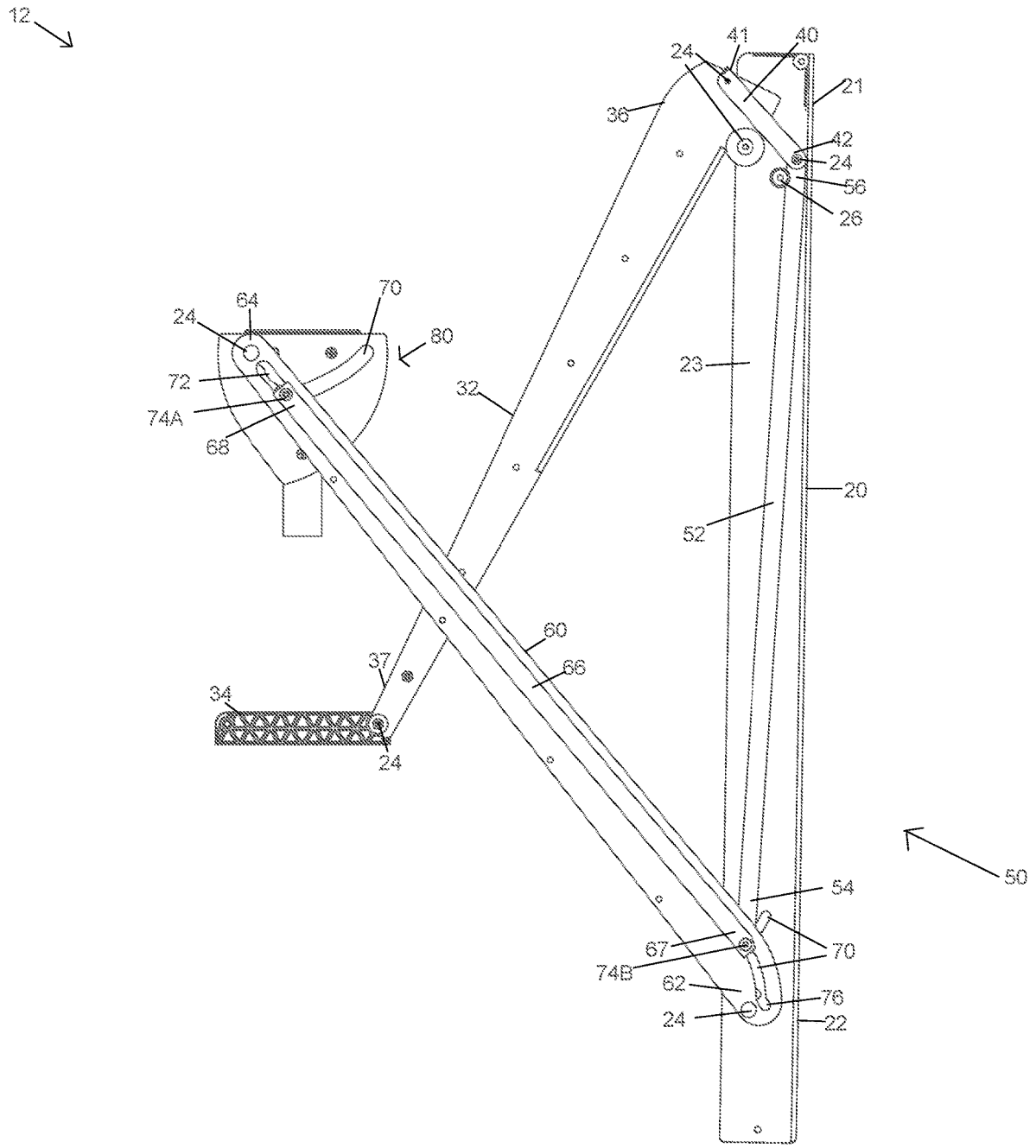
FIG. 22 illustrates a half frame assembly according to one embodiment of the present invention in the almost closed position.
Figure 23:
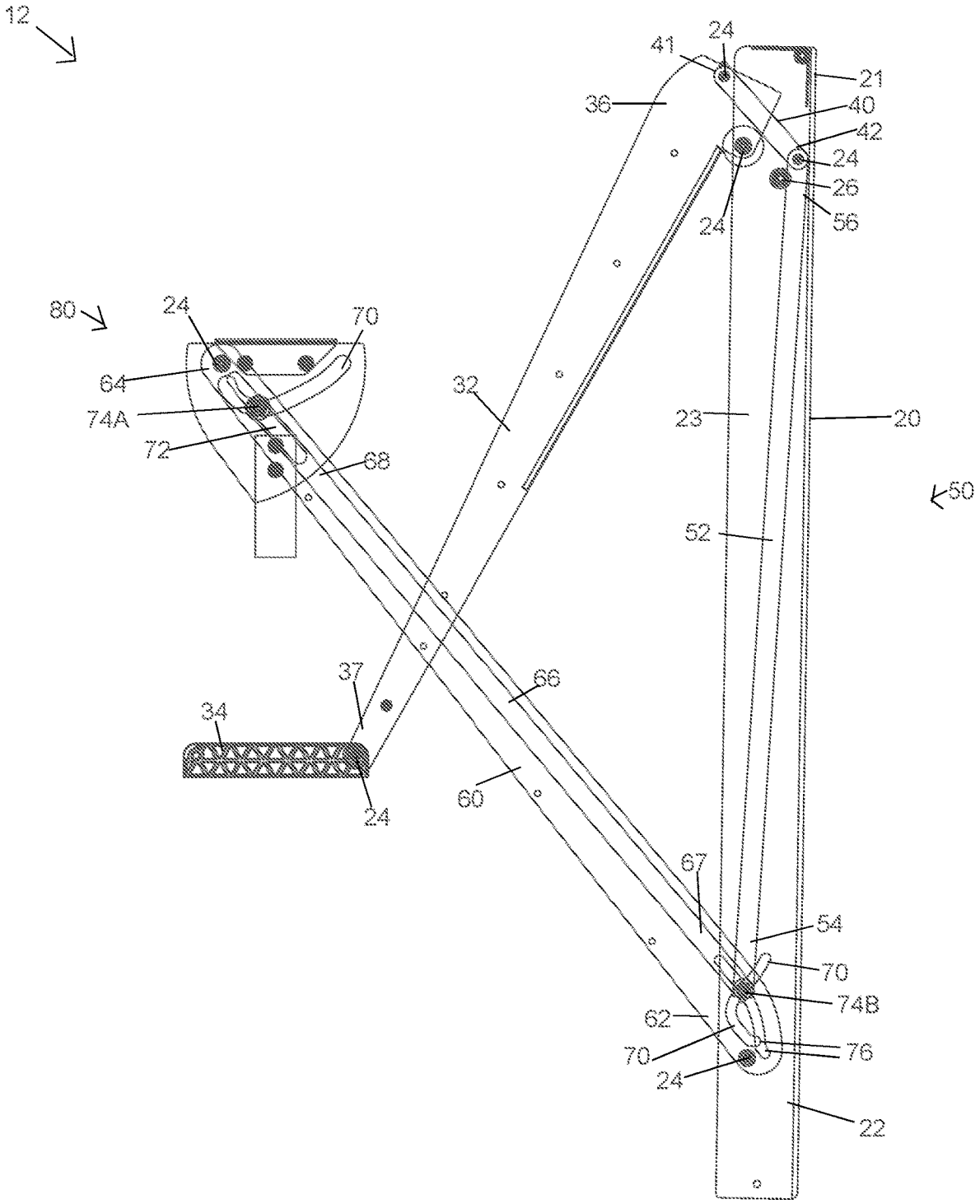
FIG. 23 is an alternative view of the half frame assembly of FIG. 22 with hidden lines and parts visible.
Figure 24:
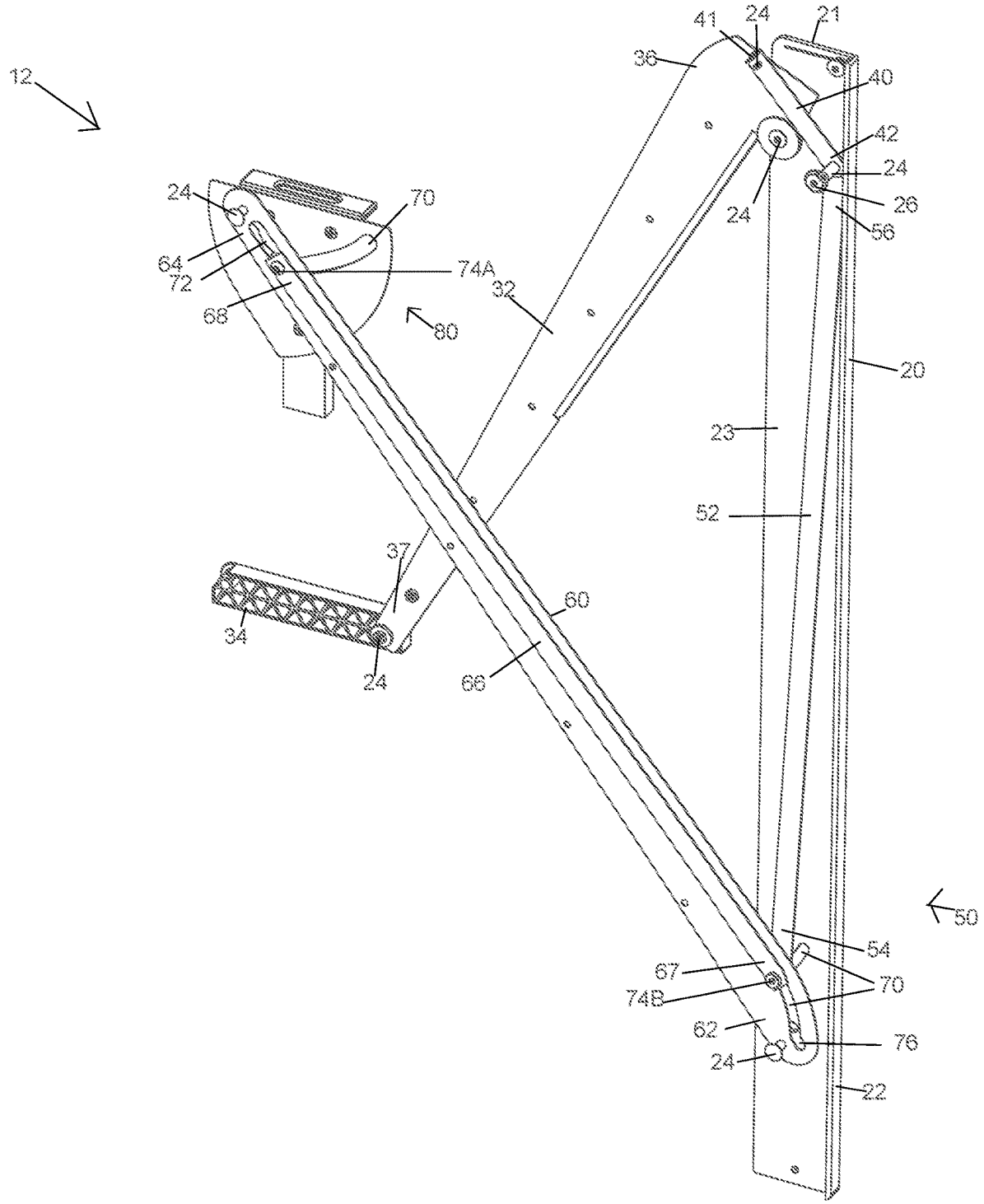
FIG. 24 is a perspective view of the half frame assembly of FIG. 22.
Figure 25:
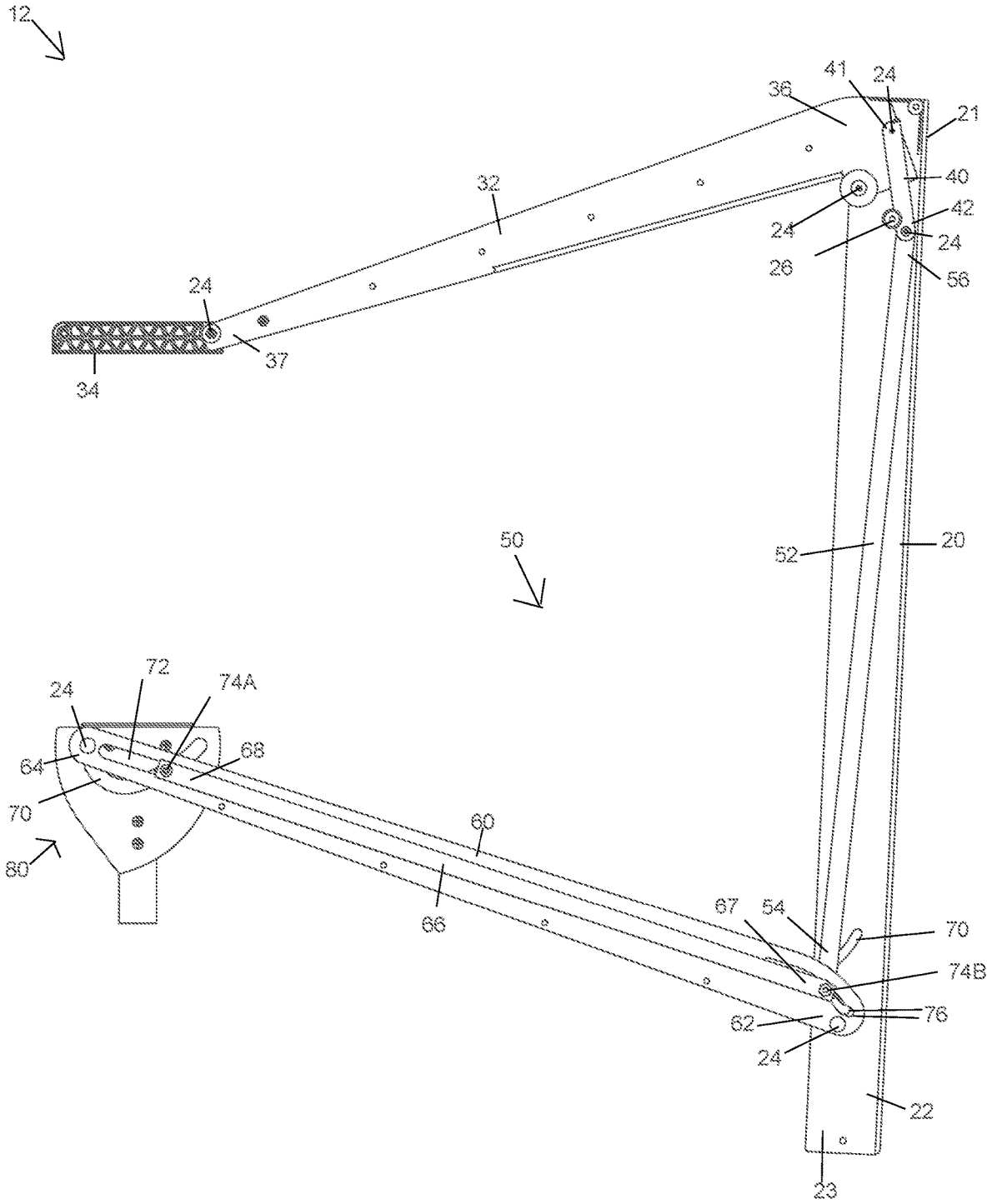
FIG. 25 illustrates a half frame assembly according to one embodiment of the present invention in the almost open position.
Figure 26:
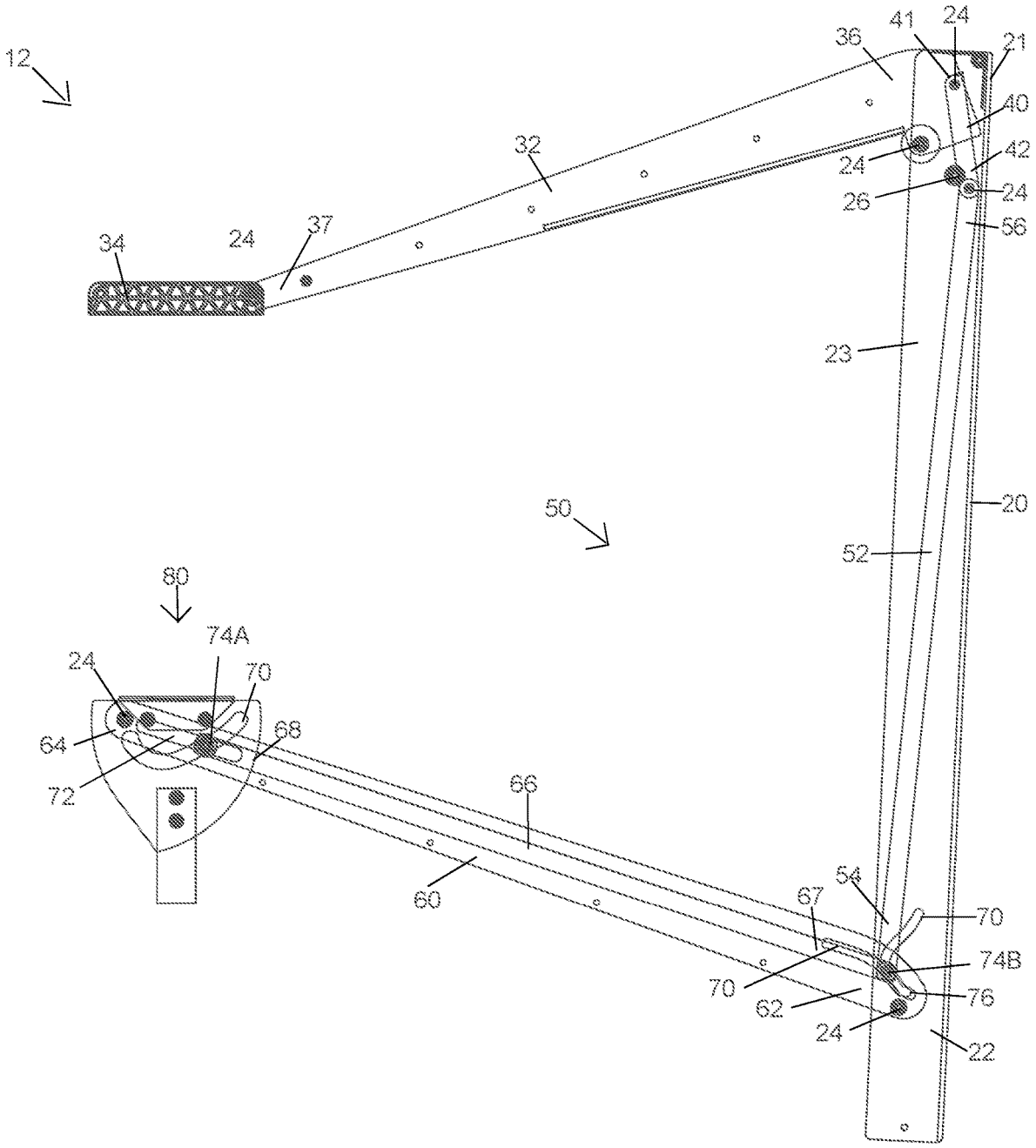
FIG. 26 shows the half frame assembly of FIG. 25 with hidden lines and parts visible.
Figure 27:
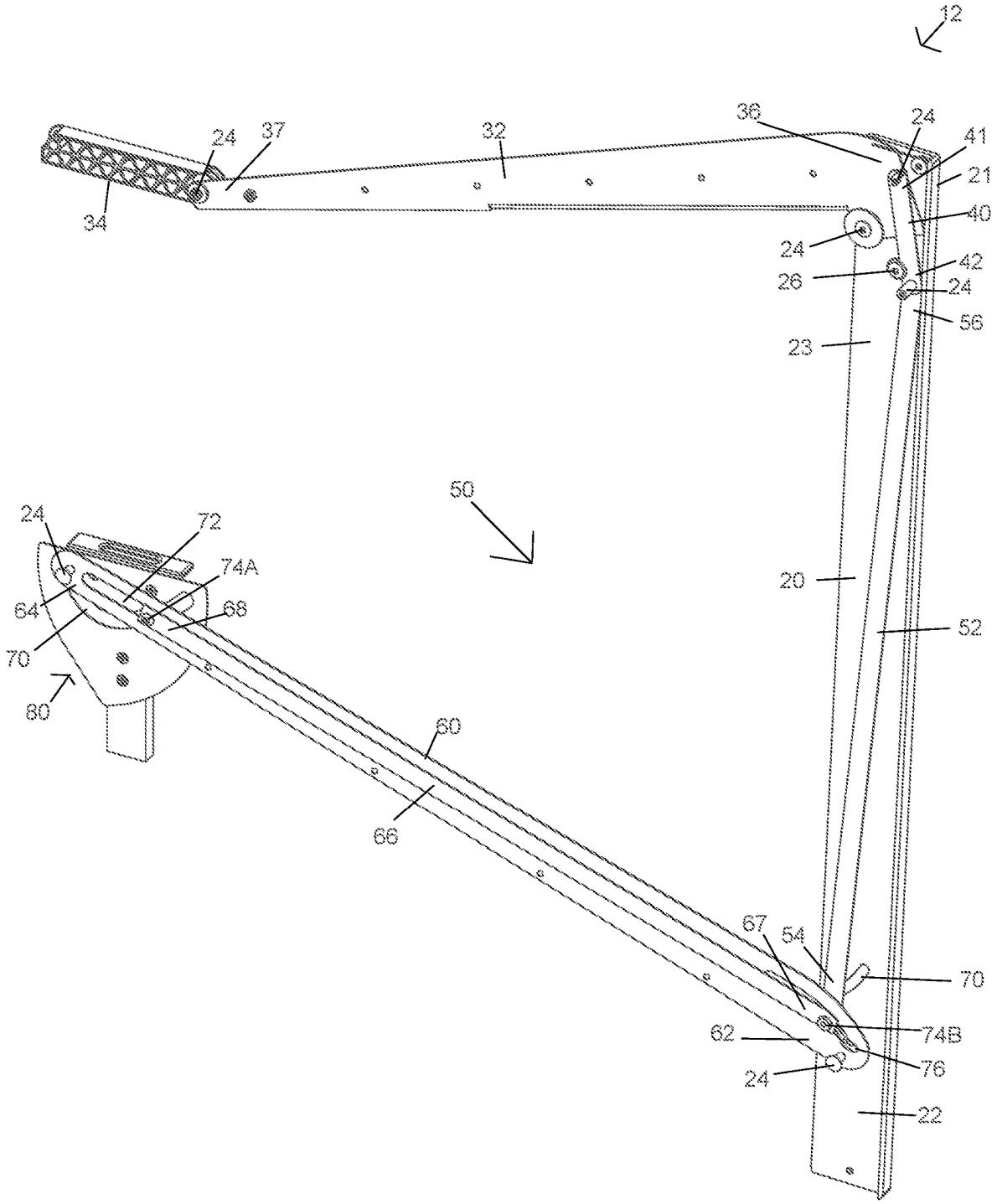
FIG. 27 is a perspective view of the half frame assembly of FIG. 25.
Figure 28:
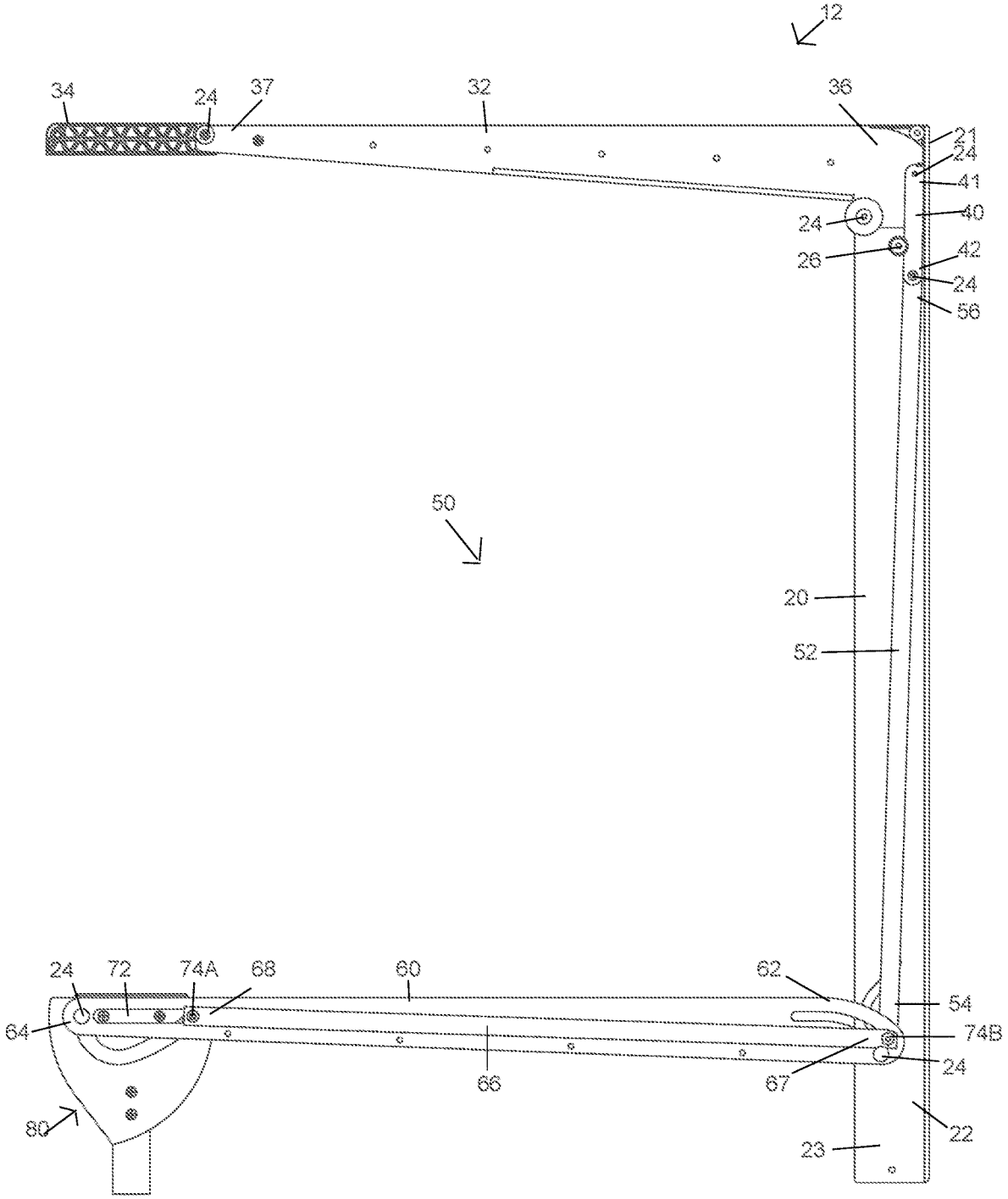
FIG. 28 illustrates a half frame assembly according to one embodiment of the present invention in the open position.
Figure 29:
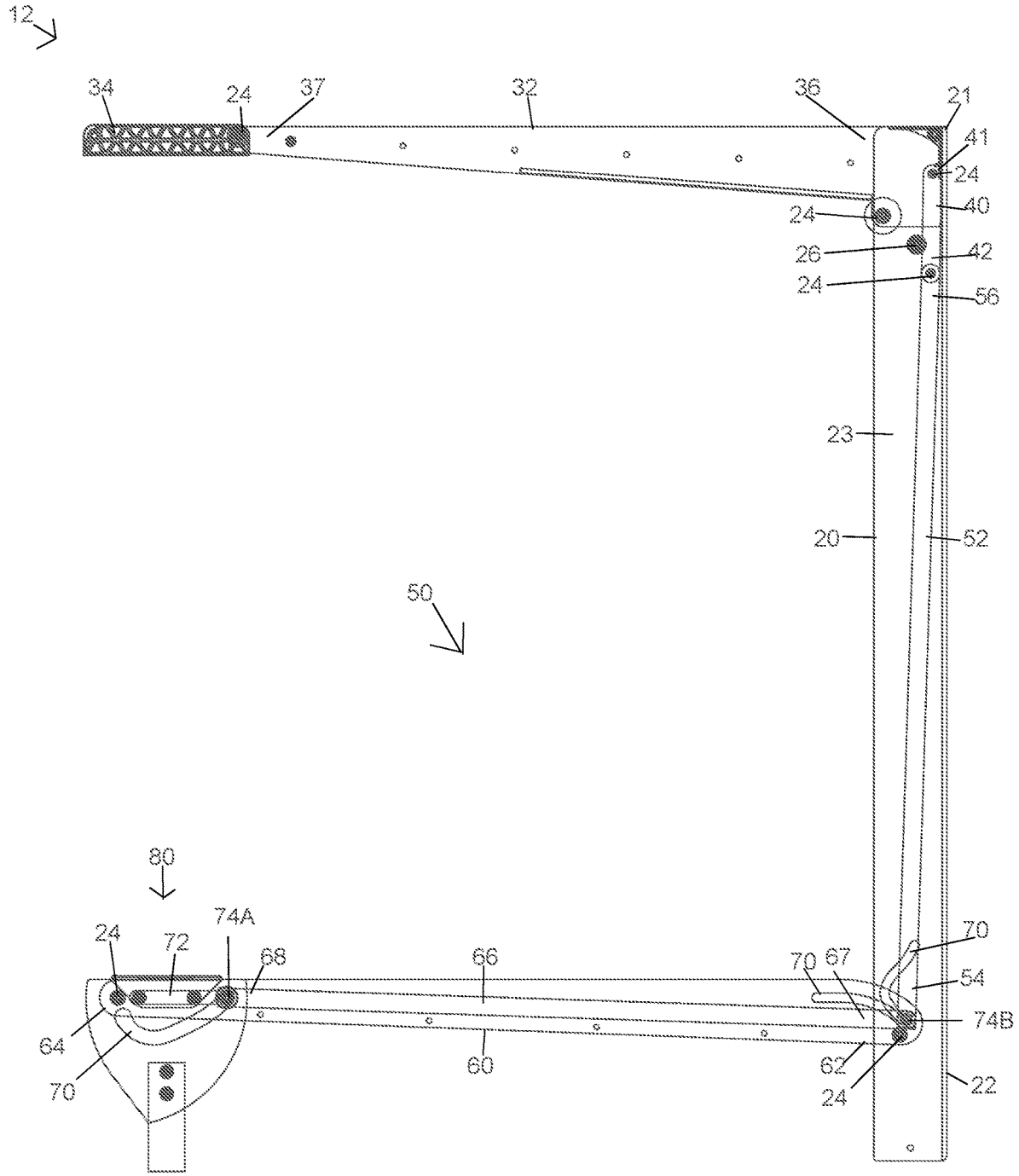
FIG. 29 shows the half frame assembly of FIG. 28 with hidden lines and parts visible.
Figure 30:
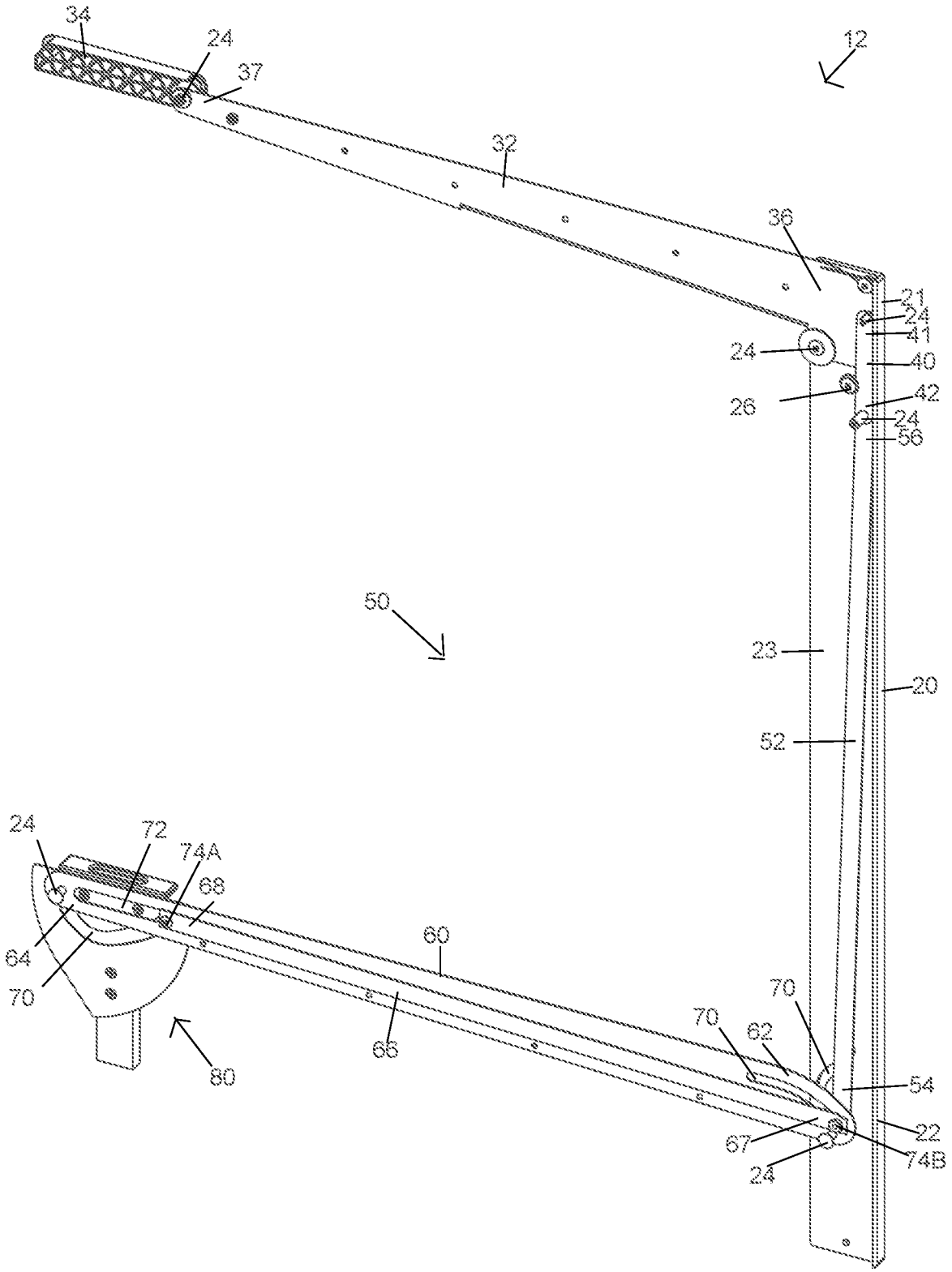
FIG. 30 is a perspective view of the half frame assembly of FIG. 28.
Figure 31:
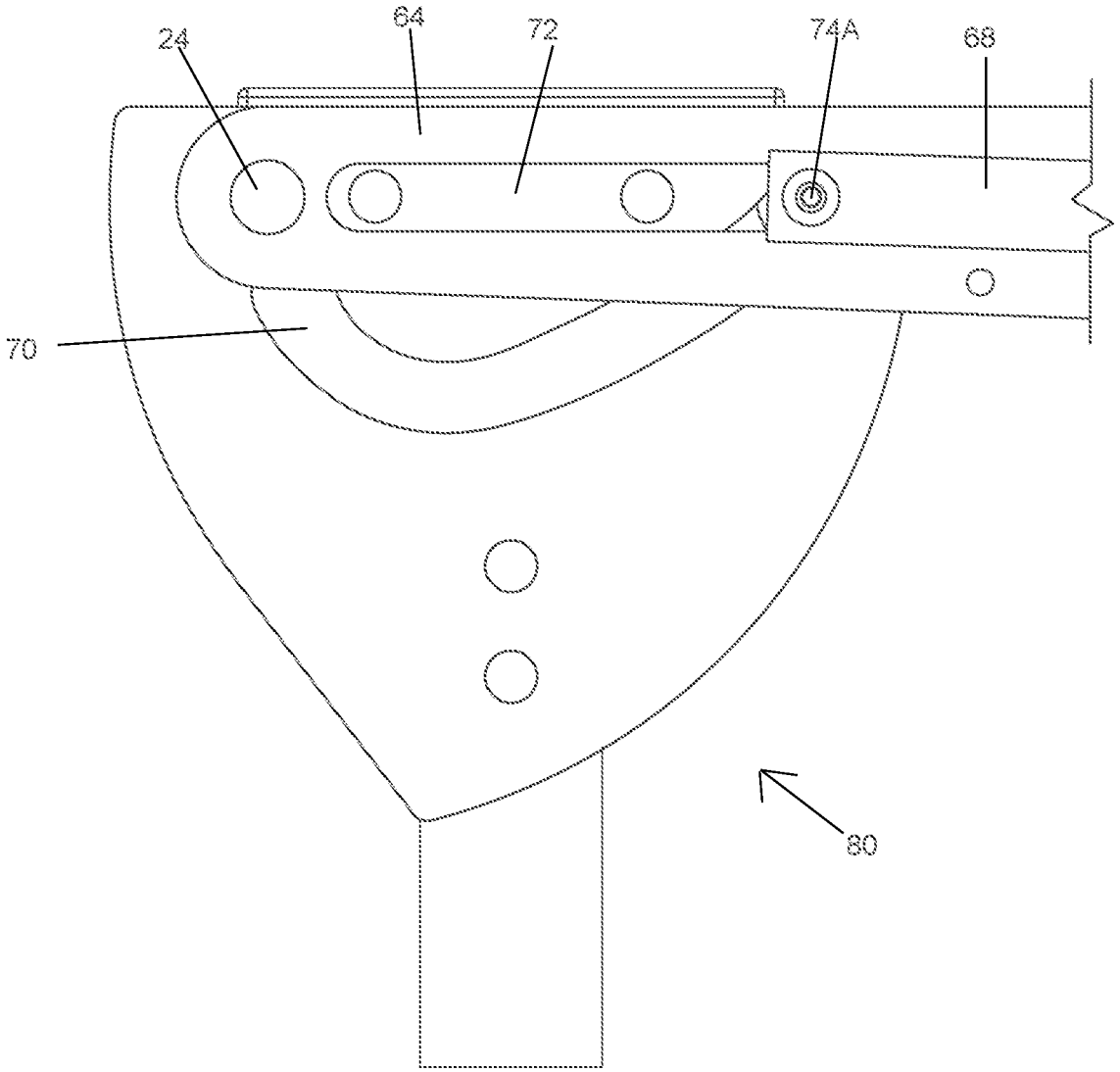
FIG. 31 illustrates a hub according to one embodiment of the present invention with a base strut and strut cam rod in the open position.
Figure 32:
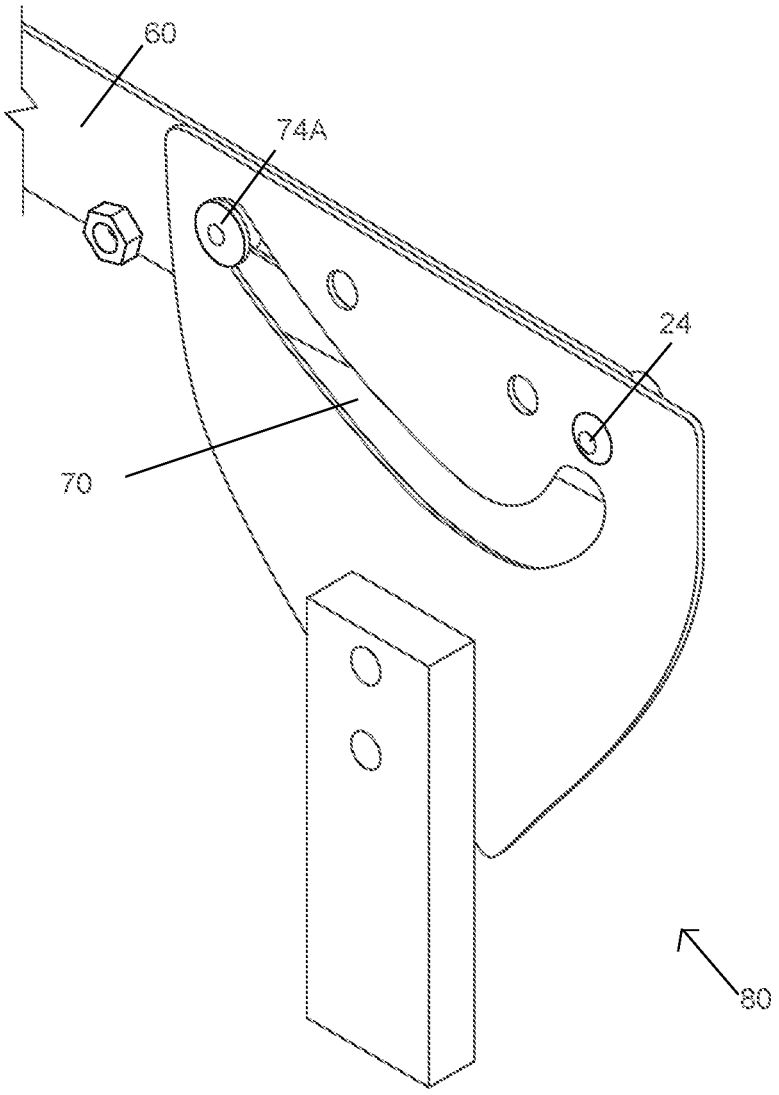
FIG. 32 illustrates the rear view of the hub according to FIG. 31.
Figure 33:
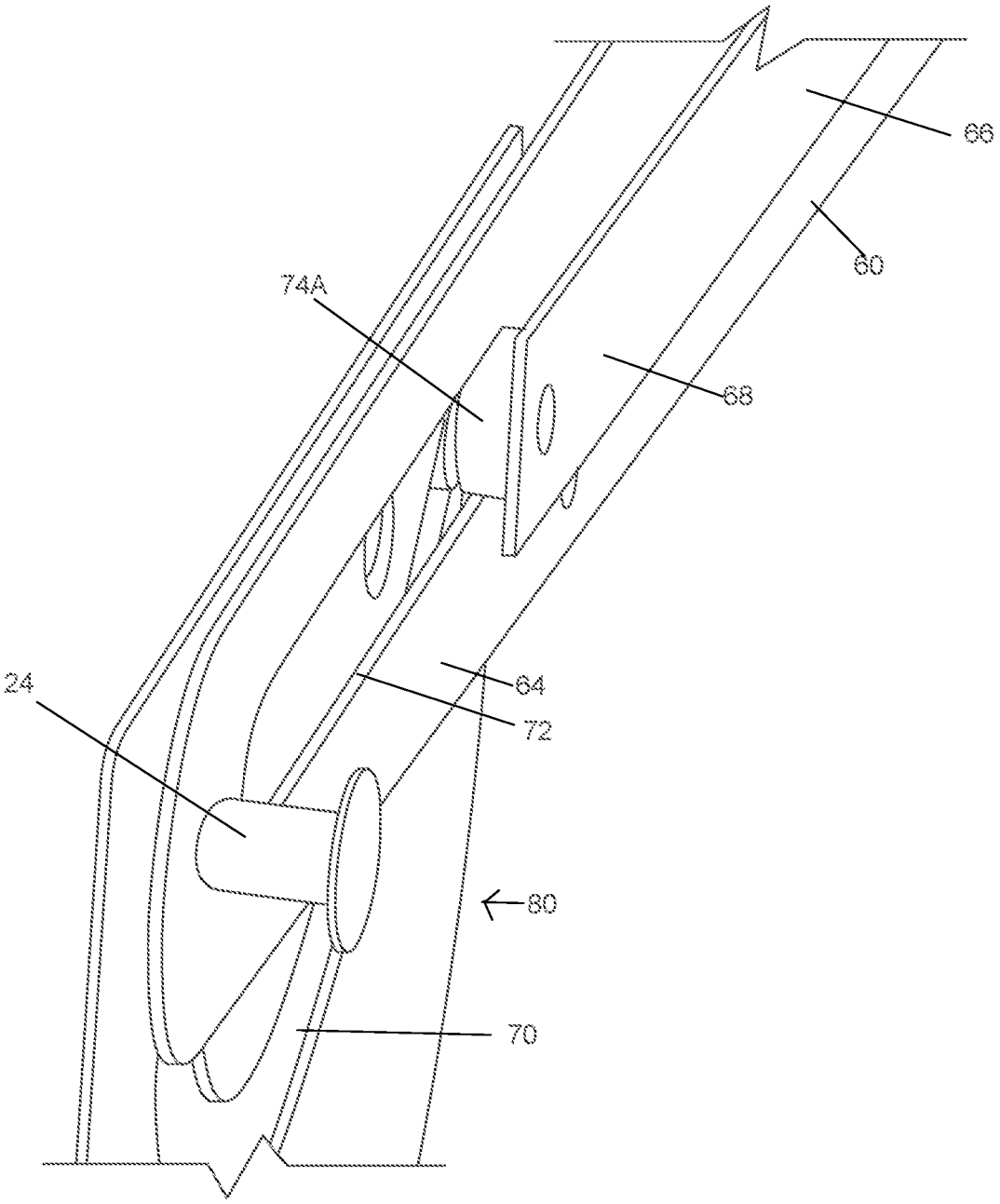
FIG. 33 is a perspective view of the hub according to FIGS. 31 and 32.
Figure 34:
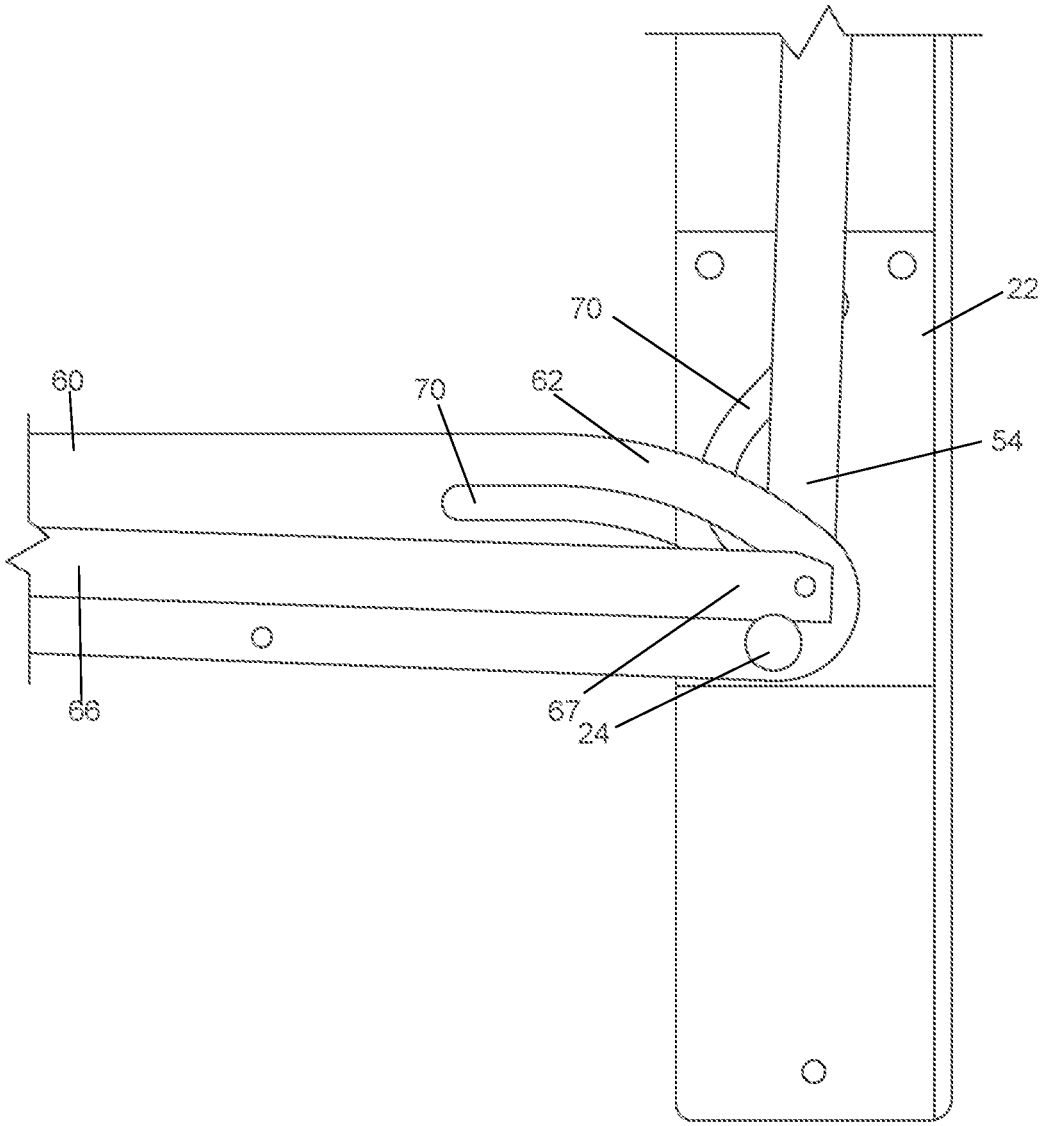
FIG. 34 illustrates the interconnections of a base strut outer end, a strut cam rod outer end and a corner post lower end according to one embodiment of the present invention in the open position.
Figure 35:
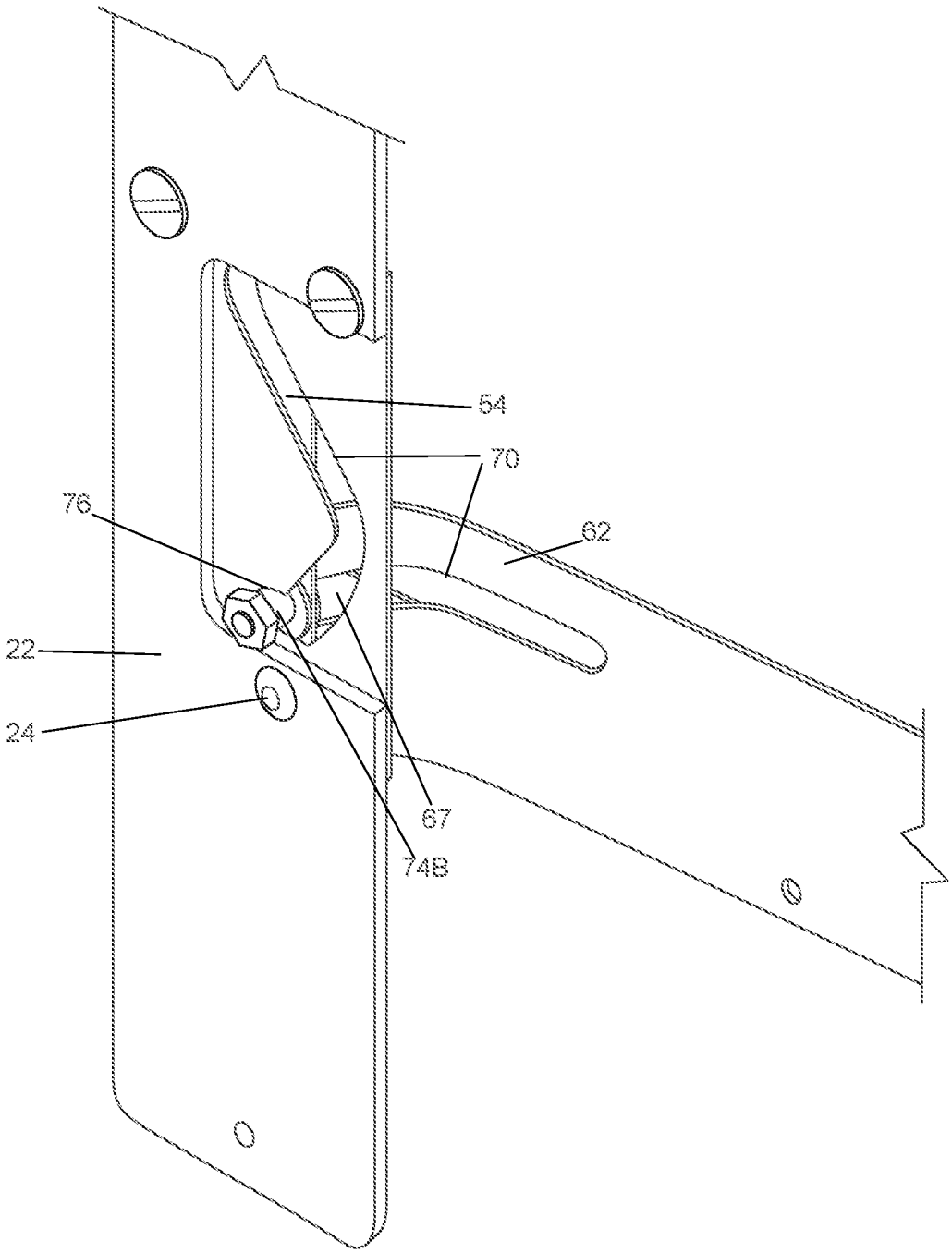
FIG. 35 is the rear view of the lower corner of FIG. 34.
Figure 36:
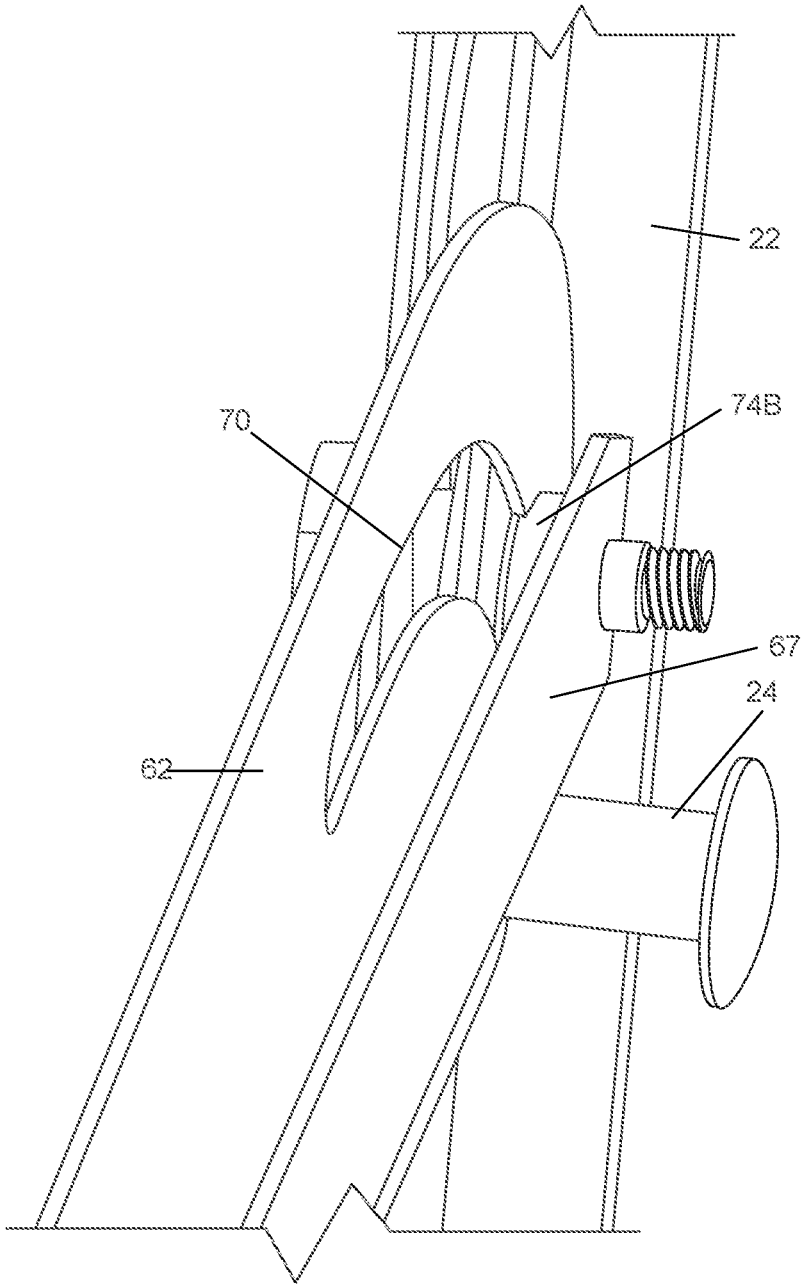
FIG. 36 is a perspective view of FIG. 34.

The play yard 1 closes in a reverse operation. First, the central hub 80 is pulled upward, which pulls cam wheels 74B out of extensions 76 and then draws the corner posts 20 inward as well, while the upper rail assemblies 30 collapses downward. The cam actuator assemblies 50 operate to keep the corner posts 20 from collapsing during this process. FIGS. 12 through 14 show a half frame assembly 12 in the closed position.

Most prior art play yards require a lock to keep the play yards in the closed position, particularly when the play yard is being moved or stored. The present invention play yard 1 can be secured in the closed position by a lock. It will be obvious to one skilled in the art that many of the variety of lock mechanisms that are on the market could be adapted to be used with the present invention. However, the present invention play yard 1 can also be locked using a corner post locking mechanism that is located in the upper corners of the corner posts 20 and can be released through use of pull tab.

In the open position of one embodiment of the present invention, the upper rails 32 will have at least a 4-inch gap to prevent any part of a child's body from getting crushed between the upper rails 32 if the play yard 1 would unexpectedly close with a child in it. This gap is accomplished via the upper joint members 34, which should be at least 4 inches in length.

Mechanical Control Assembly and System 200

Play yards that are on the market today are some of the most complex mechanical consumer products. For one popular model, there are twenty-one independent structural subassemblies each with multiple pivot connections totaling twenty-four interconnected pivoting joints. Industrial robots by comparison have six subassemblies, six joints, and they have the advantage of having a motor control each joint. The goal of the mechanical control assembly and system 200 of certain embodiments of the present invention is, in the absence of motors for control, to provide a low cost means of coordinating the joints and pivot points so the play yard 1 moves between the two states, closed and open, in a controlled manner that is easy for users to manipulate. For discussion purposes, the phrase "mechanical control assembly 200" includes both a mechanical control assembly and a mechanical control system. The mechanical control assembly 200 is the combination and interconnection of the necessary parts, slots, and cutouts described and shown herein in to control the movement of a foldable structure 1000. The system is the use of all of the identified parts, slots and cutouts to manipulate the physics and movement of parts of a foldable structure 1000 to open and close the foldable structure 1000.

Figure 49A:
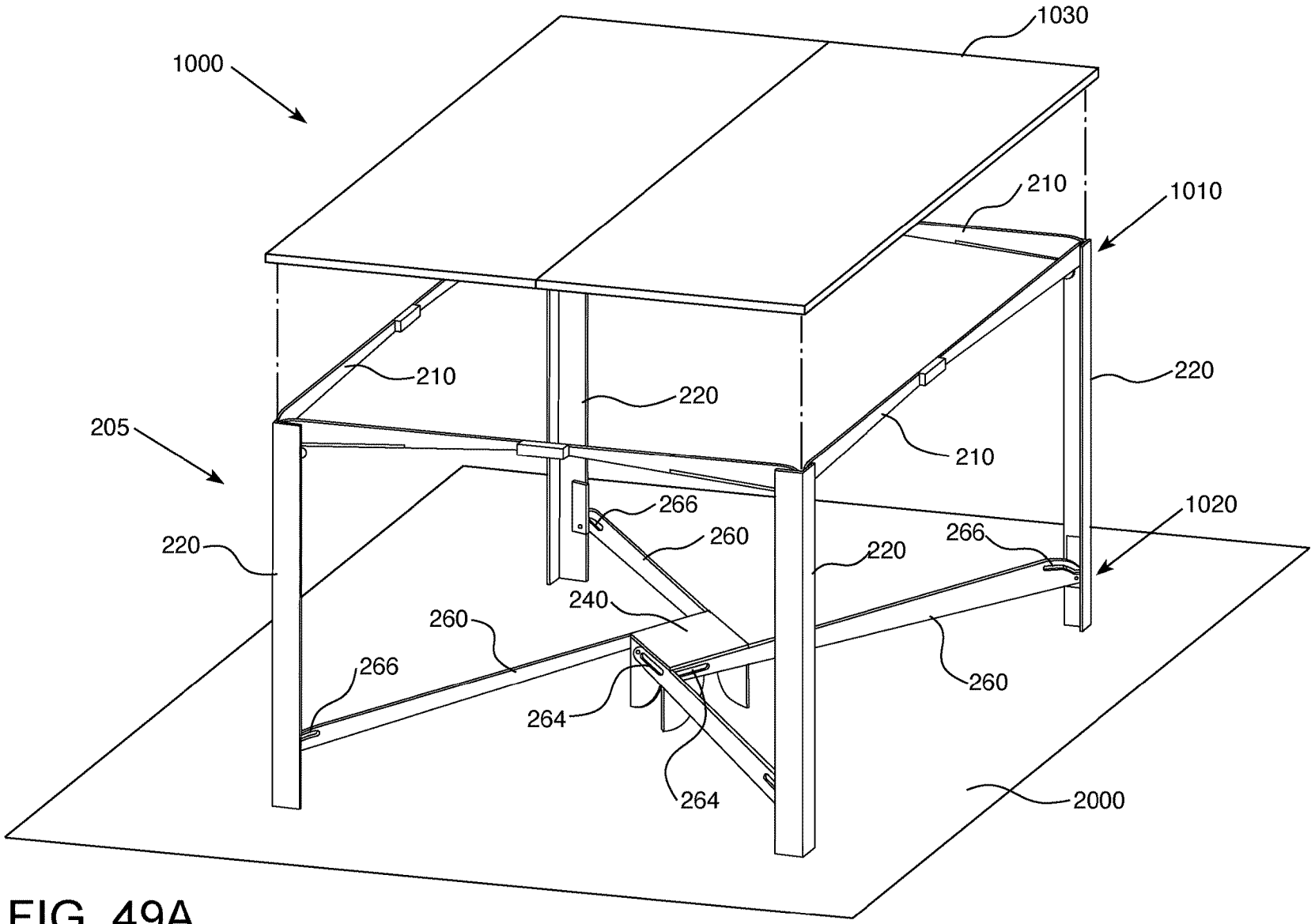
FIG. 49A shows one embodiment of a foldable structure that is a table and FIG. 49B shows one embodiment of a foldable structure that is the frame of a play yard.
Figure 49B:
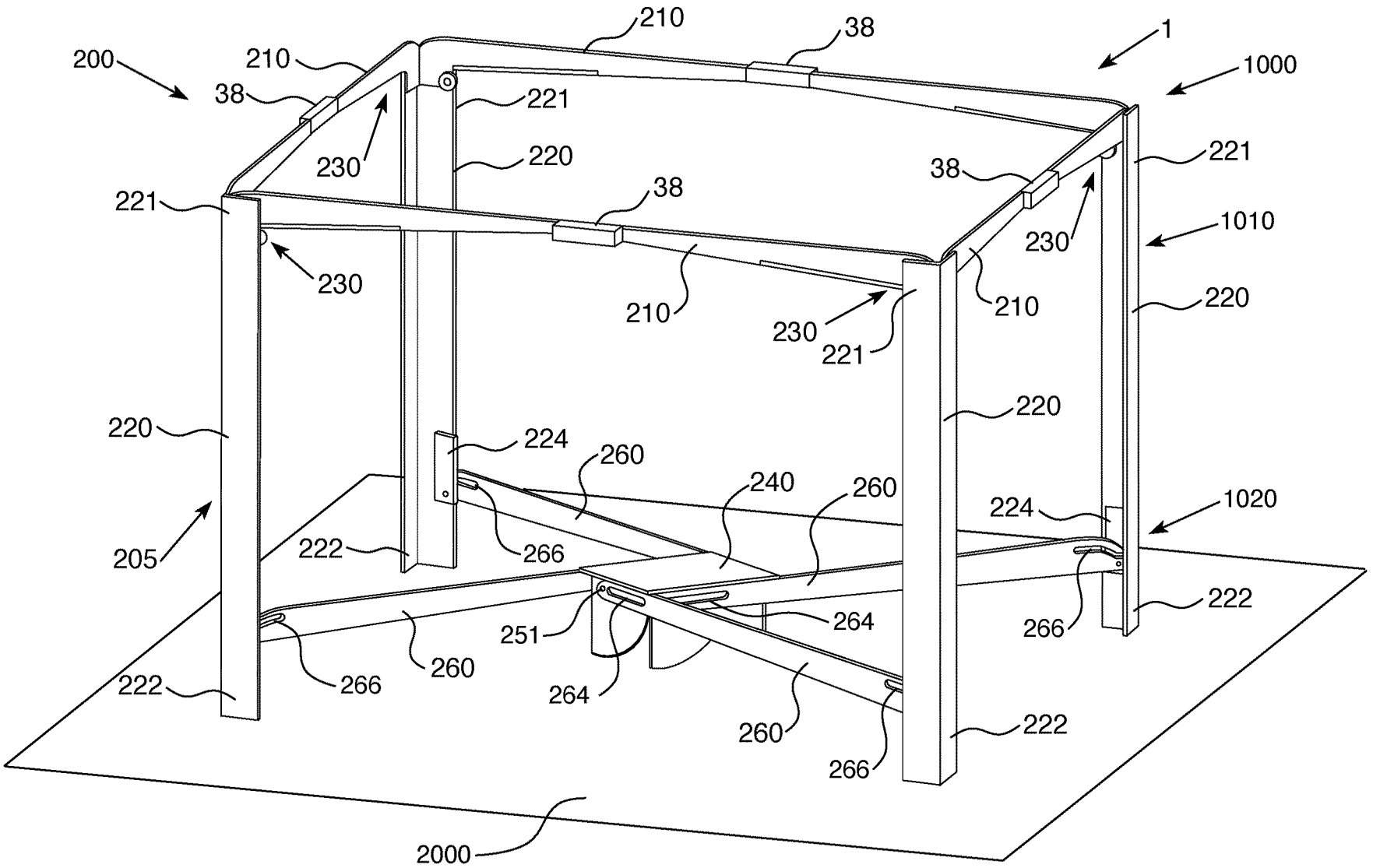

Various embodiments of a mechanical control assembly 200 are described herein within the context of various non-limiting embodiments of the play yard 1. However, it will be obvious to one skilled in the art, that these embodiments of a mechanical control assembly 200 can be used with any foldable structure 1000 that is comprised of basic components that are structurally and/or functionally equivalent to the play yard 1 components described in the various embodiments of the present invention. FIG. 49A illustrates one embodiment of a foldable structure 1000 that is a folding table. The table shown in FIG. 49A has a foldable structure 1000 as the base with a tabletop 1030 that sits on top of the foldable structure 1000. FIG. 49A also shows the relative top 1010 of the foldable structure 1000 and the relative bottom 1020 of the foldable structure 1000, which is closer to the floor 2000 in the open position. Similar to the assembly shown in FIG. 51A, the hub 240 is closer to the top 1010 of the foldable structure 1000 in a more closed position. In the more open position, and similar to FIG. 54, the hub 240 of the foldable structure 1000 is closer to the bottom 1020 of the foldable structure 1000. FIG. 49B illustrates a similar foldable structure 1000 that is the frame 205 for a child's play yard 1.

Figure 58:
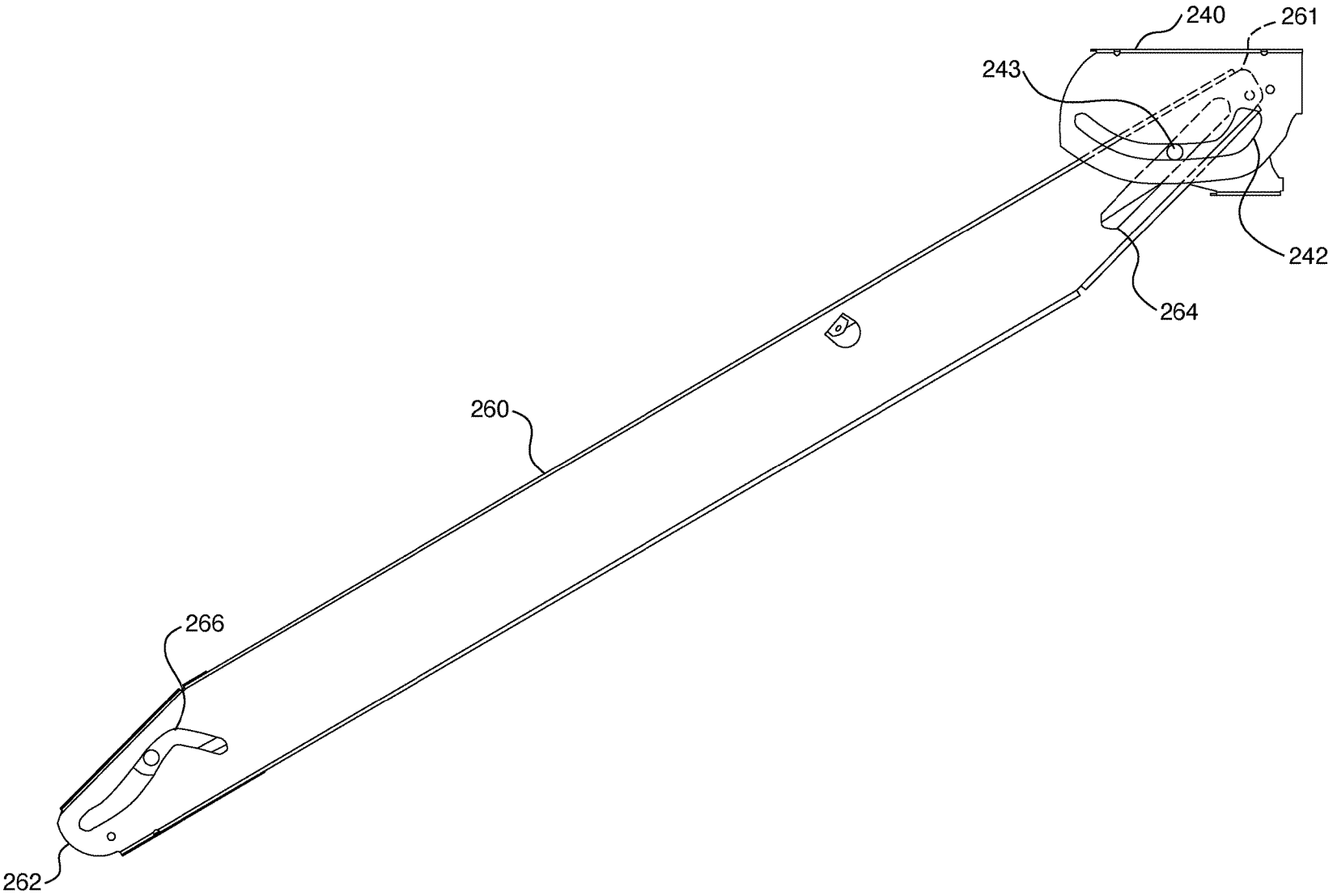
FIG. 58 shows one embodiment of a lower arm connected to one embodiment of a hub slot.

For the following discussion one embodiment of a mechanical control assembly 200 for a basic play yard 1 structure is illustrated in FIG. 49B. That play yard 1 has four upper arms 210. Each upper arm 210 connects two adjacent corner posts 220 at each corner post's top 221. The play yard 1, shown in FIG. 49B, has four corner posts 220 (each with a top 221 and a bottom 222) that extend from the upper arms 210 to a floor 2000, to the ground, or to play yard feet. Each corner post 220 connects to two upper arms 210 either directly at each of two corner post-upper arm joints 230 and/or to the upper end 311 of a pull rod 310 that runs adjacent to and substantially parallel to each corner post 220. In the center of the play yard 1 is a hub 240. Four lower arms 260 (a non-limiting example of which is shown in FIG. 58) connect the hub 240 to each of the corner posts 220 (at their bottoms 224) (and, in some embodiments, to the lower ends 312 of the pull rods 310 at each of four lower arm-post joints 270). The lower arms 260 can connect directly to the corner posts 220 or they can connect to a corner post mount 224, which is a small extension of or additional piece attached to each corner post bottom 222. Each lower arm 260 has a hub end 261 and a post end 262. Each lower arm 260 connects to the hub 240 at a hub slot 242 and forms a hub-lower arm joint 250. For some embodiments, each lower arm 260 is paired with a pushrod 280 that runs adjacent to and substantially parallel to the corresponding lower arm 260. For embodiments incorporating push rods 280, each pushrod 280 connects to the hub 240 at its pushrod hub end 281 and to a corner post 220 and/or a pull rod 310 at its pushrod corner end 282. It is within the context of a standard play yard 1 of the design shown in FIG. 49B that the certain embodiment of the invention are described below. However, the aspects of the below-described invention can be implemented in and incorporated into play yards of a variety of designs and structures and into structurally or functionally similar foldable structures 1000.

Figure 54:
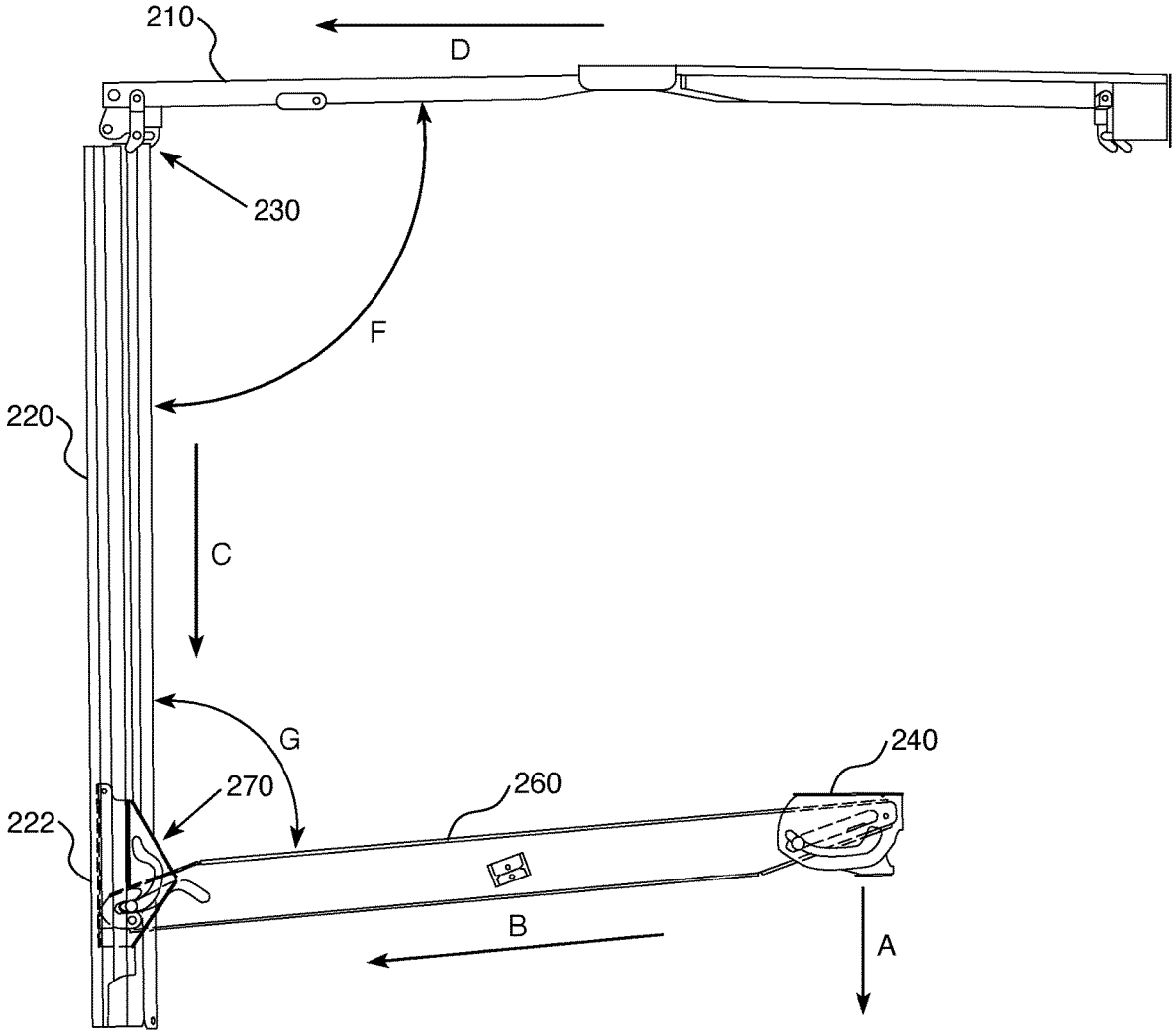
FIG. 54 illustrates the interconnected movements of an upper arm, corner post, lower arm and hub according to one embodiment of the present invention.

Push Angle. In a standard play yard with no mechanical control system, there is nothing to lift the upper arms as the user tries to open the play yard by pushing down on the standard hub. In these standard play yards, the upper arms and corner posts simply fall to the floor when not in a fully opened position. Various embodiments of the play yard mechanical control assembly 200 lift the upper arms 210 while the play yard is being opened and then secure the upper arms 210 in a horizontal state when play yard 1 is fully opened. The energy for this lifting work in a play yard 1 that incorporates an embodiment of the mechanical control assembly 200 is delivered by the user who exerts force over a distance as they push down on the hub 240, as shown in FIG. 54. This energy from the user's push is delivered from the hub 240 to the bottom 222 of each corner post 220 and/or to the pull rod 310 via a pushrod 280 that is mounted inside or alongside of each of the lower arms 260 (see FIGS. 51A, 51B, and 54). As the user forces the hub 240 down (FIG. 54 at A), the pushrod 280 (and the lower arm 260) is forced to move outwards away from the hub 240 (FIG. 54 at B) and this outward movement causes mechanical actuation at the corner post bottoms 222 that is mechanically communicated to the upper arms 210 causing the arms 210 to raise and lock (FIG. 54 at C, D, F, and G). The pushrod 280 has a pushrod hub end 281, which connects to the hub 240 and to the lower arm hub end 261 as shown in FIG. 51A through 52C.

Figure 52A:
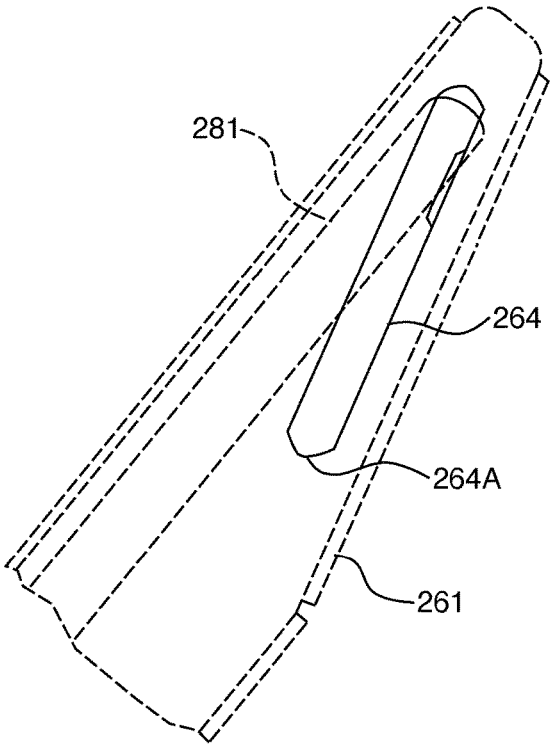
FIGS. 52A through 52C illustrate the interconnections and individual pieces of one embodiment of a lower arm hub slot, hub, and pushrod of the present invention.
Figure 52B:
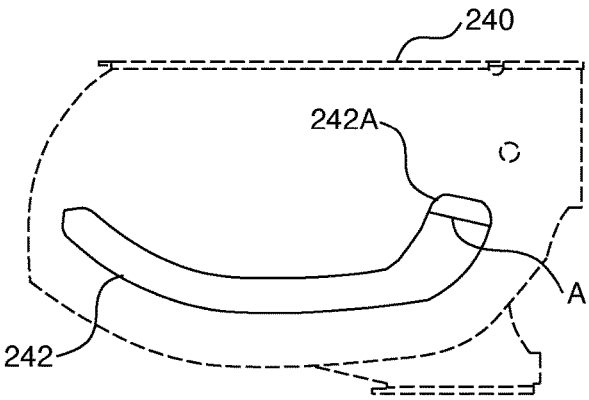
Figure 52C:
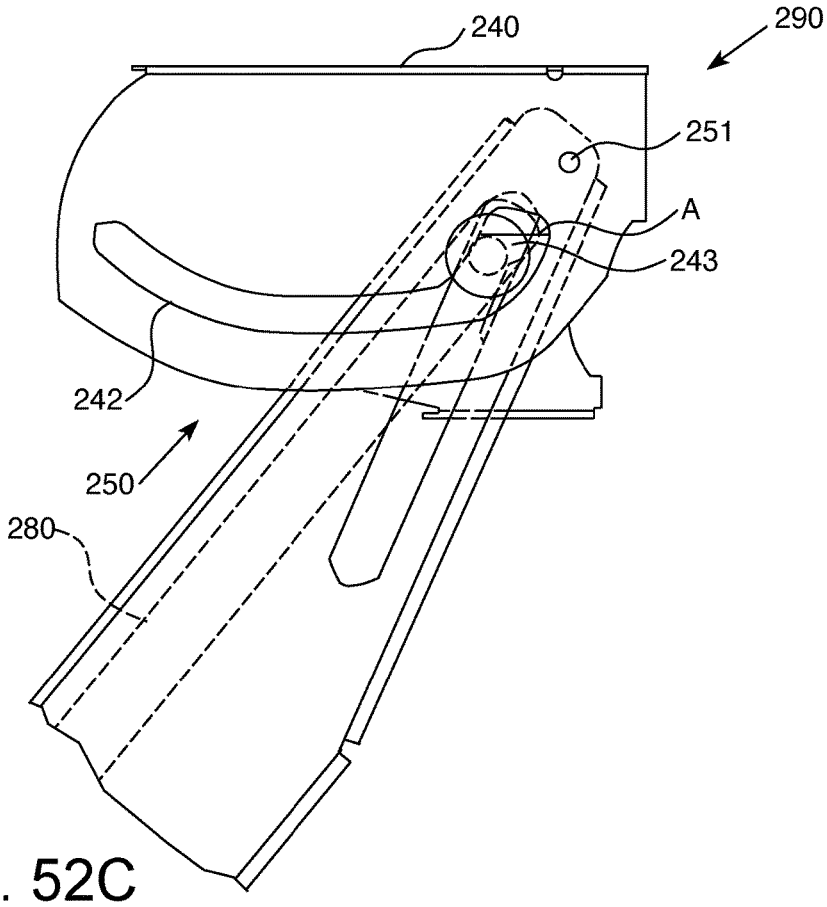
Figure 53A:
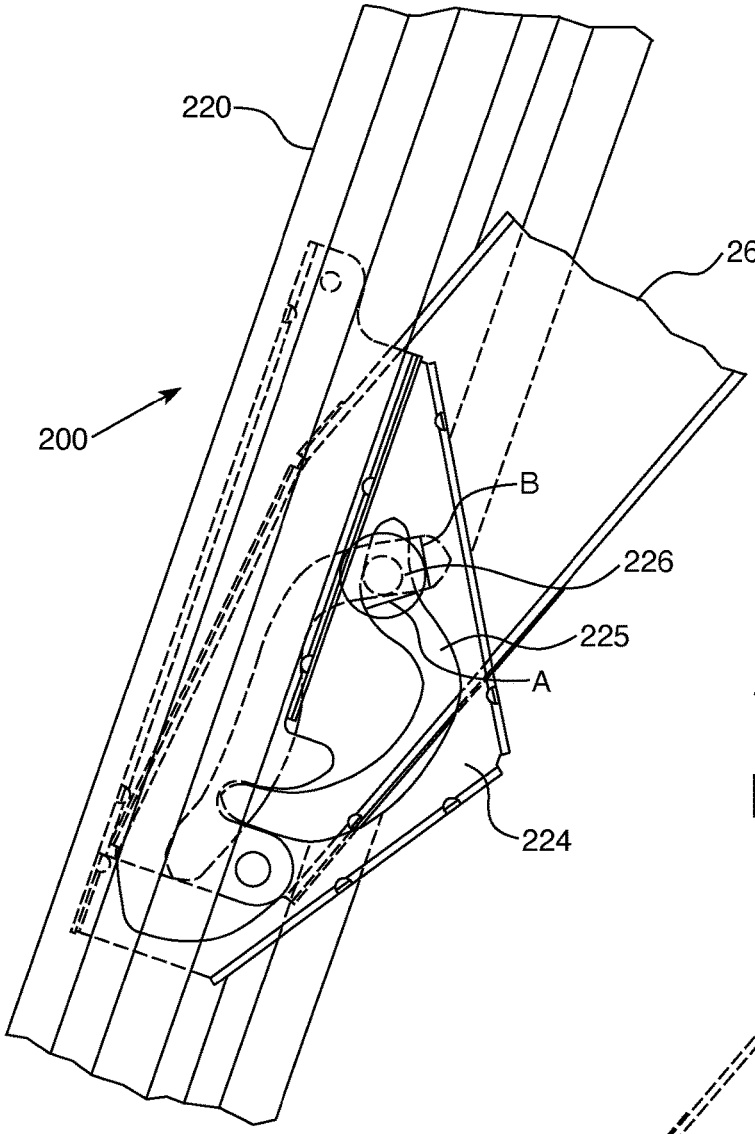
FIGS. 53A through 53C illustrate the interconnections and individual pieces of one embodiment of a corner post, corner post mount, and lower arm post slot of the present invention.
Figure 53B:
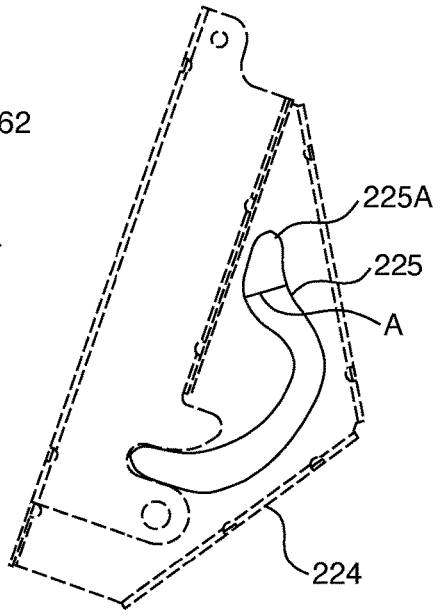
Figure 53C:
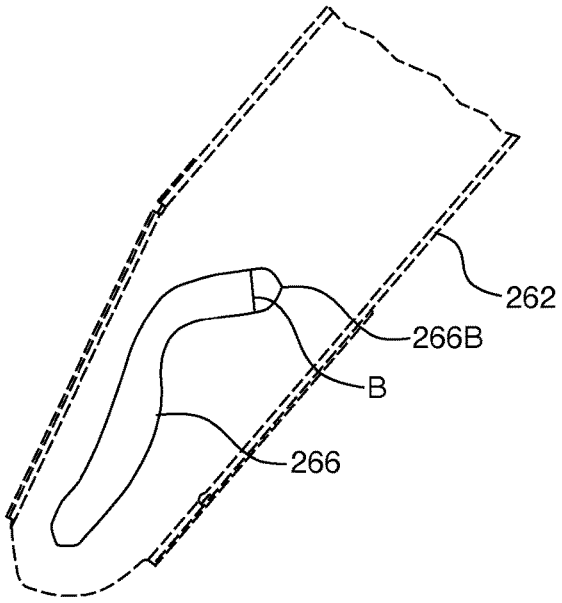
Figure 56:
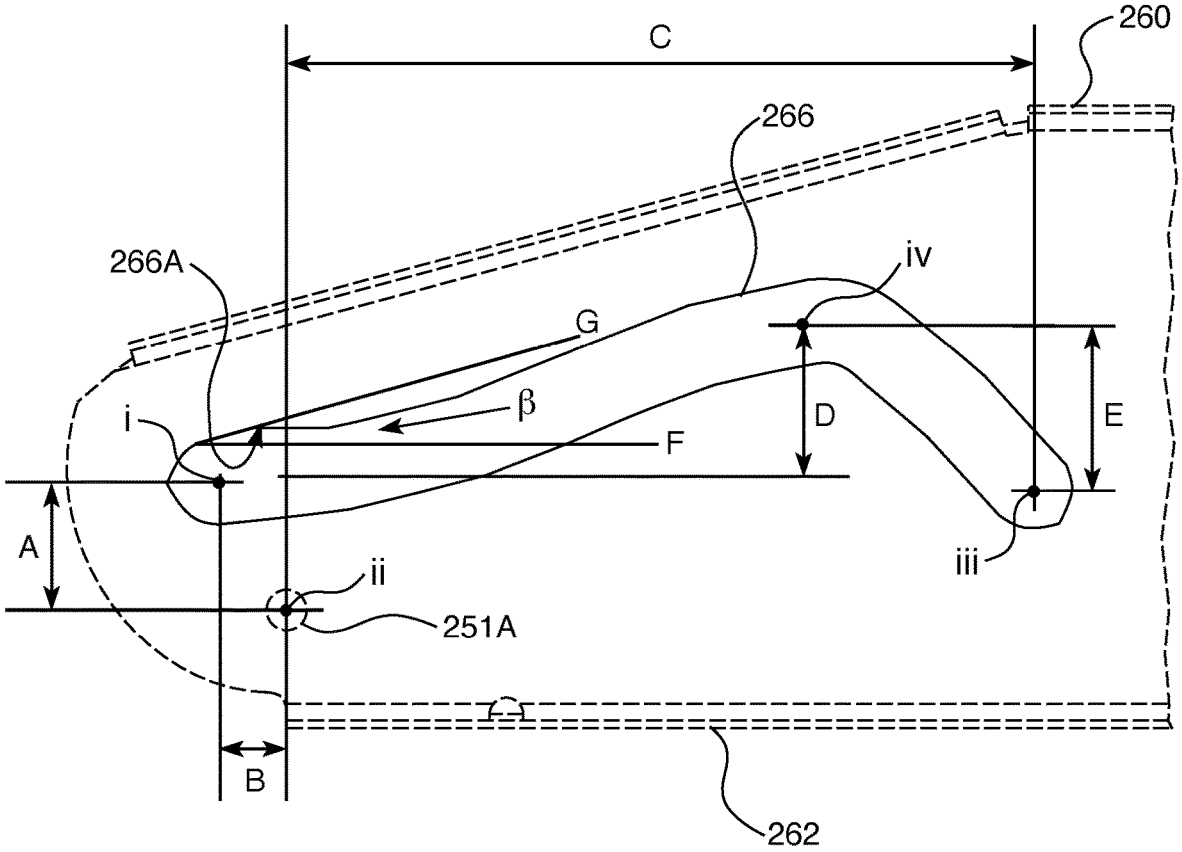
FIG. 56 illustrates the lower arm post slot of one embodiment of the present invention.

One embodiment of the present invention is a mechanical control assembly 200 for use with an opening and closing foldable structure 1000 having open and closed positions and, wherein the foldable structure 1000 comprises a frame 205 having a plurality of corner posts 220, each corner post 220 having a top 221 and a bottom 222, and a plurality of upper arms 210 each of which arms 210 connect (directly or indirectly) to the tops 221 of adjacent corner posts 220. The mechanical control assembly 200 comprises a hub centrally located near a bottom 1020 of the foldable structure 1000 in an open position and near a top 1010 of the foldable structure 1000 in a closed position. The hub 240 has a plurality of hub slots 242, one for each lower arm 260. A plurality of lower arms 260, each lower arm 260 having a hub end 261 with a lower arm hub slot 264 and a post end 262 with a lower arm post slot 266, connect at each lower arm post end 262 to the bottom 222 of one of the corner posts 220 and at each lower arm hub end 261 to the hub 240 at the hub slot 240. Additionally, a plurality of push rods 280, with each push rod 280 having a push rod corner end 282 and a push rod hub end 281, are each adjacent to a corresponding lower arm 260 and are each slidably connected at the push rod hub end 281 to the lower arm hub slot 264 in the corresponding lower arm hub end 261 (with the lower arm hub slot 264 as illustrated in FIG. 52A), and wherein each push rod corner end 282 is slidably connected to the lower arm post slot 266 in the corresponding lower arm post end 262 (with the lower arm post slot 266 as illustrated in FIGS. 53C and 56.) A plurality of pull rods 310, with each pull rod 310 having an upper end 311 and a lower end 312, and with each lower end 312 slidably connected to a corresponding lower arm post slot 266 and each pull rod upper end 311 pivotably attached to either at least one corresponding upper arm 210 or to at least one corresponding transfer link 340. Each transfer link 340 has a transfer link upper end 341 and a transfer link lower end 342. Each transfer link lower end 342 is pivotably attached to the upper end 311 of a corresponding pull rod 310 and each transfer link upper end 341 is pivotably attached to at least one corresponding upper arm 210. In this embodiment and as shown in FIG. 53A, each lower arm hub end 261 and the corresponding push rod hub end 281 also are slidably connected to one of the corresponding hub slots 242, with the hub slot 242 as illustrated in FIG. 52B. Additionally, each lower arm post end 262 and the corresponding pull rod lower end 312 are slidably mounted to a corner post mount slot 225 in the corresponding corner post bottom 222, with the corner post mount slot 225 as illustrated in FIG. 53B. The foldable structure 1000 thereby is enabled by the mechanical control system 200 from a closed to an open position by exertion of a downward push force by a user on the hub 240, which downward push force pushes each lower arm 260 and corresponding push rod 280 outward against each corresponding corner post 220 until each lower arm 260 and corresponding push rod 280 pull each pull rod 310 downward until the upper arms 210 each have a substantially horizontal position, as illustrated in FIG. 54.

Figure 50:
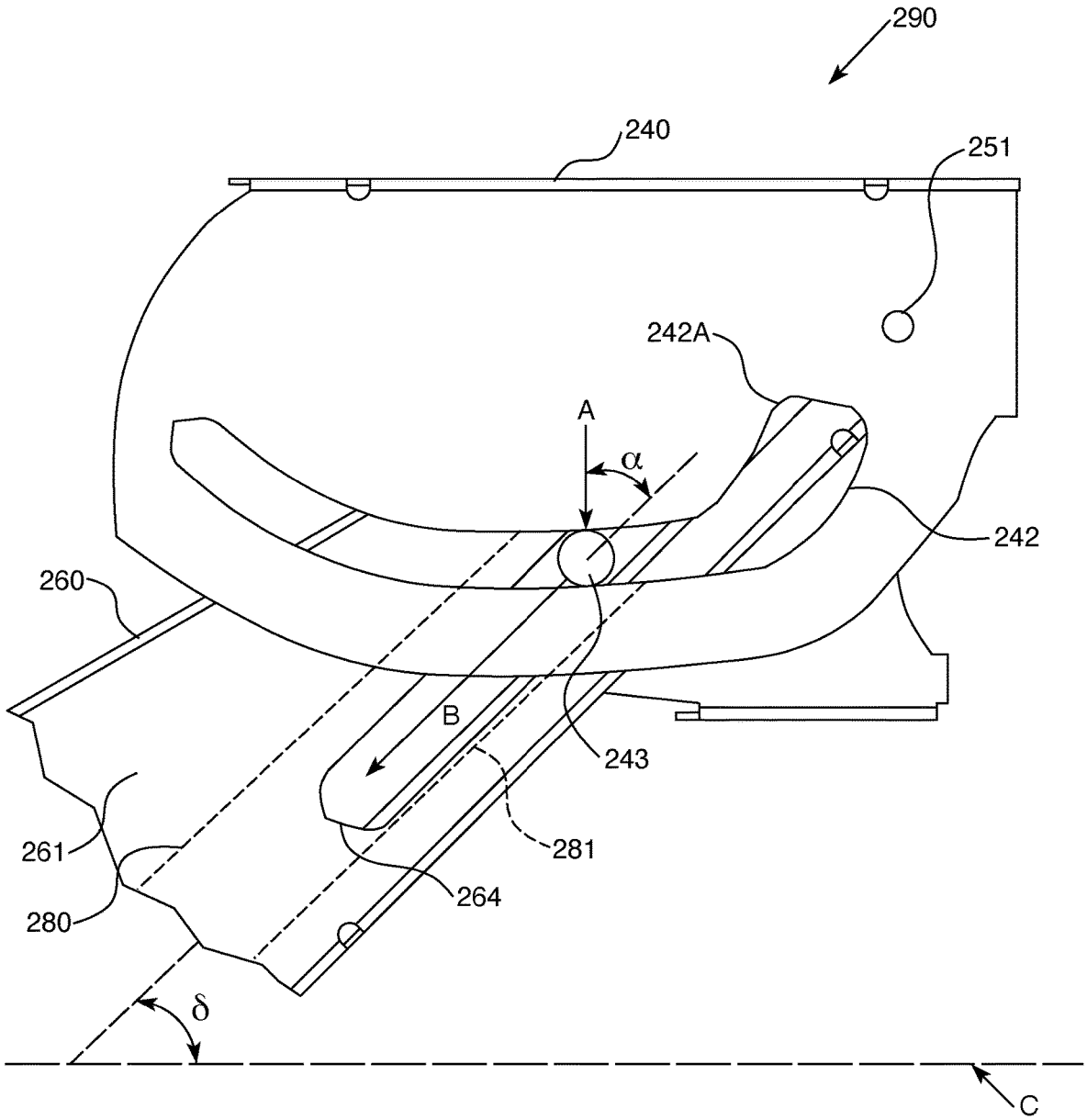
FIG. 50 illustrates a hub slot with a connected lower arm and pushrod according to one embodiment of the present invention.

In some embodiments of the present invention, mechanical control assembly 200 includes a sub-mechanical system 290 (one embodiment of which is shown in FIG. 50) that forces the pushrod 280 outward with respect to the hub 240 and is composed of a pivot 251, slots 242 and 264, and a cam roller 243. Slots 264 is formed, typically by cutting, into the lower arm 260 and the other slot 242 is formed into the hub 240. For this embodiment, the width of each slot 242 and 264 is at least as wide as the radius of the cam roller 243. Each of the lower arms 260 is mounted to the hub 240 at a pivot 251. As a lower arm 260 pivots with respect to the hub 240, the two slots 242 and 264 slidably engage and intersect each other at cam roller 243 (see FIGS. 50 and 52C).

More specifically, one embodiment of the mechanical control assembly 200 of the present invention, as illustrated in FIG. 50, is configured so that each lower arm 260 and corresponding push rod 280 are slidably attached by a shared cam roller 243, and configured whereby a push angle $\alpha$ is measured between the direction of a downward push force A and the outward travel path B of the cam roller 243 in the corresponding lower arm hub slot 264. In addition, an angle $\delta$ is measured between the diagonal orientation of the lower arm 260 and a horizontal line C that is parallel to the floor 2000, whereby, when angle $\delta$ is between about 35- and 50-degrees, the push angle $\alpha$ is between about 20- and 45-degrees, and, when angle $\delta$ is below about 30-degrees, push angle $\alpha$ is below about 55-degrees.

As the user pushes down on the hub 240, the hub 240 translates but does not rotate. Each lower arm 260, however, does rotate, from near vertical to near horizontal. As the user pushes down on the hub 240, the lower arm 260 rotates, and the top of the hub slot 242 presses down on the cam roller 243 and forces the cam roller 243 down the lower arm hub slot 264. Ideally the top of the hub slot 242 pushes directly down the path of the lower arm hub slot 264 so that all the force pushes in the direction of travel. Conversely, if the hub slot 264 pushes 90-degrees off from the direction of travel, then none of the force will go in the direction of travel, and the sub-mechanical system 290 will jam.

Some embodiments of the present invention are designed to avoid the expense of bearings in hub cam roller 243 and the corner post cam roller 226. These embodiments can be configured to either have bushings or to be solid fixed cylinders attached to each pushrod 280. For these embodiments of a play yard mechanical control assembly 200 to overcome the friction created the hub slot 242 and the lower arm hub slot 264 must be designed such that the direction of force is within approximately 45-degrees of alignment with the direction of travel, see FIG. 50 at angle $\alpha$. For greater angles, too much force is lost generating friction with the slot edges to supply to play yard 1 with enough force to lift its arms 210.

These force requirements are not necessary during the entire opening process. When the user starts to open the play yard 1, the user may pull the tops 221 of the posts 220 apart instead of initially pushing down on the hub 240. At the end of the opening process, the user has significant leverage because most of the user's weight can be easily transferred to the top of the hub 240 when it is low or closer to the ground or floor 2000. Thus, these force requirements only apply during the middle portion of the opening process (as shown generally in FIG. 57), and, more specifically, when the lower arms 260 are rotated between approximately 35-degrees from their folded state to within approximately 20-degrees of their opened state.

Control. When Posts Are Not Parallel. As mentioned in the Background of the Invention section, many existing play yard technologies require that the corner posts remain substantially parallel to a vertical axis during opening and closing. The opening and closing mechanisms of the prior art play yards are designed to maintain this positioning of the corner posts to counter the natural tendency for the posts to sway significantly side-to-side during opening and closing (racking). The designs of the prior art play yards require that the corner posts remain almost rigid and substantially parallel to a vertical axis to create a tension within those structures that is necessary to open the play yards and to maintain the stability of the play yards both when they are opening and when fully open. The structure of those play yards requires a larger number of parts to achieve that stability and tension, which contributes to the higher manufacturing expense and final product weight compared to the present invention. As an example, the '727 and '829 inventions (and related inventions) mentioned in the Background section utilize upper and lower leg assemblies that attach between corner posts and a central hub and form a parallelogram that acts to hold the corner posts in substantially vertical position—that is, where the deviation of the angle of the corner posts from vertical is no more than five-degrees (5°).

In contrast, the present invention utilizes various embodiments of a novel mechanical control assembly and/or system 200 in place of the upper and lower assemblies of the prior art. This assembly 200 operates to prevent the corner posts 220 from collapsing during the opening and closing of the play yard 1 and allows the corner posts 220 to tilt or flex inward and/or outward on a controlled basis during opening and closing. The mechanical control assembly 200 interacts with a central hub 240, each corner post 220, the lower arms 260, the push rods 280, the pull rods 310, and several cam slots, cutouts, and pivot points to transfer the opening and closing forces applied by the user to the play yard frame 205 in the manner described herein to create a tension and stability in the frame 205 during the opening and closing of the play yard 1—and that allows the corner posts 220 to flex beyond being substantially parallel to a vertical axis. The structure and mechanisms used to achieve this operation and motion in the present invention require significantly fewer parts than the prior art structures. Embodiments of the present invention mechanical control assembly and system 200 can be configured to work with corner posts 220 that, in some embodiments, are between about 6-degrees and more than about 12-degrees from vertical, which, in a highly calibrated structure like a play yard 1, is significantly beyond substantially parallel. On other embodiments, this range expands to between about 6-degrees and more than about 12-degrees from vertical, as shown generally in FIG. 48, with the referenced angle being measured between the degree of tilt of corner post 220 from an initial vertical orientation.

Solution to the User Pressing Tops Together When Closing. Product misuse is extremely common with play yards. In the case of most play yards, users may try to force the play yard either open or closed by manipulating the corner posts instead of by pushing the down on the hub down or by pulling the hub. Play yards should be designed to continue to operate properly after such misuse.

When closing a play yard 1 that incorporates certain embodiments of the mechanical control assembly 200 of the present invention, it is easy for the user to partially close the play yard 1 by pulling up on the hub 240, then gathering the post tops 221 together to force the assembly 200 to the folded or closed state. If the feet 400 or post bottoms 224 are on carpet when this occurs and are prevented from moving towards the center or hub 240 by the carpet, then the cam path control systems 200 and 290 are forced into an unintended state. Furthermore, the user has significant leverage. This leverage occurs because, when a user is pressing the tops 221 of the posts 220 towards each other, there is a pivotal attachment axis near the bottom of each post 220 where the post 220 is attached to a lower arm 260 and a place about 3-inches from that pivot where the corner post cam roller 226 is held within the slots 225 and 266. As such, when the user pushes the post tops 221 together, the user has a 10:1 mechanical advantage because of the ratio between an approximate 30-inch arm and the 3-inch distance of the corner post cam roller 226 from the pivot location. As described below, certain embodiments of the play yard mechanical control assembly 200 allows the pushrod 280 to find a neutral position when this occurs to avoid system 200 failure.

To address this problem, in certain embodiments of the play yard mechanical control assembly 200 of the present invention, there are enlarged widths and other adaptive areas to the various cam slots illustrated in FIGS. 51A through 53C. The hub slot 242 has an enlarged width 242A (see FIG. 52B at Distance A, which is the width at that point of the inner terminal end of the hub slot 242). The corner post mount slot 225 has an enlarged width 225A (see FIGS. 53A and 53B at Distance A). The lower diagonal arm hub slot 264 has an adapted end 264A (see FIG. 52A).

Figure 51A:
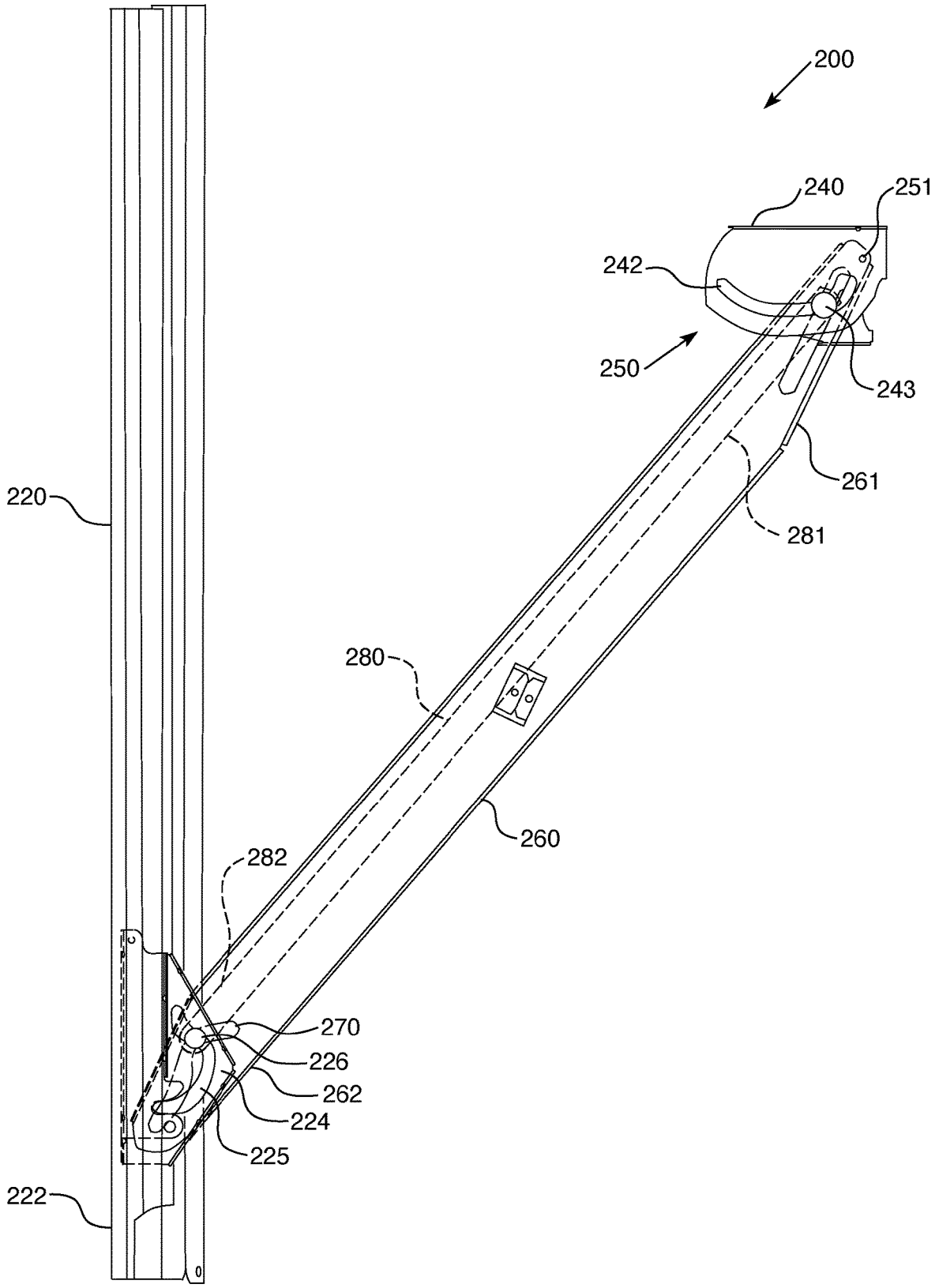
FIGS. 51A and 51B illustrate one embodiment of a connected corner post, lower arm, pushrod, and hub according to the present invention.
Figure 51B:
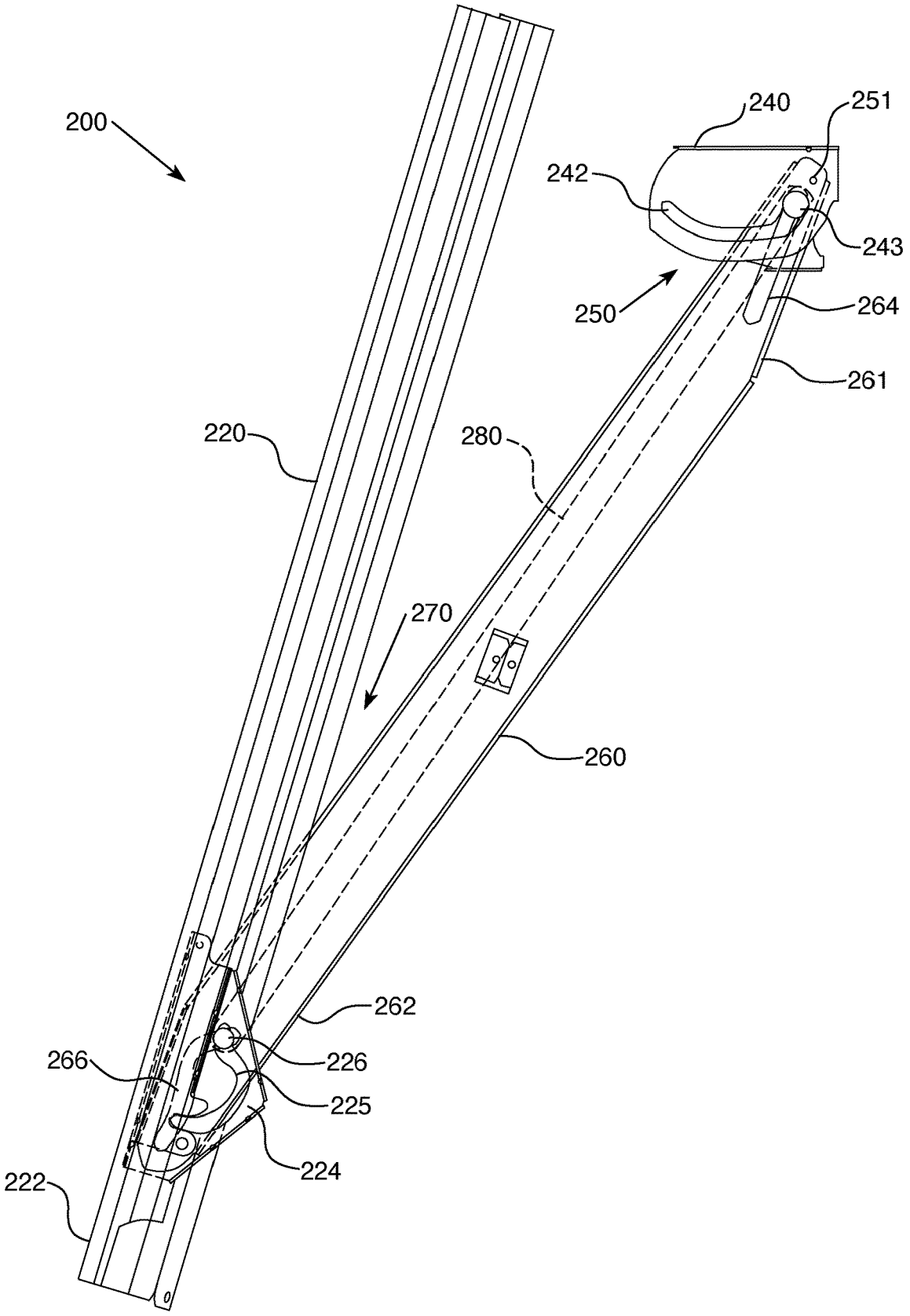

FIGS. 51A and 51B illustrate a corner post 220 and an attached lower diagonal arm 260. In FIG. 51A, the corner post 220 and attached lower diagonal 260 are partially folded (the lower diagonal arm 260 is about 45-degrees up from the floor or horizontal as shown by the angle δ in FIG. 50). FIG. 51B shows the same corner post 220 and lower diagonal arm 260 with the top 221 of the post 220 pushed towards the hub 240.

There is an enlarged width 242A in the hub cam slot 242 creates a shape of slot 242 that allows the movement of cam roller 243 to occur without bending the metal around slot 242. This is shown in more detail in FIG. 52B and at Distance A. The shape of the hub cam slot 242 enables the cam roller 243 to be forced up in the slot 242 without damaging the metal into which the slot 242 is formed.

Similarly, in certain embodiments of the present invention play yard mechanical control assembly 200, there are adaptive areas, including enlarged widths, such as in the upper terminal end 225A of the corner post mount slot 225 (see FIG. 53B at Distance A) and the inner terminal end 266B of the lower diagonal arm post slot 266 (see FIG. 53C at Distance B) that likewise prevent damage and bending while slots 225 and 266 move about corner post cam roller 226. These are illustrated in detail in FIGS. 53A through 53C and FIG. 56. These enlarged widths shown in FIGS. 53A through 53C enable the corner post cam roller 226 to move to the position illustrated in FIG. 53A when the post tops 221 are forced together while the post bottoms 222 are still spread apart. This is not an ideal position for any play yard; however, the illustrated expanded widths prevent metal in the various slots are formed from failing due to the forces that exist in this situation.

Wedge to Achieve Rigid Final Open Position. Any play yard must reach a rigid open state such that there is no looseness to the device that could allow a child to attempt to break or exit the safe space of the play yard. For play yards that incorporate the mechanical control assembly 200 of the present invention, this lack of looseness is achieved by configuring the play yard structure 1 so that the upper arms 210 are prevented from rotating up above horizontal. There are many ways to accomplish this known in the field. In one embodiment of the present invention mechanical control assembly 200, pull rods 310 pull down the back of the upper arms 210, near where the upper arms 210 meet the corner post tops 221, thereby forcing the upper arms 210 up until they 210 reach a predesignated stopping point. In this embodiment, a tension level of at least 50-pounds must pull the pull rods 310 down so that the middle arm structure 38, which has a 13:1 leverage advantage over the pull rod 310 attachment point behind the upper arms 210, pulls sufficiently hard to stiffen the upper arms 210 and resist any attempt to pull upper arms 210 down. The middle arm structure 38 (labelled in FIGS. 49B, 54, and 57) is a link between two long upper arms 210 that is approximately 3-inches long in most, but not all, embodiments and provides a safety function for play yards 1. Without a middle arm structure 38, the two upper arms 210 potentially could trap a child's head or neck if the child or other user managed to get the upper arms 210 to drop. The middle arm structure 38 creates an approximately two-inch gap between the folded upper arms 210 and thereby eliminates this risk of harm. The middle arm structure 38 is similar in structure and configuration to the upper arm joint member 34 shown in FIGS. 1 through 48.

When the play yard 1 is nearly open, the posts 220 are not yet vertical because the lower arms 260 are still extending outwards while the hub 240 goes down. As the posts 220 approach vertical, the angle of joint 230 with respect to the upper arms 210 increases (see FIG. 54 at angle F). As a result, the pull rods 310 must continue to pull down as the play yard 1 approaches a fully open state. To achieve this result, the angle R of the path in the cam slot 266, that is the cam path, for this last about 5-degrees of change of angle R for the lower arms 260 must be between about 1- and 5-degrees, as shown in FIG. 56, and as the corner post cam roller 226 moves about a half-inch outboard jamming the pull rod 310. In FIG. 56, if the angle R of the cam path of cam slot 266 is less than about 1-degree, the assembly 200 will not pull down enough to keep sufficient tension in the corner post-upper arm joint 230 to provide the required tension. If the angle R of cam slot 266 is greater than about 5-degrees, the assembly 200 could back drive, whereby pushing down hard enough on the upper arms 210 could cause the play yard 1 to begin to fold. More specifically, as shown in FIG. 56, angle 3, as measured between horizontal line F and the slope G of the inner side 266A of lower arm post slot 266, ranges between about 1 to 5 degrees when the foldable structure 1000 is fully opened.

This aspect of this embodiment of the present invention is illustrated in FIG. 54. When the hub 240 is pushed down (FIG. 54 at A), then each lower arm 260 moves towards a horizontal orientation (FIG. 54 at B), and each corner post 220 moves towards a vertical orientation (FIG. 54 at G). During this movement, each upper arm 210 is being pulled to a horizontal orientation (FIG. 54 at D) and the angle at the corner post-upper arm joint 230 is increasing (see generally, FIG. 54 at F and 230).

Figure 55A:
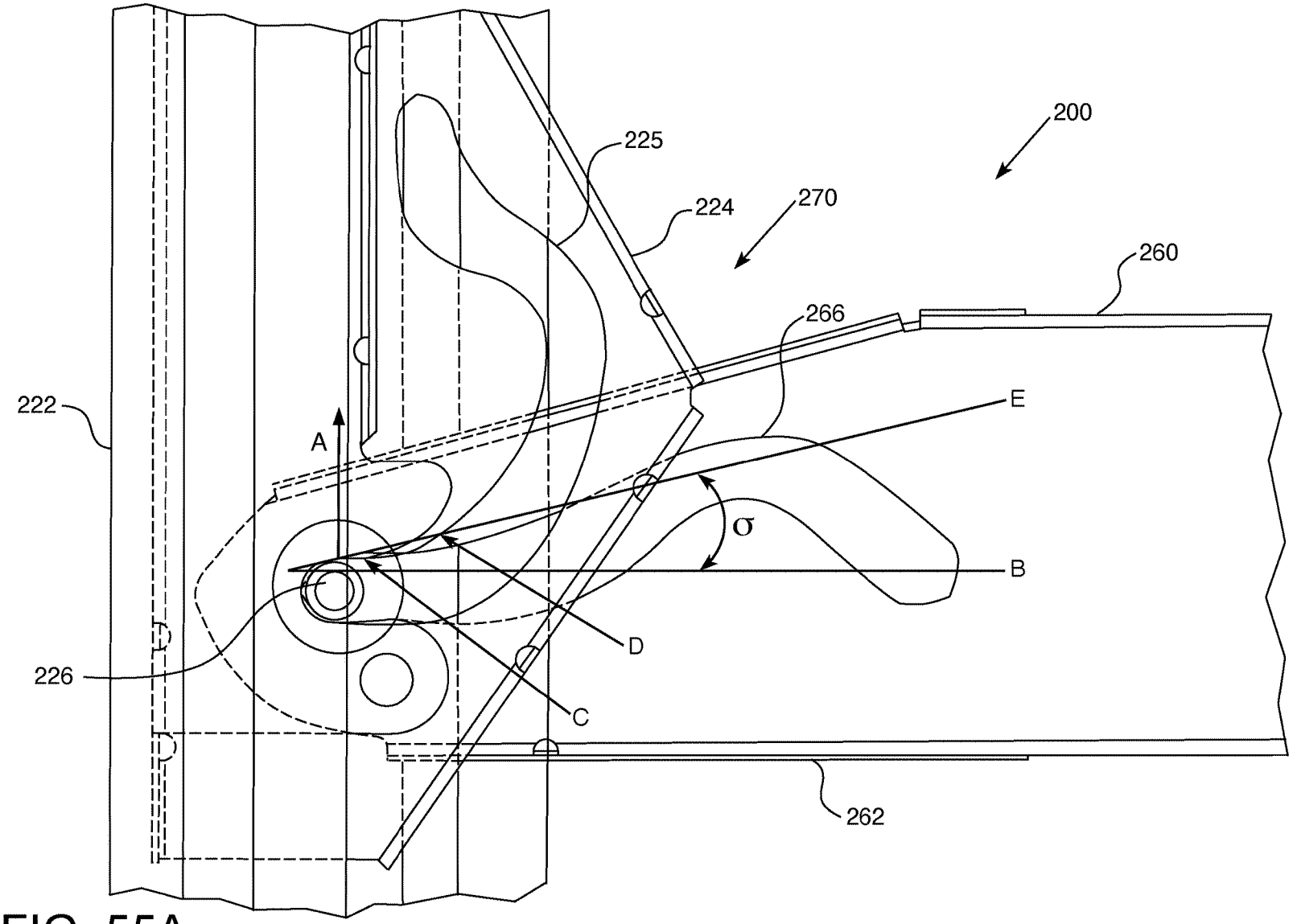
FIGS. 55A and 55B illustrate the interconnected slots in the corner post bottom and the lower arm post end according to one embodiment of the present invention.
Figure 55B:
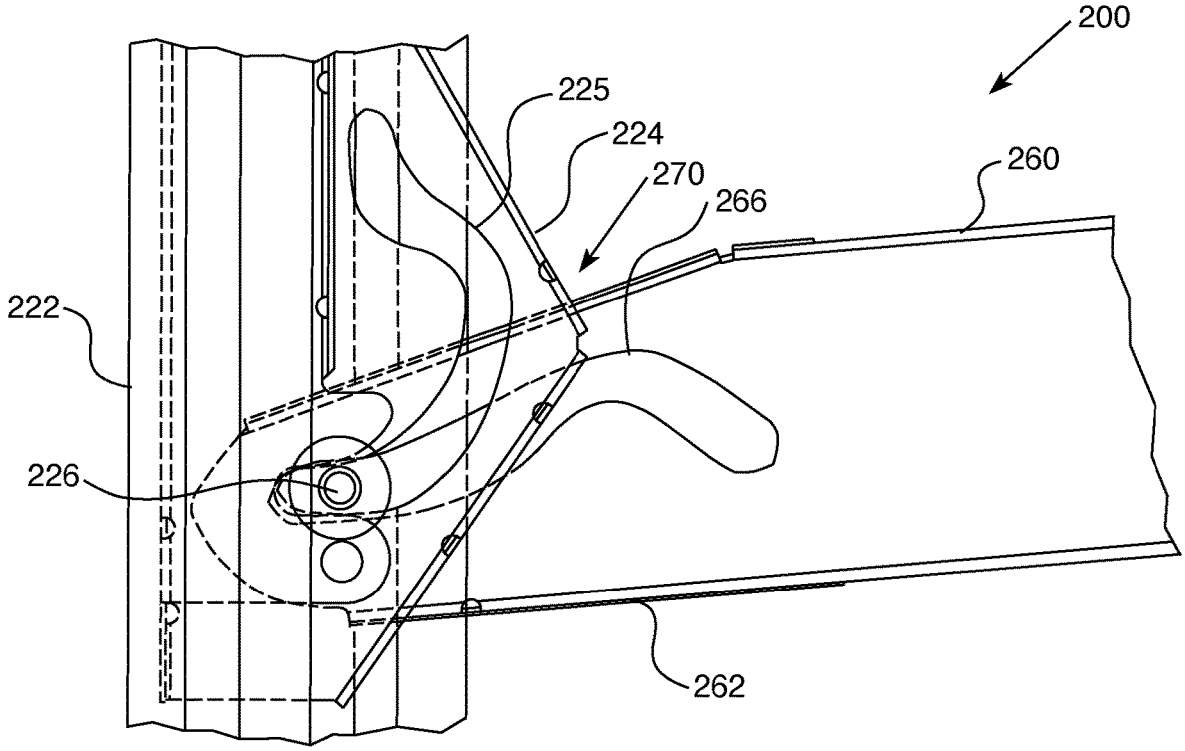
Figure 65:
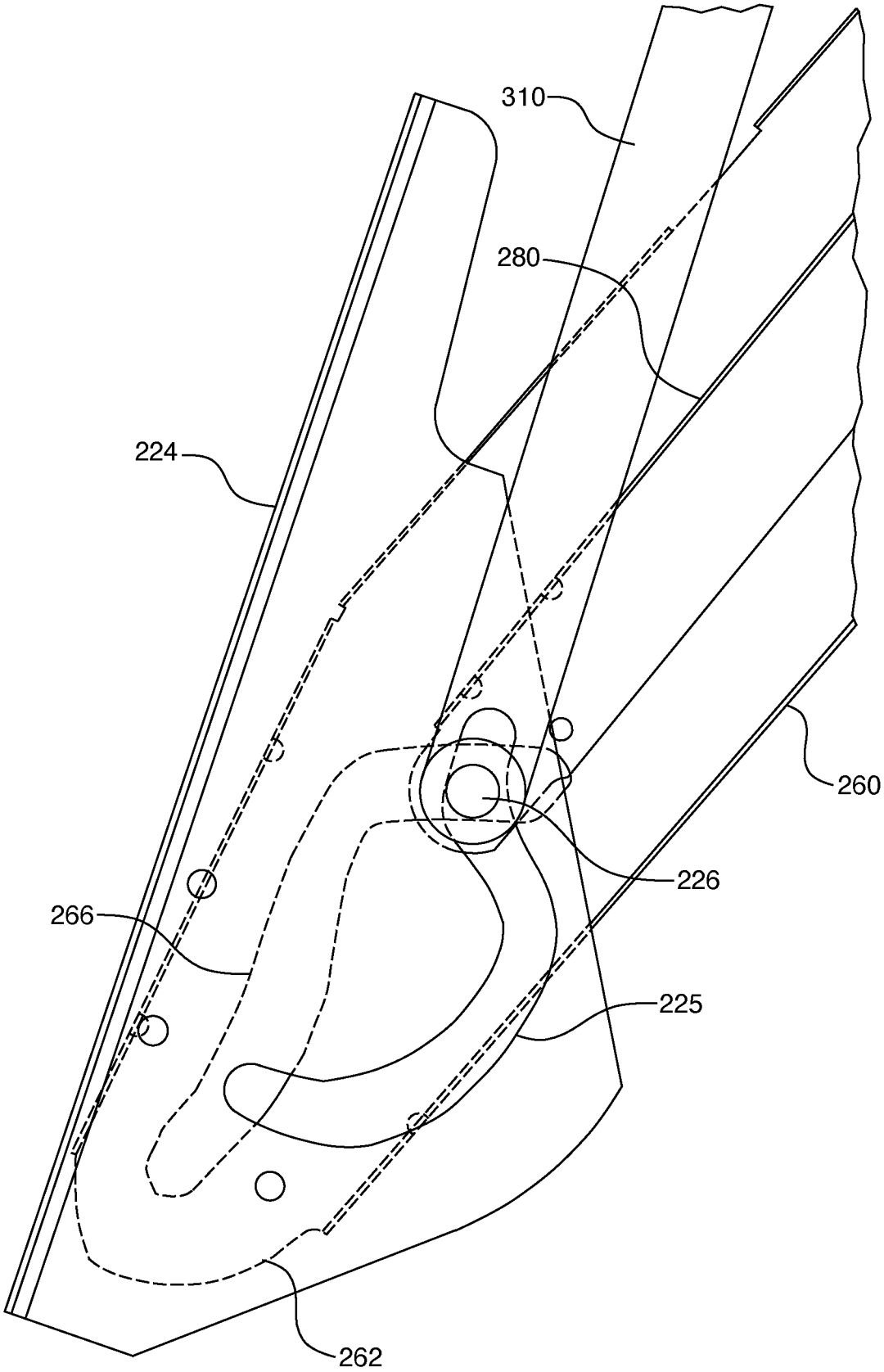
FIG. 65 illustrates the cam slots and interactions between one embodiment of a corner post bottom and one embodiment of a lower arm post end.

FIGS. 55A and 55B illustrate the additional aspects of one embodiment of the present invention mechanical control assembly 200 that achieve the needed tension in the open position while preventing a user from forcing the play yard 1 to start closing by pushing down on the upper arms 210. First, the movement of the lower arm cam slots 266 with respect to corner post cam roller 226 in each lower arm 260 does not provide a downward load on the pull rods 310 (shown more clearly in FIG. 57). The angle $\alpha$ of the post mount slot 225 shown in FIG. 55A in one embodiment should be about 1- to 5-degrees up and to the right of horizontal. More specifically, as shown in FIG. 55A, the post mount slot 225 to the left of line A must be tilted up and to the right by 1- to 5-degrees from the horizontal B. The angle $\alpha$ is this angle between the identified portion of the post mount slot 225 (suggested by line E) and the horizontal (line B) in FIG. 55A. The section of the post mount cam path 225 highlighted between lines C and D of FIG. 55A must load the pull rods 310 with 50-pounds of force in the open state. In FIG. 55A, angle $\alpha$ is shown as being greater than the discussed 1- to 5-degrees from the horizontal B. Additionally in FIG. 55A, line E shows the approximate location of the upper side of angle $\sigma$ for ease of identifying the angle. Angle $\sigma$ in FIG. 55A is enlarged to show the location and orientation of the angle, not the exact dimensions of it. Finally, the interaction between the corner post cam roller 226 and cam slot 225 in the post mount 224 must pull the pull rods 310 down with approximately 50-pounds of force in an open state (see FIG. 65).

Anti-Racking CAM Path. In one embodiment of the play yard mechanical control assembly 200 of the present invention, the cam paths embodied by the lower arm post slots 266 are configured to avoid racking in the play yard 1. Racking is where the corner posts of a play yard all sway in essentially the same direction. Traditional play yard designs tend to rack because gravity pulls the corner posts down to the ground. The same is true for corner posts twisting about the central vertical axis of the play yard which is really a 3-D extension of "racking". The two dimensions on the left (A and B) in FIG. 56 are the most critical. Distance A in FIG. 56 (the vertical distance between points i and ii) should be about ¼" to ¾" in this embodiment of the present invention. Distance B in FIG. 56 (the horizontal distance between points i and ii) should be about ⅛" to ¾" in the preferred embodiment. The dimensions to the right of the pivot 251A are also important. These are shown in FIG. 56 and are as follows: Distance C (the horizontal distance between points i and iii) should be at least 1/25", Distance D (the vertical distance between points i and iv) should rise about ¼" to 1¼", and Distance E (the vertical distance between points iii and iv) must drop at least ¼". While a play yard 1 according to the present invention can be configured to have dimensions beyond these limits, the dimensions specified in connect with FIG. 56 result in one embodiment of the present invention play yard 1 that resists racking.

More specifically, one embodiment of a mechanical control assembly 200 has a lower arm post slot as illustrated in FIG. 56. As shown in FIG. 56, the vertical distance A, measured between center point i at the inner terminal end of the lower arm post slot 266 and the center point ii of pivot cut-out 251A, is between about 0.25 and 0.75 inches. Additionally, the horizontal distance B in FIG. 56 measured between center point i at the inner terminal end of the lower arm post slot 266 and the center point ii of the pivot cut-out 251A, is between about 0.125 and 0.75 inches. In FIG. 56, the horizontal distance C, measured between the center point ii of pivot cut-out 251A and center point iii at the outer terminal end of the lower arm post slot 266 is at least about 1.25 inches. The vertical distance D, measured between the center point i and the highest center point iv of the lower arm post slot 266, is about 0.25 to 1.25. Finally, the vertical distance E, measured between the center point iii at the outer terminal end of the lower arm post slot 266 and the highest center point iv of the lower arm post slot 266, is at least about 25 inches greater than distance D.

Spread of the Bottom of the Corner Posts. To begin opening the play yard 1 of the present invention in one embodiment, the user pulls two opposing corner posts 220 apart. This can be facilitated in one embodiment by attaching optional straps or similar pull structures to two opposing corner posts 220 for the user to hold onto while pulling. These straps can be conveniently located on the tops 221 of the posts 220. If there were no cam linkage system (or equivalent mechanism) the only part of the posts 220 that would move apart would be the tops 221 because only tops 221 are being pulled. Similarly, the bottoms 222 of the posts 220 would stay stuck to the floor 2000 near the hub 240 where they are located when the play yard 1 is in the closed position. Additionally, if only the post tops 221 are moved, the user would not be able to push the hub 240 down after spreading the post tops 221 because the lower arms 260 would still be pointing substantially toward the ground or floor 2000 and would generate no side forces to spread apart the lower arms 260.

Figure 57:
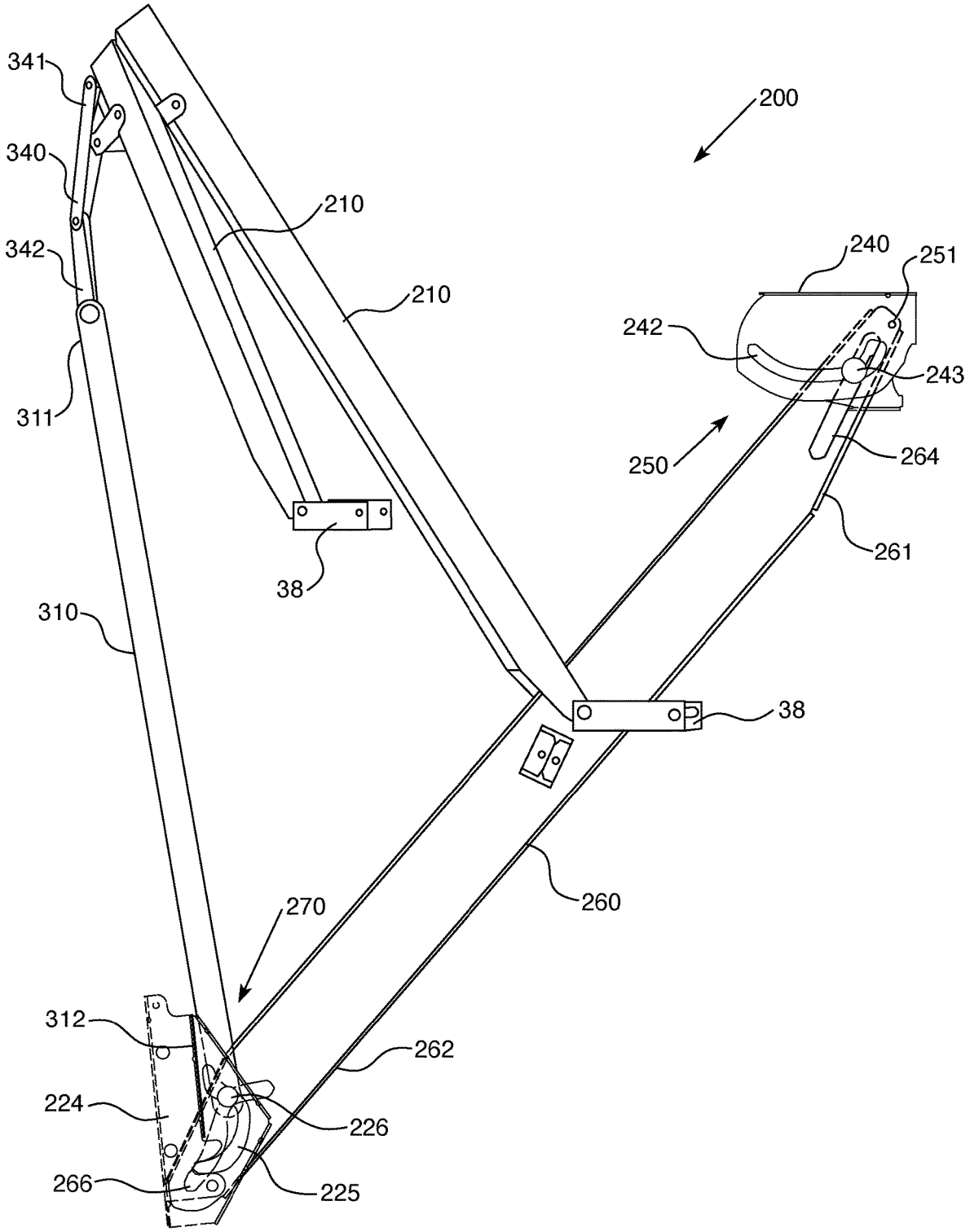
FIG. 57 illustrates the interconnected movement of two upper arms, a corner post, a lower arm, a hub slot, and a transfer link according to one embodiment of the present invention.

The mechanical control assembly 200 controls the position and tilt of each corner post 220 as opening occurs through the positioning of each pushrod 280 at the hub 240 (each pushrod 280 having a hub end 281 and a corner end 282). This positioning controls the pushrod corner end 282 to create the proper position and tilt between the corner post mount slot 225 and the lower diagonal arm post slot 266. This configuration is illustrated in FIG. 57. Positioning the hub slot 242 against the lower arm hub slot 264 forces the pushrod 280 at its hub end 281 into a position which is mechanically transmitted to the pushrod corner end 282 because pushrod 280 has a rigid structure.

The positioning of the corner post mount slot 225 and the lower arm post slot 266 is configured such that the lower arm-post joint 270 is less than about 15-degrees to vertical when the corner post tops 221 are about 30-inches or more apart so that the second stage of opening, pushing the hub 240 down, works properly (see generally FIGS. 54 and 57 at G and 270).

Novel Play Yard Feet 400

Play yard feet can be designed to serve a variety of purposes. Ideally, a play yard foot stabilizes an open play yard so that it resists sliding, facilitates the movement of an empty play yard from one location to another, and facilitates the opening and closing of the play yard. Users prefer having wheels on the bottom of the play yard to enable the play yard to roll or be easily moved. Additionally, the mechanical control system 200, which is responsible for guiding the joint movements in the play yard during opening and closing, requires that the feet travel diagonally outwards when the play yard is opening and closing. Therefore, there is a need for a novel play yard foot that facilitates these goals. Specifically, current play yards do not have the control system 200 of the present invention and, instead, are simply a collection of many tubes loosely connected by pivots. The existing play yards do not have a controlled diagonal movement. Without this controlled movement, wheels on the feet of a traditional play yard can guide the feet on a path that is not diagonal and thereby interfere with opening and closing operation of the play yard by, for example, bending the post 220 sideways towards each other or otherwise breaking the frame 205.

Figure 61:
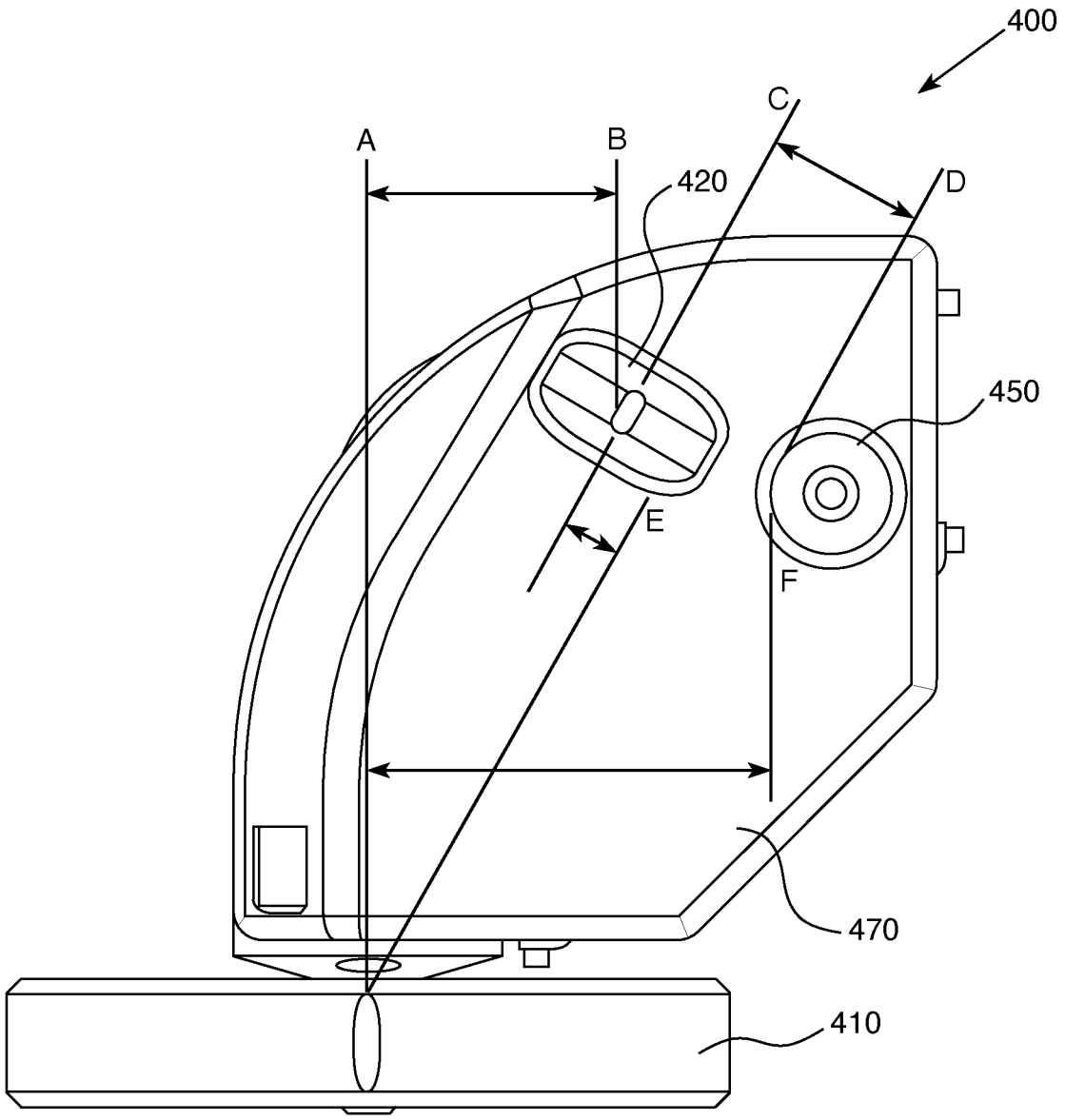
FIG. 61 shows the bottom of one embodiment of a play yard foot according to the present invention.
Figure 62A:
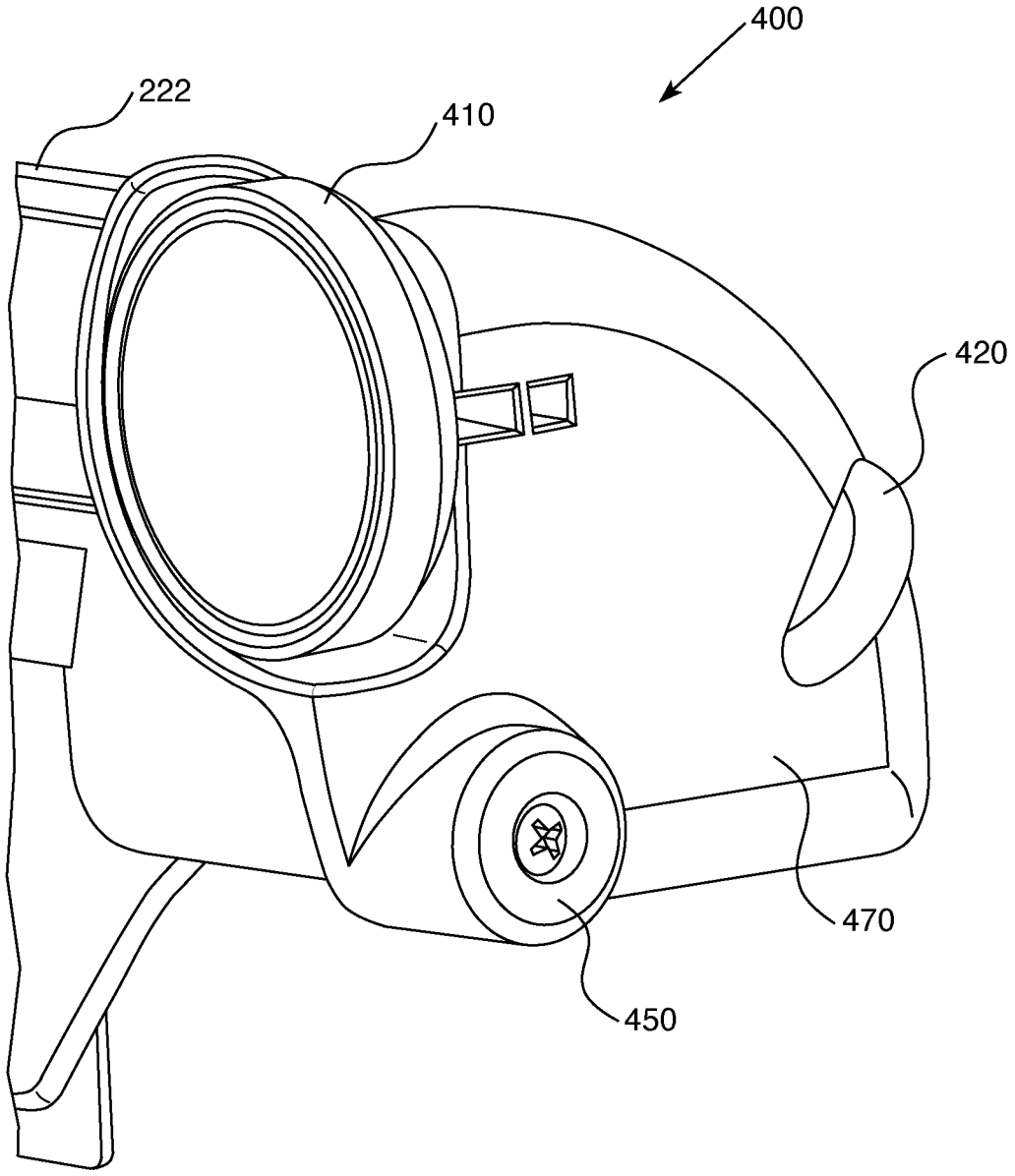
FIGS. 62A and 62B show two views of an alternative embodiment of a play yard foot according to the present invention.
Figure 62B:
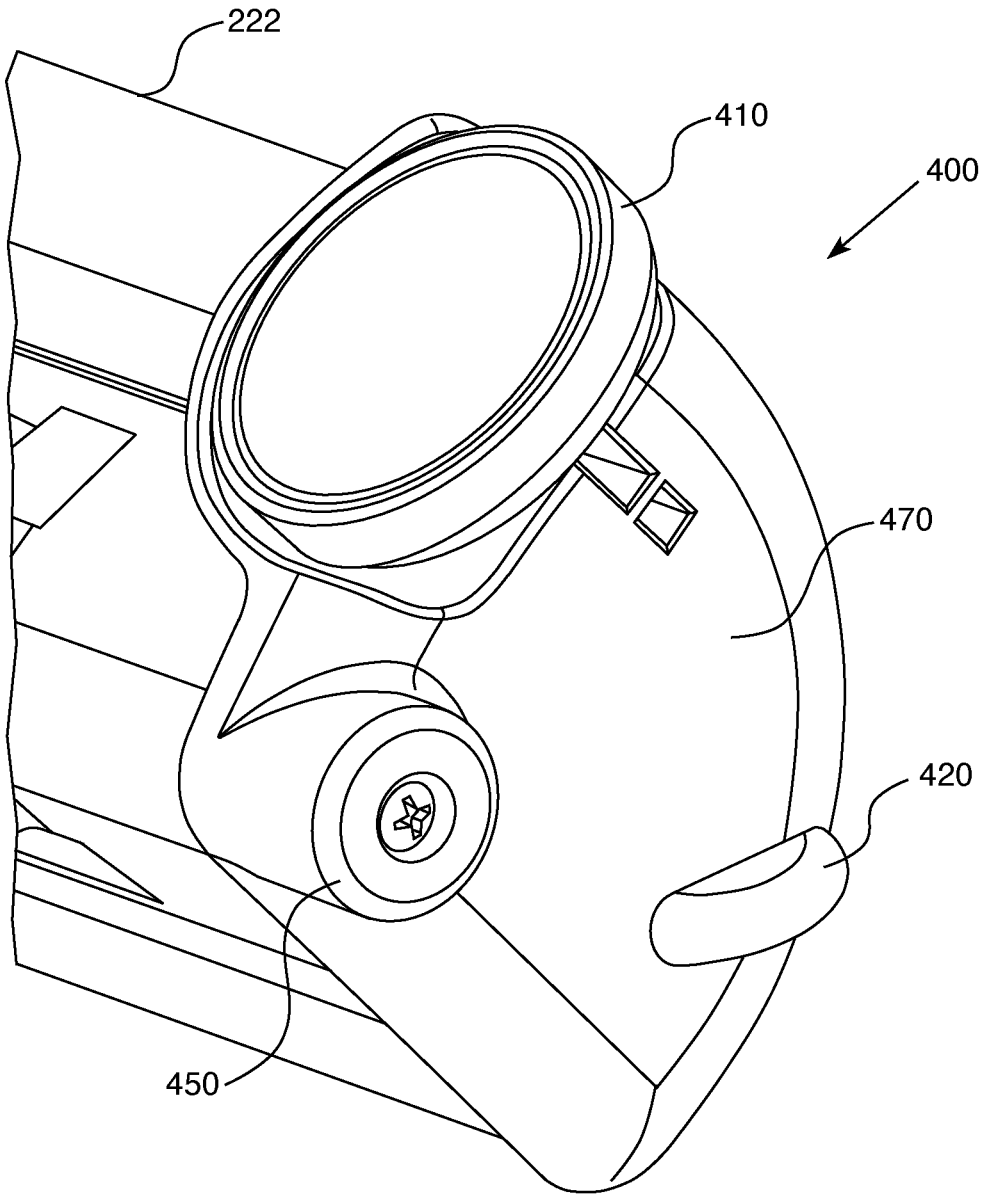
Figure 63:
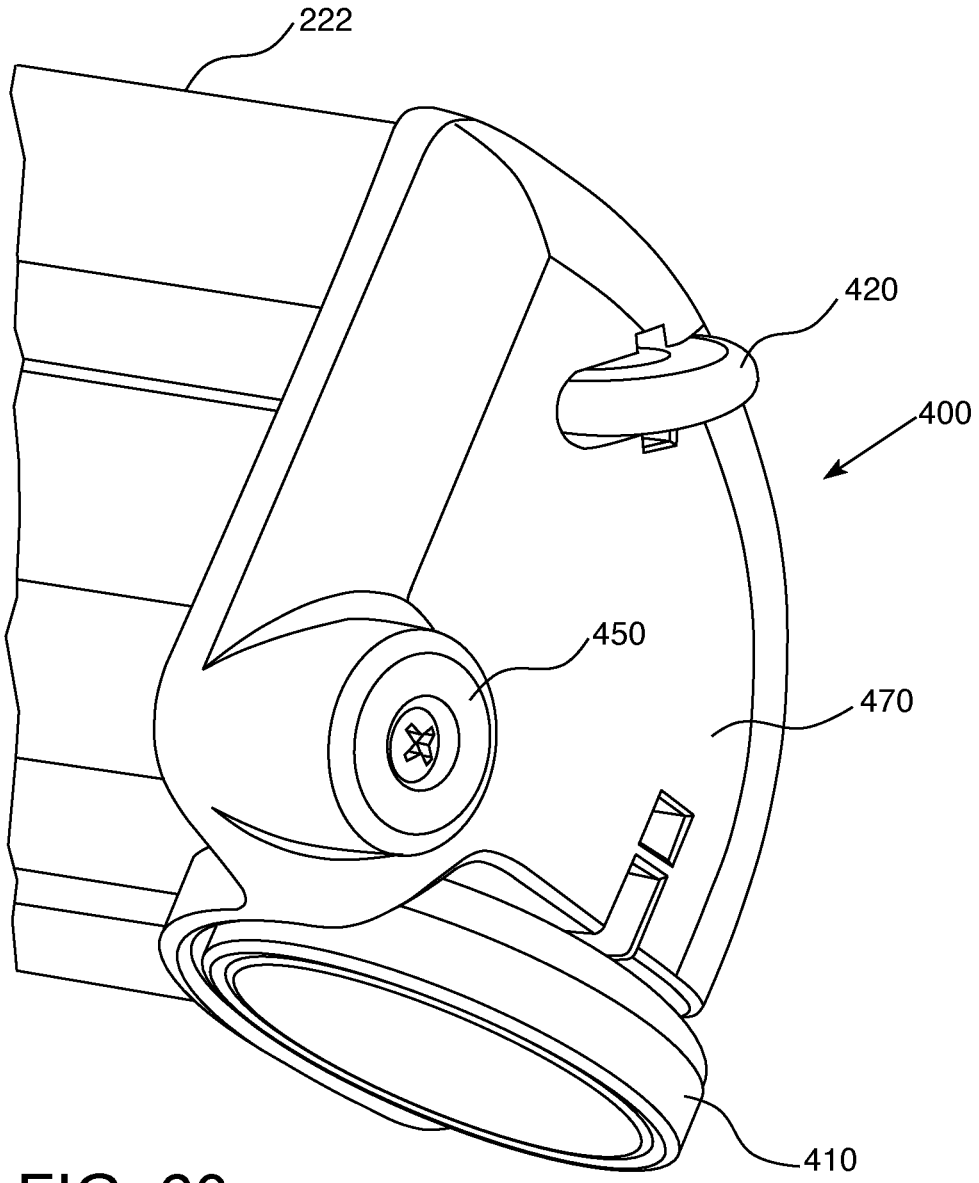
FIG. 63 shows another embodiment of a play yard foot according to the present invention.

Certain embodiments of the present invention includes a novel play yard foot 400 that accomplishes these three goals. One embodiment of a foot 400 for a play yard according to the present invention is configured for use with a play yard 1 having a plurality of corner posts 220, with each corner post 220 having a top 221 and a bottom 222, whereby foot 400 connects at or near to the bottom 222 of the corner post 220 and is operable to rest on a floor surface 2000. One embodiment of foot 400 (shown in FIG. 63) comprises: (i) a bottom surface 470 of foot 400 that faces the floor surface 2000; (ii) a wheel 420 that protrudes through the bottom surface 470 and that engages during the opening and closing of the foldable structure 1000; and (iii) a non-slip rest 450 located on the bottom surface 470. An alternative embodiment of foot 400 also comprises at least one in-line wheel 410, which is located in alignment with a corner post 220. FIG. 61 shows one embodiment of foot 400 according to one embodiment of the present invention. FIGS. 62A and 62B show different views of an alternative embodiment of foot 400. FIG. 63 is an alternative view of foot 400 shown in FIGS. 62A and 62B.

The various embodiments of feet 400 enhance the movement of the various foldable structures 1000 described herein. First, there is a non-slip rest 450 (preferably made of rubber) that protrudes downward when the play yard 1 is fully opened and that prevents the play yard 1 from easily sliding on the floor 2000 when in use. The non-slip rest 450 also can be configured to protect wood or other flooring material that could be scratched by a plastic, metal or other sharp foot material. As shown in FIG. 61, a non-slip rest 450 is shown on the bottom surface 470 of the play yard foot 400. Additionally, as shown in FIG. 61, there is a diagonal wheel or slider 420. Finally, as shown in FIGS. 61 through 63, there are one or more in-line wheels 410 on each corner post bottom 222. In-line wheels 410 facilitate moving an open play yard 1. In one embodiment, a play yard 1 has two feet 400 on two adjacent corner posts 200. The feet are oriented so that the in-line wheels 410 are aligned in a parallel direction to each other and perpendicular to the plane formed by the two adjacent corner posts 220. Having at least two feet 400 on the bottom of two adjacent corner posts 200 and each parallel to one of the upper arms 210, enables a user to role an open play yard 1 across the floor. Functionally, this works in one of two ways. First, a user can lift the side of the play yard opposite the side with two feet 40 so that the feet 400 make contact with the floor 2000 and the play yard 1 can be rolled to a new location. Alternatively, the user could push down on the side of the play yard 1 that has the two feet 400 to push the feet 400 into contact with the floor 200 (and lift the side without feet 400) and then roll the play yard 1 to a new location. In some embodiments, every corner post 200 ends in a foot 400 having an in-line wheel 410.

The three features of play yard feet 400 are able to operate, without interfering with each other, by taking advantage of different tilt angles of the corner posts 220. Specifically, in one embodiment, when the corner posts 220 are vertical in the open state, the rests 450 are approximately 0.08" below all other features at bottom surface 470 of the play yard foot 400, including the in-line wheels 410 bottom surface 470 of the play yard foot 400 and the diagonal wheel 420. The third system, i.e., the diagonal wheels 420, which guide the corner posts 220 outboard diagonally, touch the ground or floor surface 2000 below the other two systems when the corner posts 220 are tilted outboard greater than about 8-degrees during opening.

To achieve these functional three features in one play yard foot 400, each foot 400 is configured according to the following principles and parameters in one preferred embodiment, which are illustrated in FIGS. 61 through 63. In one embodiment of foot 400, the distance between lines A and B in FIG. 61 should be greater than or equal to about 1-inch. The distance between lines C and D in FIG. 61 should be greater than or equal to about 1-inch. The distance between lines C and E should be greater than or equal to about 0.5-inches. The distance between lines A and F should be greater than or equal to about 1.5-inches.

Sheet Metal Play Yard

It will be obvious to one skilled in the art that the various embodiments of play yards 1 of the present invention can be made from a variety of materials. Currently, many prior art play yards use metal tubing for at least the upper arms, corner posts and side rails. Those tubes are then compressed into the corners. Many existing play yards are made from standard welded steel or extruded aluminum tubes for their construction. This results in wall thickness that is too high and gives the overall play yard additional weight that can make it difficult for some users to carry, move, open or close traditional play yards.

Building upon the discussion of play yard regulations and the laws of physics detailed in the Background section, the concept of "moment of inertia" states that tube bending and buckling strength is always proportional to the radius squared. To determine the stress on a beam, such as the lower arm 260, one needs to know a beam's moment of inertia, I. The typical rectangular beam formula for I is:

$$I = (b \times d\text{^}3)/12$$

where b is the beam width and d is the beam height.

Again, the maximum stress for a rectangular beam is given by:

$$\sigma = M \times c/I = M \times c/((b \times d\text{^}3)/12)$$

Maximum stress is reduced by increasing the height of the beam to the cubed power where increasing the width only reduces the stress proportionally. As such, if one cuts the width in half, but doubles the height, the total amount of material stays the same but stress is reduced by a factor of 4.

When the beam is hollow as in the case of a play yard's lower arm 260, the formula is more complex, but it is still dependent on the height of the beam cubed. The same logic applies, that is, increasing the height is far more impactful on reducing stress than width or wall thickness.

When applying this insight to lower arms 260 in play yards (of the present invention or of other structures beyond the present invention's play yard 1), which must support vertical loads according to the compliance standard for play yards, the result is that the height of beam should be increased as possible, because this gives a benefit that follows the cubed power in the principles of physics discussed above. If one reduces the wall thickness by two but increases the beam height by two there is a roughly 4-times increase in load carrying capacity with the same amount of material. Certain embodiments of the present invention utilizes these principles to enable construction of novel sheet metal lower arms 260 and corner posts 220 that satisfy safety requirements while being constructed from relatively thin sheet metal and in a manner that is not used by any traditional play yards.

For example, there are practical limits to the incorporation of these principles of physics, such as space constraints in material thicknesses that are commonly available. However, certain embodiments of the present invention is configured to maximize the application of these principles to the structure of a traditional play yard. One embodiment of the present invention is a lower arm 260 that is configured in the shape of an approximately 2-inch high beam (see FIGS. 59A and 59B), with an approximately 0.4-inch width, and made of approximately 0.015-inches thick metal. With an 80-lb load in the center of an approximately 24-inch long lower arm 260, the resulting maximum stress is 15,500 psi. A low-grade aluminum, with a tensile strength of only 28,000 psi, is more than sufficient to meet this requirement. The volume of material is just 0.015"×4.8"×24"=1.73". The weight of the lower arm 260 of this example is just 0.173 lbs.

Because the process of extruding aluminum is only effective down to a minimum of 0.050" thickness, it is not possible to make the traditional tubes from a standard extrusion process and achieve such lightweight structures. With steel tubes, the most practical method of making tubes is through welding, which also yields a minimum thickness greater than the 0.015-inches of one embodiment of the present invention. Certain embodiments of the present invention solves these manufacturing limitations through a novel configuration that utilizes two separate pieces of sheet metal that are "C" shaped 500 and interlock to form a structural component. The two separate pieces of sheet metal are joined with rivets 510 or another attachment mechanism 510 that securely joins the two "C" shaped pieces of sheet metal 500 (see FIGS. 59A and 59B). The rivets or similar attachment mechanism 510 provide the additional strength to meet play yard torsional requirements. Depending upon the size of the lower arm 260, the thickness of the sheet metal, and the other structural aspects of play yards 1 of various sizes and shapes, these torsional requirements can be satisfied under certain circumstances by only 5 rivets 510 along each seam where the two "C" shaped pieces 500 meet (see FIG. 59A). However, the number of rivets or attachment mechanisms 510 can vary depending upon changes to the play yard safety requirements, the type of sheet metal being used, the size of the lower arm 260, and the overall size and dimensions of the play yard 1.

Instead of using metal tubes, one embodiment of the present invention is a play yard of a multitude of designs, structures, or configurations, wherein at least some of the parts are made from sheet metal. More specifically, all or some of the following parts and others outlined in this application or in traditional play yards can be constructed from sheet metal, including but not limited to the corner posts 220 (shown in cross-section in FIG. 64), parts of the hub 240 (FIG. 60B), the lower diagonal arms 260 (FIGS. 59A and 59B), and the push rods 280. Construction of many of the play yard parts from sheet metal, instead of metal tubing, creates a thinner, lighter structure overall, which is easier to fabricate and easier to transport. Construction from sheet metal is generally faster and less expensive than construction from other materials. Additionally, construction from sheet metal is particularly suitable to the play yards 1 of the present invention because the sheet metal facilitates the stamping or cutting out of the various slots, which would be significantly more difficult to achieve with metal tubing.

In one embodiment of the present invention, the flat metal pieces can be made from stamped steel and all pieces are cut with about a 2-mm or 3-mm clearance (other clearances may be acceptable depending on the manufacturing process) on all parts for flashing, which may occur during the stamping of the steel in production. The clearance can be varied depending on the manufacturing needs.

Figure 59A:
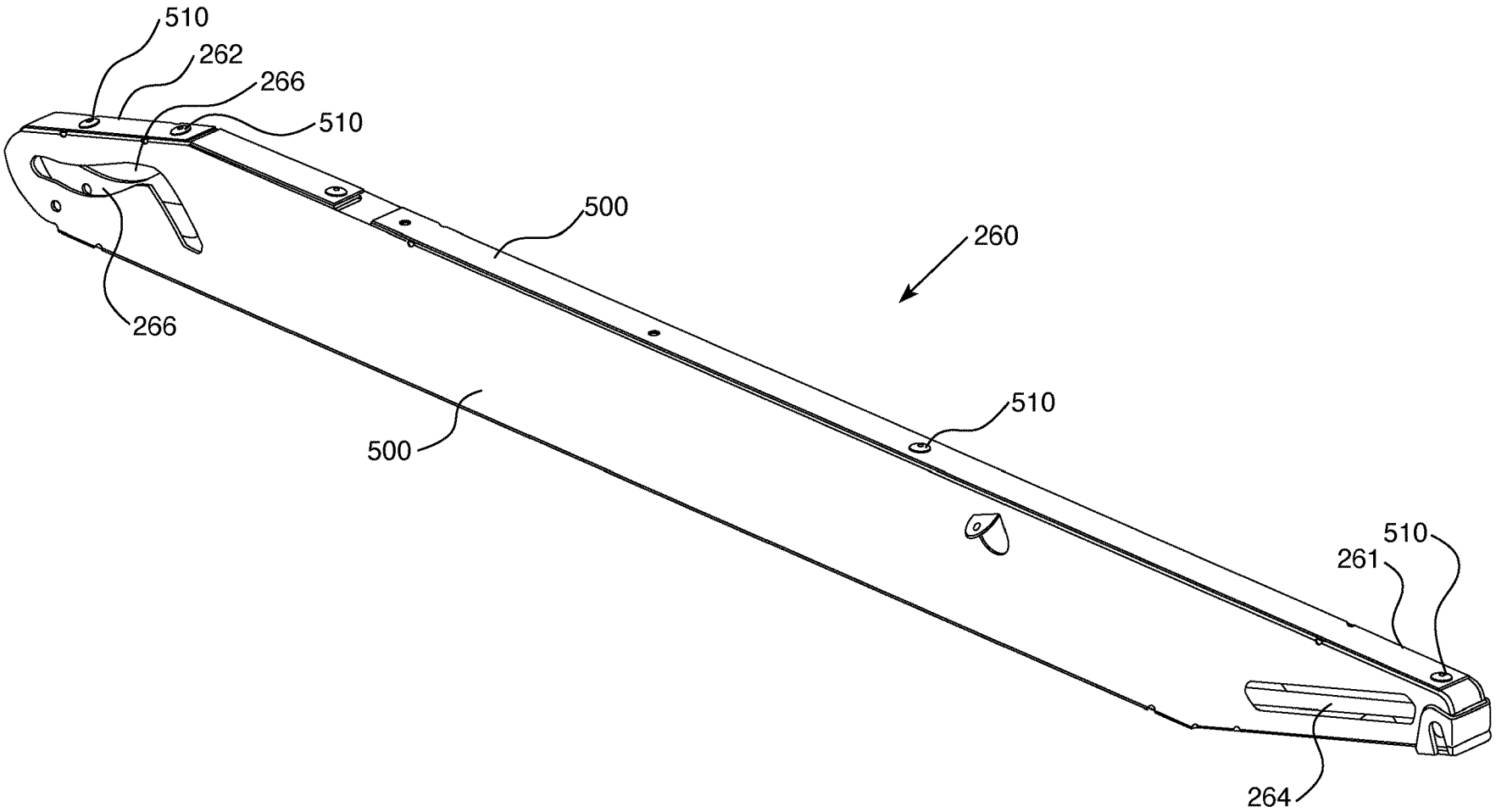
FIG. 59A shows one embodiment of a lower arm comprised of two connected C-shaped pieces of sheet metal.
Figure 59B:
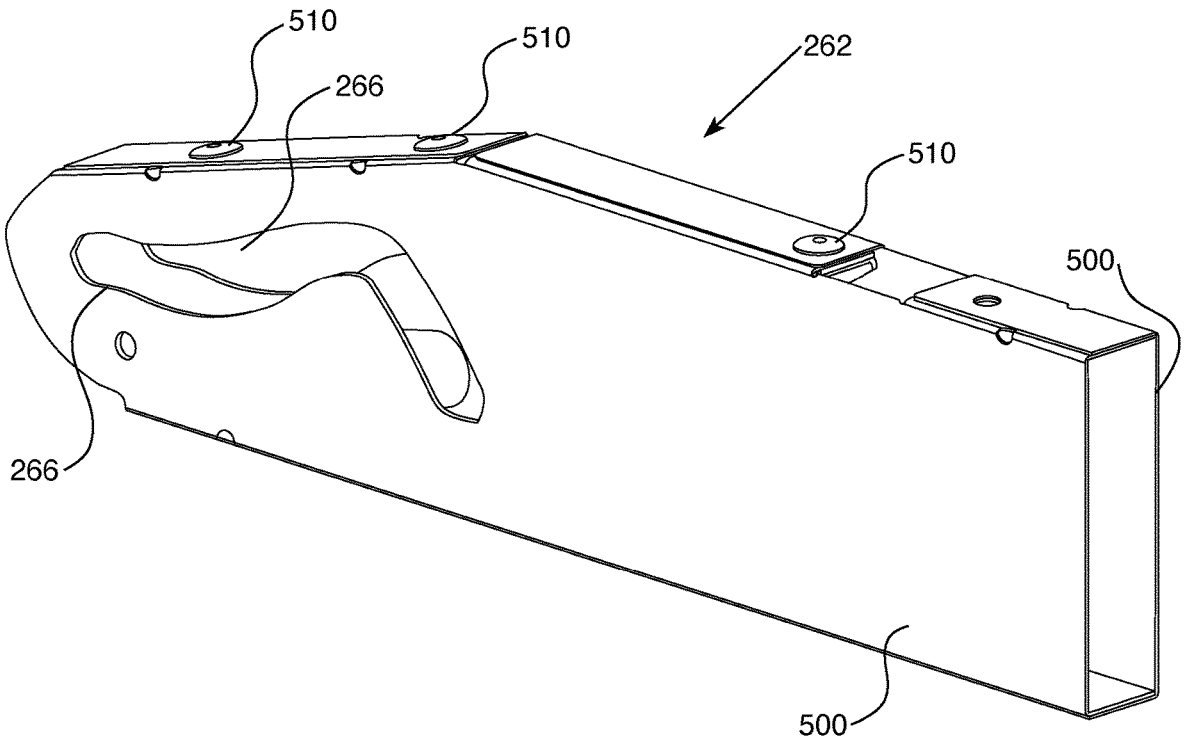
FIG. 59B shows the parallel slots in the end of one embodiment of a lower arm comprised of two connected C-shaped pieces of sheet metal.

For certain of the embodiments of a play yard 1 made of sheet metal according to the present invention, the play yard parts are constructed from sheet metal "tubes" that are made from two pieces of bent sheet metal with two facing "C" cross-sections 500 and are attached together by rivets 510 or other similar attachment means create a tube-like structure (see FIGS. 59A and 59B). This results in play yard parts that can be significantly thinner and lighter in weight, but that have the necessary strength for a play yard. In one embodiment, the sheet metal tubes can be constructed from sheet steel that is about 0.012" thick, a fifth of the welded tubes. This also applies to parts made from aluminum, where sheet metal aluminum can be about 0.016" thick, which are still 4 times thinner than extruded tubes, while satisfying the strength requirements for a play yard. Therefore, sheet metal play yard parts according to these embodiments of the present invention require significantly less material and are less expensive to make because they benefit from the principles of physics as described above and because the cost is proportional to the weight.

There are other advantages to constructing play yards from sheet metal tubes. First, the sheet metal tubes can have a larger diameter, which facilitates the construction and housing of mechanical parts of the play yard inside the tubes. Second, the sheet metal is significantly easier to stamp and create slots as cutouts in than extruded tubes would be. This advantage is particularly important to the inventions described in this application, which utilize a number of slots and/or cutouts for functionality. Finally, the stamping of slots can occur as part of the process of stamping for rivet holes and other functions instead of adding any other steps to production. If required for a play yard design, additional support easily can be added to certain areas of the play yard, such as around the articulation points (e.g. cam paths). However, this support can be localized and, therefore, will add little weight and cost to the play yard.

Figure 47:
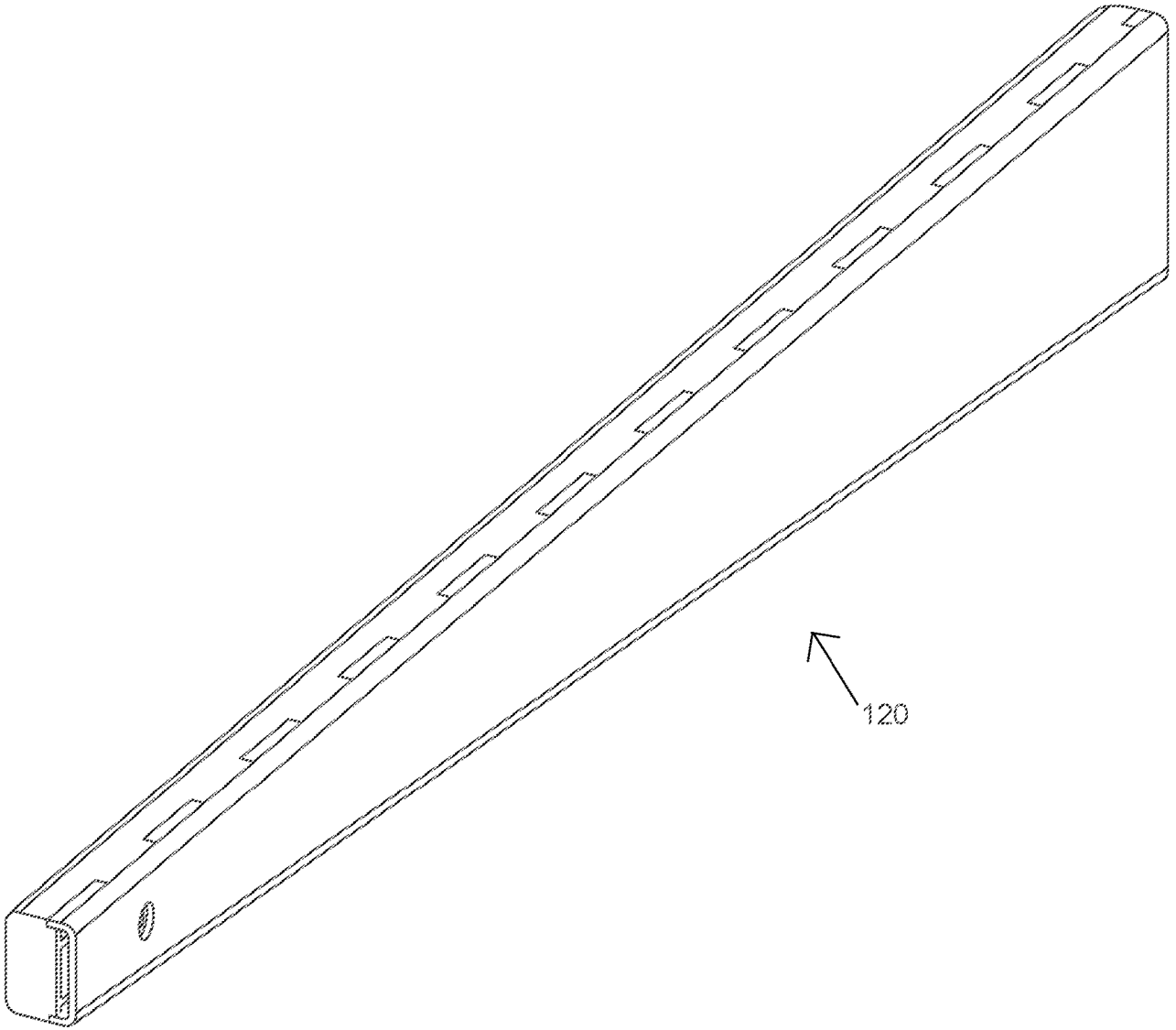
FIG. 47 is one embodiment of a plastic case for a rail.

In order to prevent the thinner metal from buckling under pressure, one embodiment of the present invention enclose certain of the flat metal pieces within interlocking plastic cases 120. FIG. 47 shows one embodiment of a plastic case 120 for an upper rail 32. The inside top and bottom of the plastic cases 120 may have ribs, in one embodiment, which provide support to the flat metal parts, provide additional strength, resist torquing, and prevent the metal from buckling. The plastic cases 120 can be fabricated relatively easily and snapped around select sheet-metal upper pieces. It will be obvious to one skilled in the art that there are many ways to secure the plastic cases 120 to the metal pieces. One possible way is to use rivets to attach the plastic cases to the sheet metal pieces to provide additional support and prevent buckling.

Figure 64:
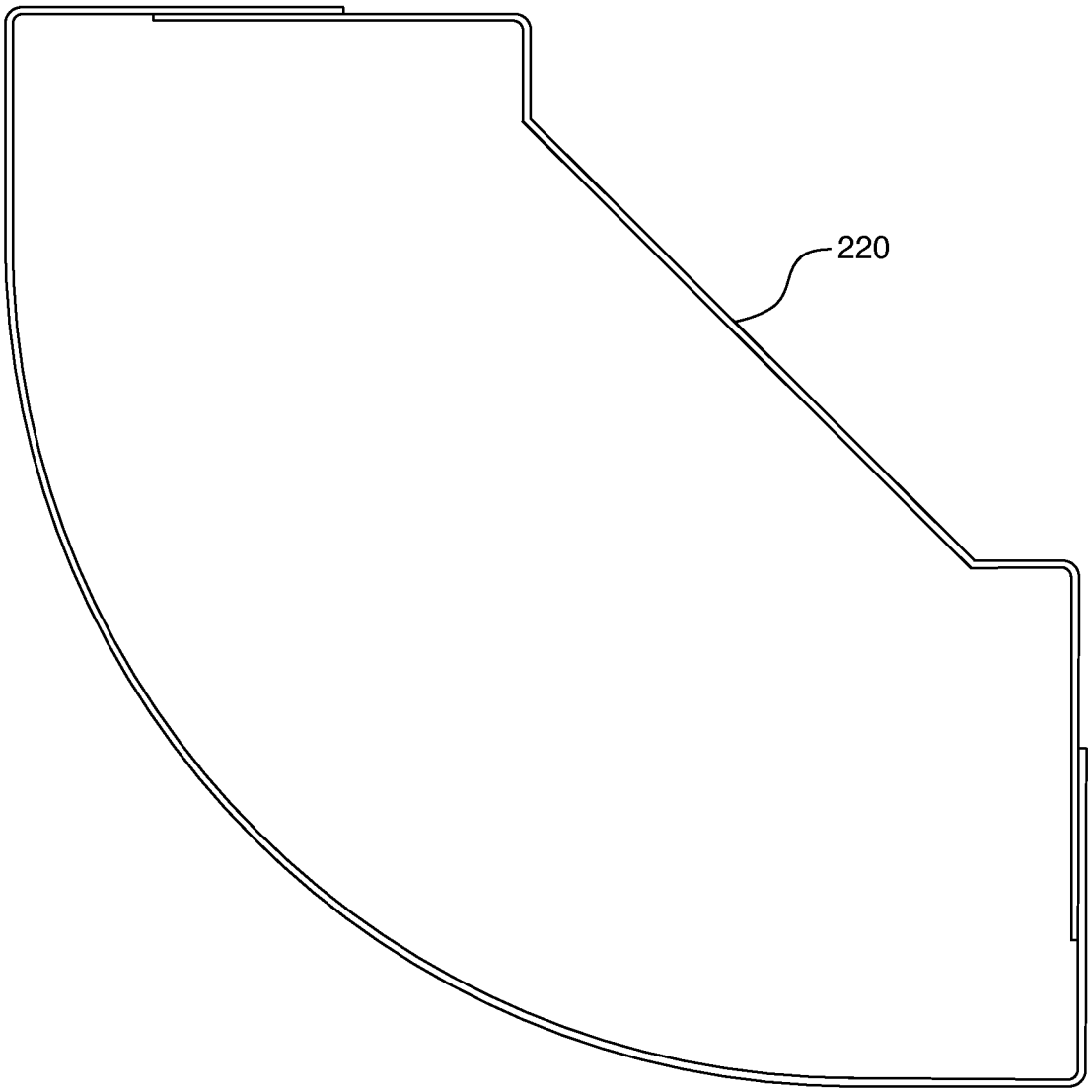
FIG. 64 illustrates a cross-sectional view of one embodiment of a corner post constructed from sheet metal.

Some of the embodiments of the play yard 1 and mechanical control assembly 200 of the present invention are used herein as one example of how to configure the parts of many different play yards out of sheet metal. The mechanical control assembly 200 can be configured such that each corner post 220 is formed from at least one piece of sheet metal formed to provide an outer frame and inner conduit for one of the pull rods 310. See FIG. 64 provides a cross-section illustration of one embodiment of a corner post 220 constructed from two pieces of bent sheet metal. For one embodiment of a mechanical control assembly 200, the corner post 220 is comprised of two pieces of formed sheet metal which are attached to one another to create a tube-like structure (FIG. 64).

Another embodiment of the present invention is a mechanical control assembly 200, wherein each lower arm 260 is formed from at least one piece of sheet metal bent to provide an outer frame and inner conduit for one of the push rods 280. FIGS. 59A and 59B illustrate one embodiment of a lower arm 260 made from bent sheet metal. As shown in FIG. 59B, the lower arm 260 is formed from two pieces of bent sheet metal with each having a "C" cross-section 500 and which are attached to one another to create a tube-like structure.

One embodiment of a lower arm 260 for a foldable structure 1000 made from sheet metal according to the present invention comprises the use of at least one piece of sheet metal bent to form a beam structure. The beam structure of this embodiment is configured to have a height, a width, and a sheet metal thickness sufficient to satisfy any force requirements that are applicable to the foldable structure 1000. Certain embodiments of a sheet metal lower arm 260 are constructed from two pieces of sheet metal and a plurality of attachment mechanisms 510 sufficient to attach the two pieces of sheet metal to one another to create a hollow beam. For some embodiments, the individual pieces of sheet metal can approximate a "C" shape. In other embodiments, one of them can be a "C" shape and the other can approximate a "W" shape. In one embodiment of a sheet metal lower arm 260, the height of the beam is approximately 2-inches, the width of the beam is approximately 0.4-inch, and the thickness of the sheet metal is approximately 0.015-inches.

Similarly, certain embodiments of the present invention encompasses a variety of embodiments of corner posts 220 constructed from bent sheet metal. One embodiment of a sheet metal corner posts 220 comprises at least one piece of sheet metal bent to form a hollow tube having a tube width and a sheet metal thickness sufficient to satisfy any force requirements that are applicable to the foldable structure. Another embodiment comprises two pieces of sheet metal, each of which is bent to create the hollow tube when the two pieces are attached to one another and a plurality of attachment mechanisms 510 sufficient to secure the two pieces of sheet metal to one another. In some embodiments of the present invention, the attachment mechanisms 510 are rivets, but it will be apparent to one skilled in the art that there are numerous ways to securely attach multiple pieces of sheet metal to one another and all such mechanisms 510 are included within the scope of the present invention.

Figure 60A:
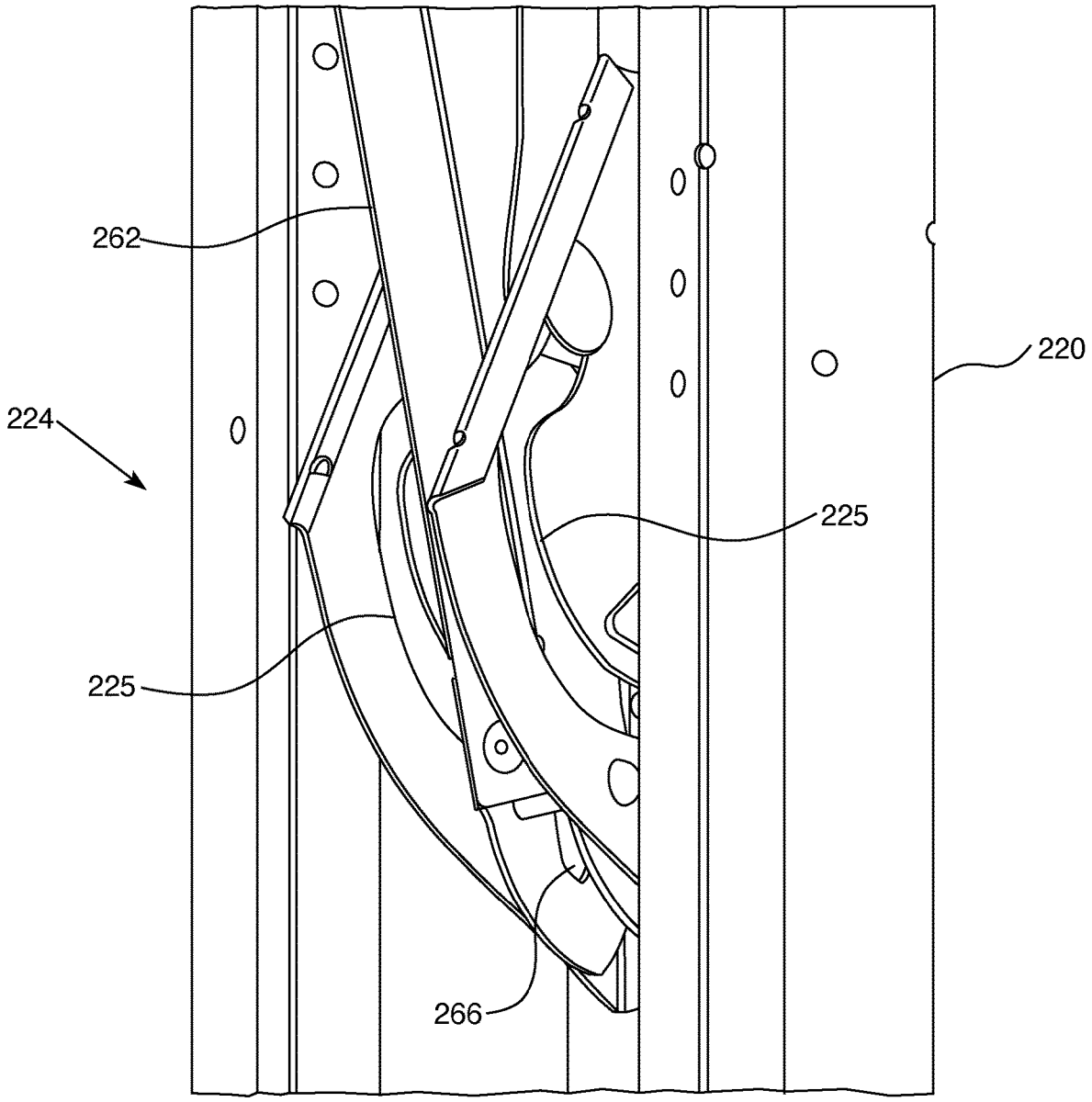
FIG. 60A illustrates a double-yoked corner post mount slot according to one embodiment of the present invention.
Figure 60B:
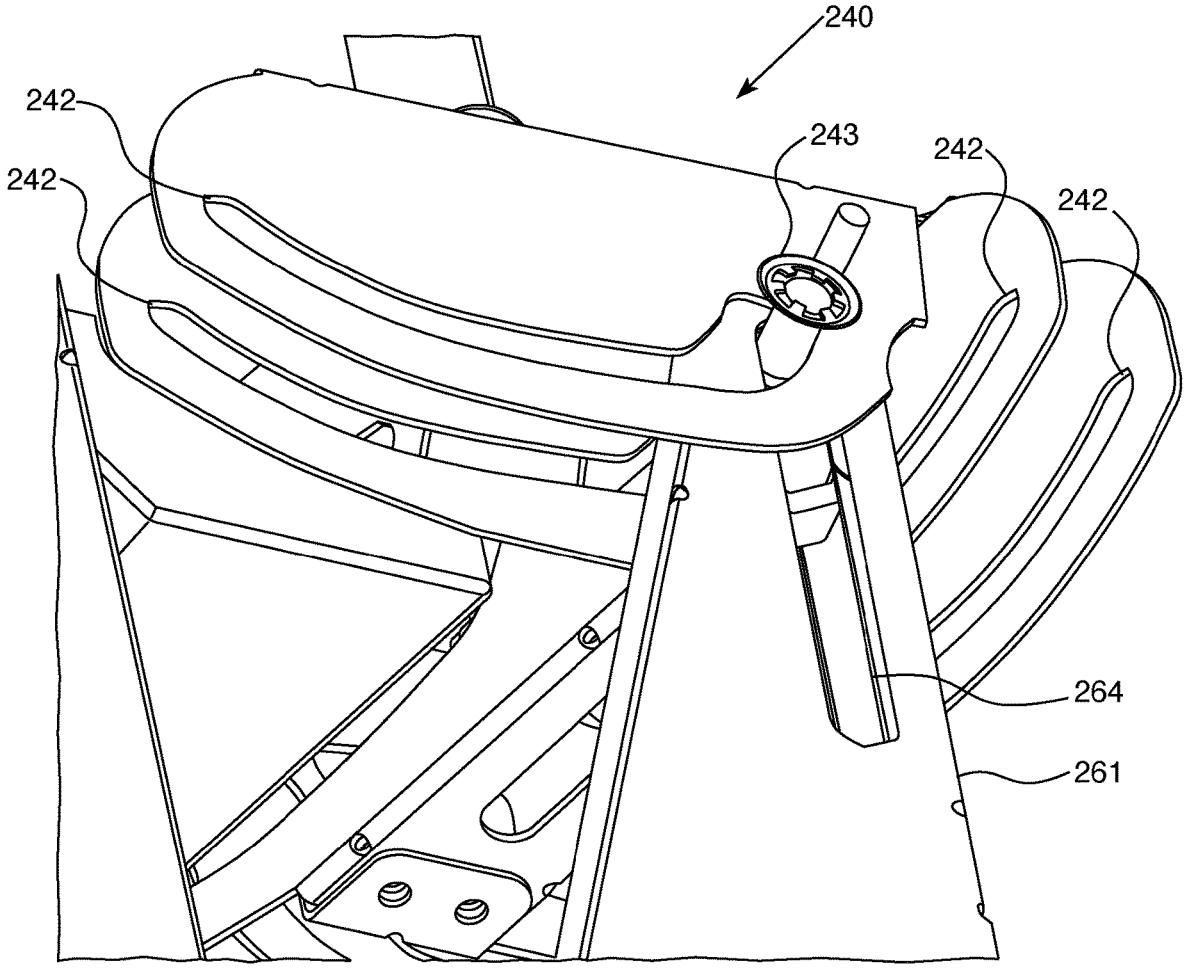
FIG. 60B shows one embodiment of a double-yoked hub slot according to one embodiment of the present invention.

In embodiments of mechanical control assembly 200 or play yard 1 that are constructed from sheet metal, the corner post mount slots 225 and the hub slots 242 can be yoked or configured to have a double-walled structure as shown in FIGS. 60A and 60B. As shown in FIG. 60A, each corner post bottom 222 has a second corner post mount slot 225 that is identical to and located parallel to the first corner post mount slot 225, whereby each lower arm 260 slides between and is attached to the first and second corner post mount slots 225 on each corner post 220. Similarly, as shown in FIG. 60B, each hub slot 242 comprises a pair of parallel adjacent hub slots 242, whereby each lower arm 260 is located between and connected to a pair of parallel adjacent hub slots 242. This double-walled or yoked structure increases the strength of the cam paths. For some play yard embodiments having structural components with slots constructed from sheet metal, parallel sides of the components will have parallel slots cut into them (see FIGS. 59A through 60B).

While the sheet metal construction described above is provided in terms of a play yard 1, it will be obvious to one skilled in the art that the same design principles can be applied to analogous parts of any foldable structure 1000 of similar construction.

It also should be noted that mechanical control assembly 200 works with play yards 1 and foldable structures 1000 of a wide variety of sizes and shapes. The various cam and slots and associated cam roller paths disclosed herein and shown in the accompanying figures are not required to have set dimensions but can be scaled up or down to accommodate the size of the overall structure 1000 and the size and shape of the component parts of that structure 1000. It is the shapes, proportions, angles, and interrelated movements of the individual parts that accomplish the goals of some of the embodiments of the present invention. Therefore, the current inventions should not be limited to cam slots of specific sizes shown in the accompanying figures.

While not shown in the Figures, it will be obvious to one skilled in the art that the sidewalls and floor of the play yard 1 may be made of fabric, mesh, or any similarly pliable materials that are appropriate for children's play yards.

While the disclosure has been described in detail and with reference to specific embodiments thereof, it will be apparent to one skilled in the art that various changes and modifications can be made therein without departing from the spirit and scope of the embodiments. Thus, it is intended that the present disclosure cover all modifications and variations of this disclosure provided they come within the scope of the appended claims and their equivalents. Among other things, the following invention may be embodied as methods or devices. The detailed descriptions of the various embodiments of the present invention should not be taken in a limiting sense.

What is claimed is:

1. A mechanical control assembly for use with an opening and closing foldable structure having open and closed positions and comprising a frame having a plurality of corner posts, each corner post having a top and a bottom, and a plurality of upper arms which arms connect the tops of adjacent corner posts, the mechanical control assembly comprising:

a hub centrally located near a bottom of the foldable structure in an open position and near a top of the foldable structure in a closed position, the hub having a plurality of hub slots;

a plurality of lower arms each lower arm having a hub end with a lower arm hub slot and a post end with a lower arm post slot, with each lower arm connected at the lower arm post end to the bottom of one of the corner posts and at the lower arm hub end to the hub;

a plurality of push rods, each push rod having a push rod corner end and a push rod hub end, wherein each push rod is adjacent to a corresponding lower arm and is slidably connected at the push rod hub end to the lower arm hub slot in the corresponding lower arm hub end, and wherein the push rod corner end is slidably connected to the lower arm post slot in the corresponding lower arm post end;

a plurality of pull rods, each pull rod having an upper end and a lower end, wherein each pull rod lower end is slidably connected to the lower arm post slot and each pull rod upper end is pivotably attached to either at least one corresponding upper arm or at least one corresponding transfer link, each transfer link having a transfer link upper end and a transfer link lower end, wherein each transfer link lower end is pivotably attached to the upper end of a corresponding pull rod and each transfer link upper end is pivotably attached to at least one corresponding upper arm;

wherein each lower arm hub end and the corresponding push rod hub end also are slidably connected to one of the corresponding hub slots, and wherein each lower arm post end and the corresponding pull rod lower end and push rod corner end are slidably mounted to a first corner post mount slot in the corresponding corner post bottom; and whereby the foldable structure is enabled from a closed to an open position by exerting a downward push force on the hub, which downward push force pushes each lower arm and corresponding push rod outward against each corresponding corner post until each lower arm and corresponding push rod pull each pull rod downward until the upper arms each have a substantially horizontal position.

2. The mechanical control assembly of claim 1, wherein each lower arm and corresponding push rod are attached by a shared cam roller and a push angle $\alpha$ is measured between the direction of the downward push force and the outward travel path of the cam roller in the corresponding lower arm hub slot and an angle $\delta$ is measured between the diagonal orientation of the lower arm and horizontal line C that is parallel to the floor, whereby, when angle $\delta$ is between about 35- and 50-degrees, the push angle $\alpha$ is between about 20- and 45-degrees, and, when angle $\delta$ is below about 30-degrees, push angle $\delta$ is below about 55-degrees.

3. The mechanical control assembly of claim 1, wherein angle $\beta$, as measured between a horizontal line and a slope of the inner side of lower arm post slot, ranges between about 1- to 5-degrees when the foldable structure is fully opened.

4. The mechanical control assembly of claim 1, wherein in the lower arm post slot, a vertical distance measured between a center point at the inner terminal end of the lower arm post slot and a center point of pivot cut-out, is between about 0.25 and 0.75 inches, and a horizontal distance measured between the center point at the inner terminal end of the lower arm post slot and the center point of the pivot cut-out is between about 0.125 and 0.75 inches.

5. The mechanical control assembly of claim 1, wherein a width of the inner terminal end of the lower arm post slot is increased.

6. The mechanical control assembly of claim 1, wherein a width of upper terminal end of the corner post mount slot is increased.

7. The mechanical control assembly of claim 1, wherein a width of the inner terminal end of the cam slot is increased.

8. The mechanical control assembly of claim 1, wherein each corner post is formed from at least one piece of sheet metal formed to provide an outer frame and inner conduit for one of the pull rods.

9. The mechanical control assembly of claim 8, wherein the corner post is comprised of two pieces of formed sheet metal and which are attached to one another to create a tube-like structure.

10. The mechanical control assembly of claim 1, wherein each lower arm is formed from at least one piece of sheet metal bent to provide an outer frame and inner conduit for one of the push rods.

11. The mechanical control assembly of claim 10, wherein the lower arm is formed from two pieces of bent sheet metal each have a "C" cross-section and which are attached to one another to create a tube-like structure.

12. The mechanical control assembly of claim 10, wherein the two pieces of bent sheet metal are attached to one another using rivets.

13. The mechanical control assembly of claim 11, wherein each corner post bottom has a second corner post mount slot that is identical to and located parallel to the first corner post mount slot so that each lower arm is located between and connected to the first and second corner post mount slots on each corner post.

14. The mechanical control assembly of claim 11, wherein each hub slot comprises a pair of parallel and adjacent hub slots so that each lower arm is located between and connected to one of the pairs of hub slots.

15. The mechanical control assembly of claim 1, further comprising a hub-lower arm pivot where the lower arm connects to the hub near the hub slot.

16. The mechanical control assembly of claim 1, further comprising a foot that is attached to or near the bottom of each of the corner posts, the foot comprising:

a bottom surface of the foot that faces the floor surface;

a wheel that engages during the opening and closing of the foldable structure, which wheel protrudes through the bottom surface; and a non-slip rest located on the bottom surface.

17. The mechanical control assembly of claim 16, further comprising at least two feet, each foot attached to or near the bottom of one of two adjacent corner posts, wherein each foot further comprises an in-line wheel aligned in a parallel direction to each other and perpendicular to a plane formed by the two adjacent corner posts.

18. A mechanical control assembly for use with an opening and closing foldable structure having open and closed positions and comprising a frame having a plurality of corner posts, each corner post having a top and a bottom, and a plurality of upper arms which arms connect the tops of adjacent corner posts, the mechanical control assembly comprising:

a hub centrally located near a bottom of the foldable structure in an open position and near a top of the foldable structure in a closed position, the hub having a plurality of hub slots;

a plurality of lower arms each lower arm having a hub end with a lower arm hub slot and a post end with a lower arm post slot, with each lower arm connected at the lower arm post end to the bottom of one of the corner posts and at the lower arm hub end to the hub;

a plurality of push rods, each push rod having a push rod corner end and a push rod hub end, wherein each push rod is adjacent to a corresponding lower arm and is slidably connected at the push rod hub end to the lower arm hub slot in the corresponding lower arm hub end, wherein the push rod corner end is slidably connected to the lower arm post slot in the corresponding lower arm post end;

a plurality of pull rods, each pull rod having an upper end and a lower end, wherein each pull rod lower end is slidably connected to the lower arm post slot and each pull rod upper end is pivotably attached to either at least one corresponding upper arm or at least one corresponding transfer link, each transfer link having a transfer link upper end and a transfer link lower end, wherein each transfer link lower end is pivotably attached to the upper end of a corresponding pull rod and each transfer link upper end is pivotably attached to at least one corresponding upper arm;

wherein each lower arm hub end and the corresponding push rod hub end also are slidably connected to one of the corresponding hub slots, and wherein each lower arm post end and the corresponding pull rod lower end are slidably mounted to a corner post mount slot in the corresponding corner post bottom; and whereby the foldable structure is enabled from a closed to an open position by exerting a downward push force on the hub, which downward push force pushes each lower arm and corresponding push rod outward against each corresponding corner post forcing the corner posts to an orientation that is beyond substantially parallel to vertical until each lower arm and corresponding push rod pull each pull rod downward until the upper arms each have a substantially horizontal position.

19. The assembly of claim 18, wherein the corner posts are oriented in the range from 6-degrees to 12-degrees from vertical during the opening of the play yard.

* * * * *